US011618261B2

(12) United States Patent
Idaka et al.

(10) Patent No.: US 11,618,261 B2
(45) Date of Patent: Apr. 4, 2023

(54) INK JET RECORDING APPARATUS

(71) Applicant: Keyence Corporation, Osaka (JP)

(72) Inventors: Mamoru Idaka, Osaka (JP); Atsushi Kitamura, Osaka (JP)

(73) Assignee: KEYENCE CORPORATION, Osaka (JP)

( * ) Notice: Subject to any disclaimer, the term of this patent is extended or adjusted under 35 U.S.C. 154(b) by 200 days.

(21) Appl. No.: 16/987,531

(22) Filed: Aug. 7, 2020

(65) Prior Publication Data

US 2021/0070054 A1 Mar. 11, 2021

(30) Foreign Application Priority Data

Sep. 10, 2019 (JP) ..... JP2019-164849

(51) Int. Cl.
*B41J 2/165* (2006.01)
*B41J 2/045* (2006.01)

(52) U.S. Cl.
CPC ..... *B41J 2/16552* (2013.01); *B41J 2/0451* (2013.01); *B41J 2/04551* (2013.01); *B41J 2/04573* (2013.01); *B41J 2/16579* (2013.01); *B41J 2002/16573* (2013.01)

(58) Field of Classification Search
CPC ... B41J 2/16552; B41J 2/09; B41J 2/08; B41J 2/0451; B41J 2/04581; B41J 2/16579; B41J 2/04526; B41J 2/04561; B41J 2/04551; B41J 2/04573; B41J 2002/16573
See application file for complete search history.

(56) References Cited

U.S. PATENT DOCUMENTS 6,062,672 A * 5/2000 Ishize ..... B41J 2/16523 347/30
2002/0063745 A1* 5/2002 Osborne ..... B41J 2/16579 347/19
2010/0225683 A1* 9/2010 Yamashiro ..... B41J 2/16517 347/1

(Continued)

FOREIGN PATENT DOCUMENTS

JP 2004130574 A 4/2004
JP 201574183 A 4/2015

OTHER PUBLICATIONS

U.S. Appl. No. 16/987,541, filed Aug. 7, 2020 (199 pages).

*Primary Examiner* — Jannelle M Lebron
(74) *Attorney, Agent, or Firm* — Kilyk & Bowersox, P.L.L.C.

(57) ABSTRACT

An ink jet recording apparatus I includes a printing head 1 configured to house, on the inside, a nozzle 12, a charging electrode 13, a deflection electrode 15, and a gutter 16, a maintenance-pattern storing unit 102*b* configured to store, respectively in association with types of abnormalities, a plurality of kinds of maintenance operations executable in the ink jet recording apparatus I, a flag storing unit 102*a* configured to store occurrence of an abnormality in the ink jet recording apparatus I as an error flag corresponding to a type of the abnormality, and a control unit 101 configured to select, based on the type of the abnormality corresponding to the error flag stored in the flag storing unit 102*a*, one maintenance operation out of the plurality of kinds of maintenance operations stored in the maintenance-pattern storing unit 102*b* and execute the maintenance operation.

13 Claims, 30 Drawing Sheets

(56) References Cited

U.S. PATENT DOCUMENTS

| | | | | |
|---|---|---|---|---|
| 2012/0176640 | A1* | 7/2012 | Furukawa | B41J 2/16579 358/1.14 |
| 2014/0307282 | A1* | 10/2014 | Sato | H04N 1/00477 358/1.14 |
| 2020/0034086 | A1* | 1/2020 | Sasaki | G06F 3/1203 |
| 2020/0101741 | A1* | 4/2020 | Arima | B41J 29/02 |

* cited by examiner

FIG. 8

| ERROR TYPE | LAST STOP TIME | LAST STOP TIME BUT ONE | STOP TIME THREE TIMES BEFORE | ... |
|---|---|---|---|---|
| NOZZLE CLOGGING | ✔ | ✔ | – | ... |
| DEFLECTION LEAK | – | ✔ | – | ... |
| OTHER ERRORS | – | – | – | ... |

FIG. 9

| | SELECTION CONDITIONS | | PROCESSING CONTENT | | |
|---|---|---|---|---|---|
| | LAST ERROR | STOP PERIOD | AUTOMATIC CLEANING | ERROR RELEASE PROCESSING | START PROCESSING |
| MAINTENANCE PROCESSING A | NONE | 1 HOUR OR LESS | UNEXECUTED | NONE | SIMPLE START |
| MAINTENANCE PROCESSING B | NONE | 1 DAY OR LESS | SHORT-TIME CLEANING | NONE | NORMAL START |
| MAINTENANCE PROCESSING C | NONE | 1 WEEK OR LESS | NORMAL CLEANING | NONE | NORMAL START |
| MAINTENANCE PROCESSING D | NONE | 2 WEEKS OR LESS | POWERFUL CLEANING | NONE | NORMAL START |
| MAINTENANCE PROCESSING E | NOZZLE CLOGGING | 10 MINUTES OR LESS | NORMAL CLEANING | INTERMITTENT JETTING | NORMAL START |
| MAINTENANCE PROCESSING F | DEFLECTION LEAK | 1 HOUR OR LESS | POWERFUL CLEANING | NONE | NORMAL START |
| MAINTENANCE PROCESSING G | DEFLECTION LEAK | 1 DAY OR LESS | POWERFUL CLEANING | NONE | NORMAL START |

PROCESS A

PROCESS B

PROCESS D

PROCESS E

PROCESS F

PROCESS G

PROCESS H

FIG. 17

| | SELECTION CONDITIONS | | | | | PROCESSING CONTENT | | |
|---|---|---|---|---|---|---|---|---|
| | LAST ERROR | LAST STOP PERIOD | LAST ERROR BUT ONE | LAST STOP PERIOD BUT ONE | SENSOR INFORMATION | AUTOMATIC CLEANING | ERROR RELEASE PROCESSING | START PROCESSING |
| MAINTENANCE PROCESSING H | NONE | 1 HOUR OR LESS | NONE | IGNORED | NONE | UNEXECUTED | NONE | SIMPLE START |
| MAINTENANCE PROCESSING I | DEFLECTION LEAK | 1 HOUR OR LESS | NONE | 1 HOUR OR LESS | NOZZLE AXIS ABNORMALITY | POWERFUL CLEANING | INTERMITTENT JETTING | SIMPLE START |
| MAINTENANCE PROCESSING J | NONE | 10 MINUTES OR LESS | NONE | 10 MINUTES OR LESS | HEAD SOIL | POWERFUL CLEANING | NONE | SIMPLE START |
| MAINTENANCE PROCESSING K | DEFLECTION LEAK | 10 MINUTES OR LESS | DEFLECTION LEAK | 10 MINUTES OR LESS | HEAD SOIL | – | – | – |
| MAINTENANCE PROCESSING L | NONE | IGNORED | NONE | IGNORED | NONE | UNEXECUTED | NONE | NORMAL START |

INK JET RECORDING APPARATUS

CROSS-REFERENCE TO RELATED APPLICATIONS

The present application claims foreign priority based on Japanese Patent Application No. 2019-164849, filed Sep. 10, 2019, the contents of which are incorporated herein by reference.

BACKGROUND OF THE INVENTION

1. Field of the Invention

The technique disclosed herein relates to an ink jet recording apparatus.

2. Description of Related Art

There has been known an ink jet recording apparatus for applying printing to work.

For example, JP-A-2015-74183 (Patent Literature 1) discloses an ink jet recording apparatus including a nozzle (a nozzle head) that ejects ink, a charging electrode that charges particulate ink (ink droplets) ejected from the nozzle, a deflection electrode that deflects a flying direction of the ink charged by the charging electrode, and a gutter that collets the ink undeflected by the deflection electrode.

The ink jet recording apparatus disclosed in Patent Literature 1 can realize desired printing by impacting the particulate ink on the surface of the work and adjusting an impacting position of the particulate ink with the deflection electrode.

A maintenance operation such as cleaning of the vicinity of the nozzle needs to be periodically carried out on such an ink jet recording apparatus.

JP-A-2004-130574 (Patent Literature 2) discloses, as an example of a technique related to such a maintenance operation, an ink jet recording apparatus capable of cleaning ink supply and collection paths.

The ink jet recording apparatus disclosed in Patent Literature 2 includes an operation panel for displaying various kinds of information. The operation panel displays a procedure of the maintenance operation such as a cleaning procedure for the nozzle as guidance. A user can carry out the maintenance operation according to the guidance displayed on the operation panel.

SUMMARY OF THE INVENTION

However, in actual operation, content and a time period for carrying out the maintenance operation depend on determination by the user. Accordingly, a user having less technical knowledge and experience about the maintenance operation is likely to be unable to appropriately carry out the maintenance operation.

Therefore, as disclosed in Patent Literature 2, it is conceivable to display the guidance on the operation panel. However, as a result of intensive studies by the inventors, the inventors noticed that such guidance alone was insufficient. More specifically, the ink jet recording apparatus disclosed in Patent Literature 2 has a function of counting a time period elapsed from an ink stop and, when the user is about to resume operation after leaving the ink jet recording apparatus untouched for a long time, displays, on the operation panel, a warning message indicating that the ink is likely to be not normally jetting from the nozzle. On the other than, for example, an error such as nozzle clogging sometimes occurred during the last operation. In such a case, even if the ink jet recording apparats is not left untouched for a long time from the last ink stop, it is desirable to carry out the maintenance operation such as nozzle cleaning for a sufficiently long time before the operation resumption. However, the user having less technical knowledge and experience is likely to not notice the fact of the occurrence of the error in the past. Even if the user notices the fact of the occurrence of such an error, it is not easy for the user to appropriately determine content of the maintenance operation and how long the user should carry out the maintenance operation.

A technique disclosed herein has been devised in view of such points, and an object of the technique is to enable a user having less technical knowledge and experience to appropriately carry out a maintenance operation.

Specifically, a first aspect of the present disclosure relates to an ink jet recording apparatus that performs printing by impacting particulate ink on work. The ink jet recording apparatus includes: a printing head configured to house, on an inside, a nozzle that ejects ink, a charging electrode that charges the particulate ink ejected from the nozzle, a deflection electrode that deflects a flying direction of the ink charged by the charging electrode, and a gutter that collects the ink undeflected by the deflection electrode, the printing head ejecting the ink deflected by the deflection electrode to an outside; and a controller including an ink supply unit that supplies the ink to the nozzle and a solvent supply unit that supplies a solvent to the nozzle.

According to the first aspect of the present disclosure, the ink jet recording apparatus includes: a maintenance-pattern storing unit configured to store, in association with each other, a plurality of different types of abnormalities that occur in the ink jet recording apparatus and a plurality of kinds of maintenance operations executable in the ink jet recording apparatus; a flag storing unit configured to store occurrence of an abnormality in the ink jet recording apparatus as an error flag corresponding to a type of the abnormality; and a control unit configured to select, based on the type of the abnormality corresponding to the error flag stored in the flag storing unit, one maintenance operation out of the plurality of kinds of maintenance operations stored in the maintenance-pattern storing unit and execute the maintenance operation.

With this configuration, the maintenance-pattern storing unit stores, in association with each other, the types of the abnormalities that could occur in the ink jet recording apparatus and the maintenance operations executable on the apparatus. A maintenance operation corresponding to a type of an abnormality can be automatically selected based on content of the storage. A mechanism not requiring technical knowledge and experience is realized by automatically selecting the maintenance operation.

In this way, with the configuration explained above, it is possible to carry out an appropriate maintenance operation irrespective of knowledge and experience of a user.

According to a second aspect of the present disclosure, the control unit may select, based on a type of an abnormality corresponding to an error flag not cleared in the flag storing unit among a plurality of the error flags, one maintenance operation out of the plurality of kinds of maintenance operations and execute the maintenance operation.

According to a third aspect of the present disclosure, the ink jet recording apparatus may further include a time measuring unit configured to measure a stop period from execution of stop processing for the ink jet recording apparatus to a start of start processing for the ink jet recording apparatus. The maintenance-pattern storing unit may store the plurality of kinds of maintenance operations respectively in association with the types of the abnormalities and the stop period. The control unit may select, based on the type of the abnormality corresponding to the error flag stored in the flag storing unit and the stop period measured by the time measuring unit, one maintenance operation out of the plurality of kinds of maintenance operations and execute the maintenance operation.

The time measuring unit may set, as the stop period, a difference between time when the stop processing is executed and time when the start processing is started or may set, as the stop period, a time period measured by a timer unrelated with the times.

For example, when a cleaning operation is carried out as the maintenance operation, hardening of the ink progresses when the stop period of the ink jet recording apparatus is long compared with when the stop period is short. The cleaning operation needs to be carried out for a longer time because of the progress of the hardening of the ink.

In this way, the time for carrying out the cleaning operation increases or decreases according to the stop period of the ink jet recording apparatus. Such a tendency is considered to be present in a maintenance operation in general other than the cleaning operation.

With the configuration explained above, the maintenance-pattern storing unit stores, in association with each other, the stop period of the ink jet recording apparatus and the maintenance operation executable on the apparatus in addition to the type of the abnormality. The maintenance operation corresponding to the type of the abnormality can be automatically selected based on content of the storage. Consequently, a more appropriate maintenance operation can be carried out.

According to a fourth aspect of the present disclosure, the maintenance-pattern storing unit may store at least one maintenance operation among the plurality of kinds of maintenance operations in association with a case in which all the error flags are cleared in the flag storing unit. The control unit may select and execute maintenance operations respectively when all the error flags are cleared in the flag storing unit and when any one of the error flags is not cleared. An execution time of the maintenance operation selected when all the error flags are cleared in the flag storing unit may be short compared with an execution time of the maintenance operation selected when any one of the error flags is not cleared.

In general, maintenance operations carried out on an ink jet recording apparats include not only operation carried out when an abnormality occurs in the apparatus but also operation carried out when an abnormality does not occur. The latter operation is considered to be able to be performed in a shorter time because it is unnecessary to solve the abnormality.

With the configuration explained above, the execution time of the maintenance operation selected when an abnormality does not occur, that is, when all the error flags are cleared is set short compared with the execution time of the maintenance operation selected when an abnormality occurs, that is, any one of the error flags is not cleared. Consequently, a more appropriate maintenance operation can be carried out.

According to a fifth aspect of the present disclosure, the control unit may select, based on a type of an abnormality corresponding to an error flag stored at a point in time when power supply to the ink jet recording apparatus is interrupted among the error flags, one maintenance operation out of the plurality of kinds of maintenance operations and execute the maintenance operation.

With this configuration, the control unit selects a maintenance operation based on the type of the abnormality at the point in time when the power supply to the ink jet recording apparatus is interrupted, for example, a point in time when the operation of the ink jet recording apparatus is temporarily stopped. Consequently, the maintenance operation can be more appropriately carried out.

According to the sixth aspect of the present disclosure, the control unit may select one maintenance operation out of the plurality of kinds of maintenance operations and execute the maintenance operation when the ink jet recording apparatus is turned on.

With this configuration, the control unit executes the maintenance operation when the ink jet recording apparatus is turned on, for example, when the operation of the ink jet recording apparatus is resumed. Consequently, a more appropriate maintenance operation can be carried out.

According to a seventh aspect of the present disclosure, the plurality of kinds of maintenance operations may include a plurality of kinds of cleaning operations for performing cleaning using a solvent supplied from the solvent supply unit.

With this configuration, a more appropriate maintenance operation can be carried out.

According to an eighth aspect of the present disclosure, the plurality of cleaning operations may be set such that at least one of execution times thereof and supply paths of the solvent are different from one another.

With this configuration, a more appropriate maintenance operation can be carried out.

According to a ninth aspect of the present disclosure, the ink jet recording apparatus may further include: a voltage detecting unit configured to detect a voltage applied to the deflection electrode; and a flow-rate detecting unit configured to detect a flow rate of the ink collected by the gutter. The maintenance-pattern storing unit may store the plurality of kinds of maintenance operations respectively in association with a detection result by at least one of the voltage detecting unit and the flow-rate detecting unit. The control unit may select, based on the detection result by at least one of the voltage detecting unit and the flow-rate detecting unit, one maintenance operation out of the plurality of kinds of maintenance operations and execute the maintenance operation.

This configuration is advantageous in managing the error flag.

According to a tenth aspect of the present disclosure, the ink jet recording apparatus may further include: a head station to which the printing head is attached; a detecting unit provided in the head station and configured to detect the attachment of the printing head; and an operation unit provided in the head station or the controller and for causing the control unit to start the maintenance operation. The control unit may execute the maintenance operation on the printing head when the operation unit is operated in a state in which the printing head is attached to the head station.

With this configuration, in order to execute the maintenance operation, the printing head needs to be attached to the head station. The maintenance operation is executable only in a state in which the printing head is attached to the head station. Accordingly, it is possible to improve safety of the maintenance operation and align the posture of the printing head at the time when the maintenance operation is executed. It is possible to improve convenience of use of the ink jet recording apparatus.

According to an eleventh aspect of the present disclosure, the head station may include: a display unit configured to display information related to the maintenance operation; and a power supply configured to supply electric power to the display unit.

With this configuration, it is possible to improve convenience of use of the ink jet recording apparatus.

As explained above, with the ink jet recording apparatus, even a user having less technical knowledge and experience can appropriately carry out a maintenance operation.

BRIEF DESCRIPTION OF THE DRAWINGS

FIG. 8 is a diagram schematically illustrating contents of error flags;

FIG. 9 is a table illustrating details of maintenance processing A to maintenance processing G;

FIG. 17 is a table illustrating details of maintenance processing H to maintenance processing L;

DESCRIPTION OF EMBODIMENTS

An embodiment of the present disclosure is explained below with reference to the drawings. Note that the following explanation is an illustration.

That is, in this specification, an industrial ink jet printer is explained as an example of an ink jet recording apparatus. However, a technique disclosed herein can be applied to, irrespective of names such as the ink jet recording apparatus and the industrial ink jet printer, apparatuses in general that use ink jet.

In this specification, printing by the ink jet recording apparatus is explained. However, the "printing" includes all machining processes applied with ink jet such as printing of characters and marking of figures.

Overall Configuration

Figure 1:
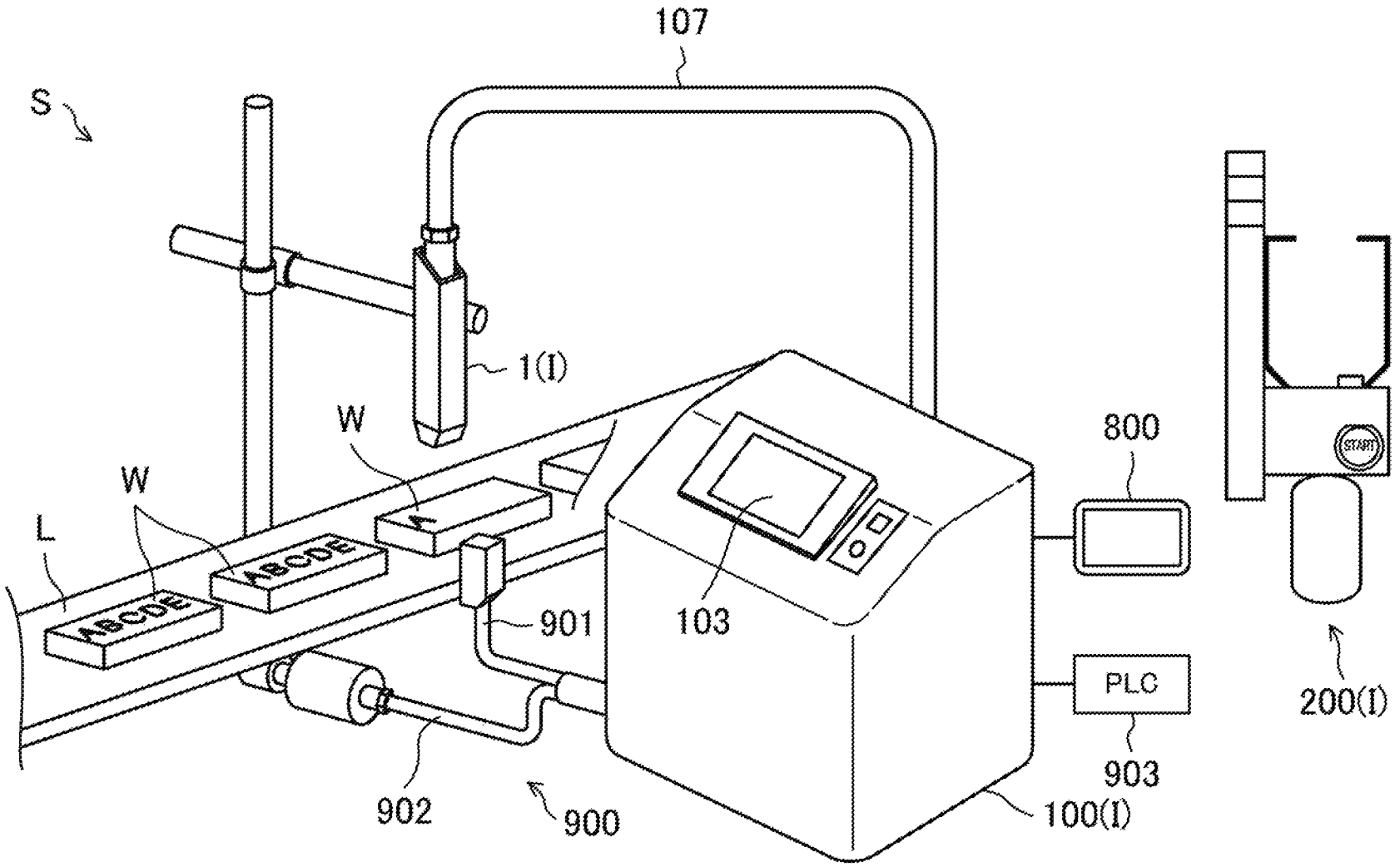
FIG. 1 is a diagram illustrating an overall configuration of an automatic printing system.
Figure 2A:
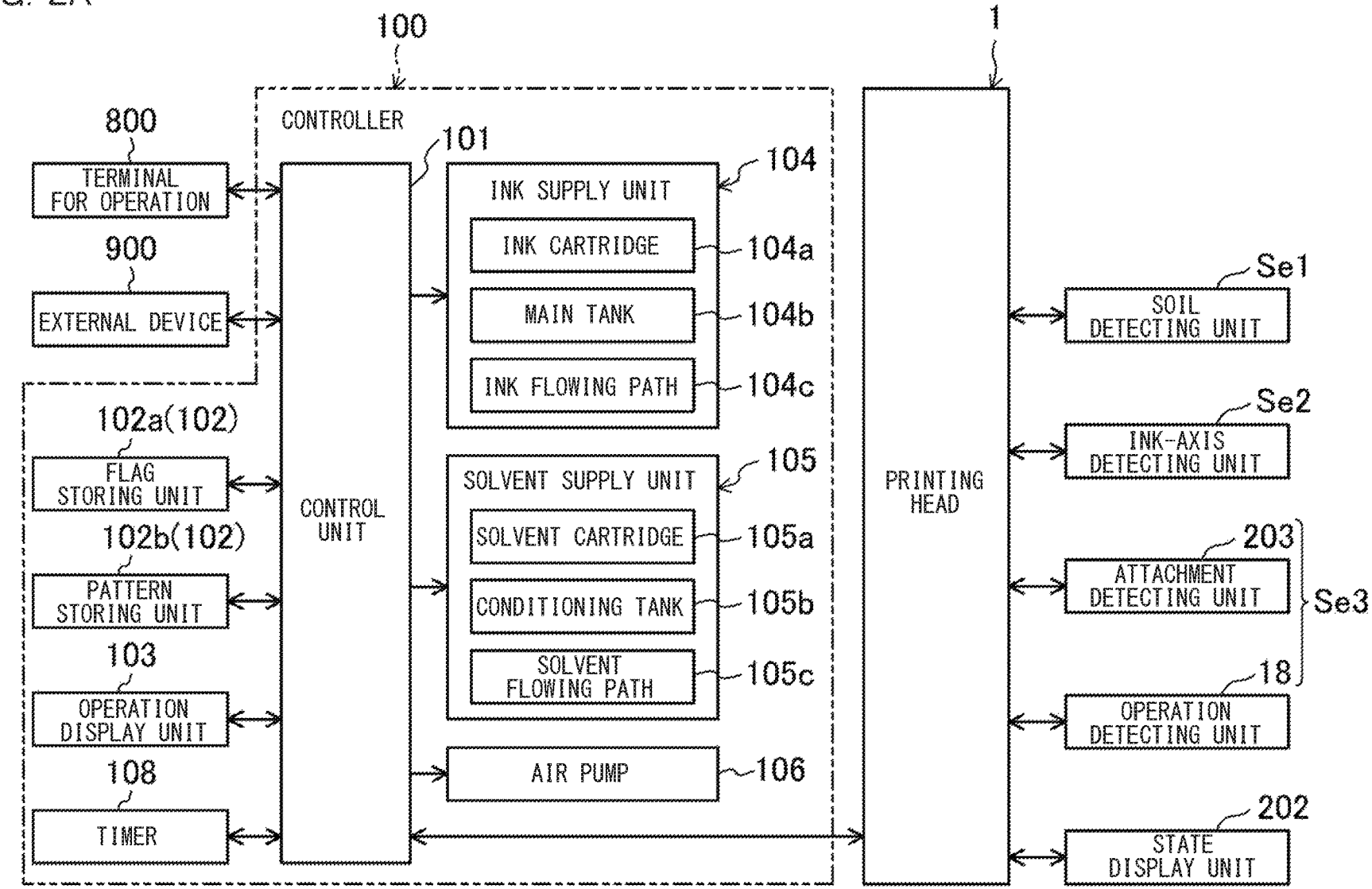
FIG. 2A is a diagram illustrating a schematic configuration of an ink jet recording apparatus.
Figure 2B:
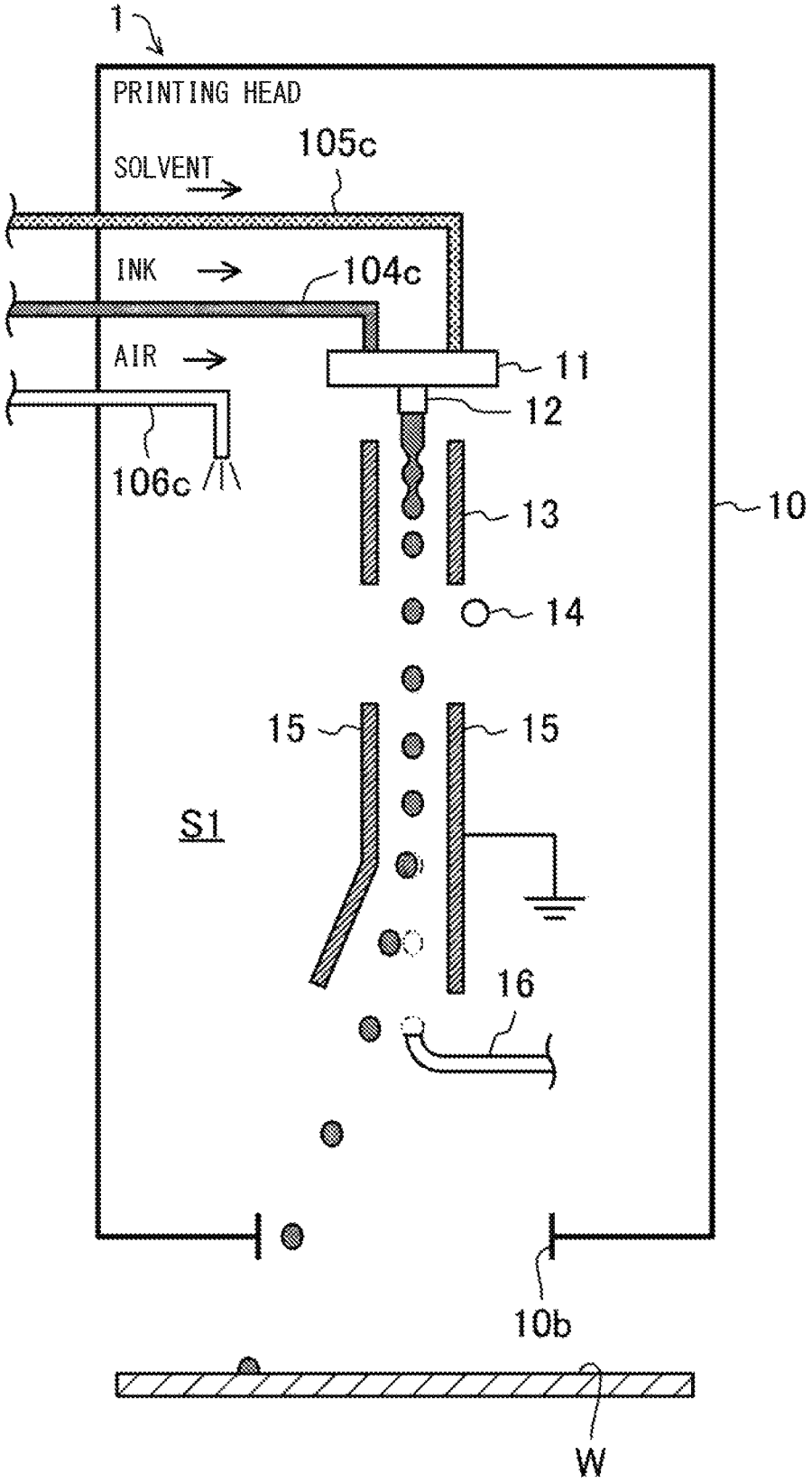
FIG. 2B is a diagram illustrating a schematic configuration of a printing head.
Figure 3:
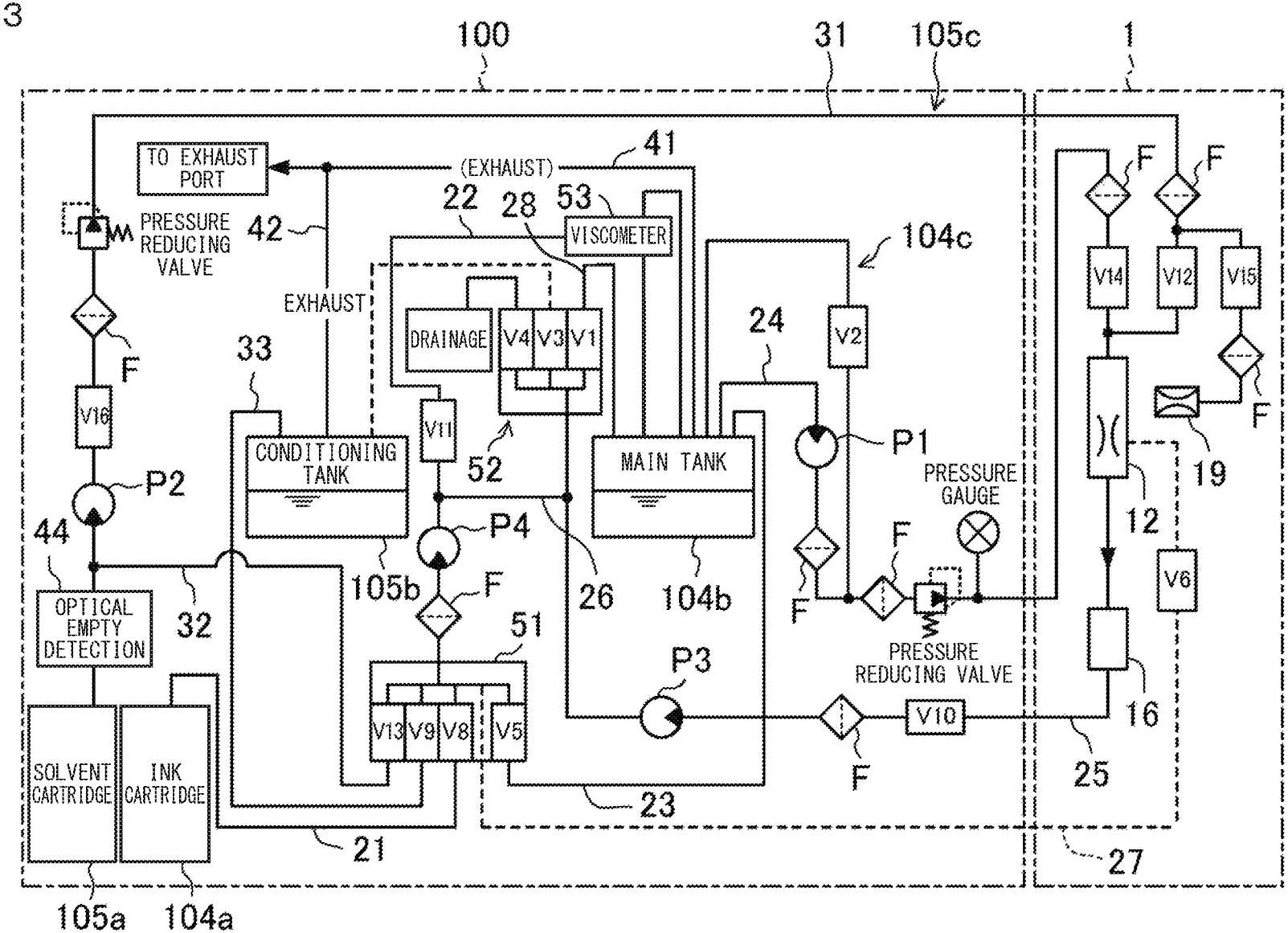
FIG. 3 is a diagram illustrating paths of ink and a solvent in the ink jet recording apparatus.

FIG. 1 is a diagram illustrating an overall configuration of an automatic printing system S. FIG. 2A is a diagram illustrating a schematic configuration of an ink jet recording apparatus I. FIG. 2B is a diagram illustrating a schematic configuration of a printing head 1 in the ink jet recording apparatus I. FIG. 3 is a diagram illustrating paths of ink and a solvent in the ink jet recording apparatus I. The automatic printing system S illustrated in FIG. 1 is set in a conveyance line L of a factory or the like and is configured to apply, in order, printing to works W flowing in the conveyance line L. Note that an application target of the present disclosure is not limited to the automatic printing system S. The present disclosure can also be applied to a printing system that uses a method other than an automatic method.

Specifically, the automatic printing system S includes the ink jet recording apparatus I that impacts particulate ink (ink droplets) on the work W to perform printing and a terminal for operation 800 and an external device 900 connected to the ink jet recording apparatus I. Note that the terminal for operation 800 and the external device 900 are not essential.

Specifically, the ink jet recording apparatus I illustrated in FIGS. 1 to 3 includes the printing head 1 that ejects ink droplets from a nozzle 12 and impacts the ink droplets on the work W, a controller 100 that supplies a control signal, ink, and a solvent to the printing head 1, and a head station 200 for maintaining and inspecting the printing head 1. The controller 100 supplies the control signal to the printing head 1 to control a trajectory of the ink droplets. Consequently, an impacting position of the ink droplets on the work W is adjusted and desired printing is realized. By attaching the printing head 1 to the head station 200, a predetermined maintenance operation is executed on the printing head 1.

In particular, the ink jet recording apparatus I according to this embodiment is configured as an ink jet printer of a so-called continuous type (a continuous ink jet printer: CIJ). That is, in the ink jet recording apparatus I, in order to prevent clogging (in particular, clogging of the nozzle 12) due to volatility of the ink, even when printing is not executed, the ink is always circulating on the inside of the ink jet recording apparatus I. By adopting the continuous type, it is possible to use quick-drying ink without causing clogging.

In order to realize the circulation of the ink, the printing head 1 includes, in addition to the nozzle 12 that ejects the ink or the solvent, a gutter 16 that collects the ink or the solvent ejected from the nozzle 12. The ink or the solvent fed into the printing head 1 from the controller 100 is ejected from the nozzle 12 and collected by the gutter 16. The ink or the solvent collected in this way is fed back to the controller 100 and reused. By repeatedly performing such a process, the ink can be circulated.

The terminal for operation 800 includes, for example, a central processing unit (CPU) and a storage device and is connected to the controller 100. The terminal for operation 800 functions as a terminal for setting machining conditions in printing and indicating information relating to the printing to a user.

Note that the machining conditions according to this embodiment include, in addition to content of a character string or the like that should be printed, conditions and parameters relating to a maintenance operation for the printing head 1.

Note that, for example, the terminal for operation 800 can be incorporated in and integrated with the controller 100. In this case, a name such as control unit is used rather than a name "terminal for operation". At least in this embodiment, the terminal for operation 800 and the controller 100 are separated.

The external device 900 is connected to the controller 100 according to necessity. In an example illustrated in FIGS. 1 and 2A, a work detection sensor 901, a conveyance speed sensor 902, and a programmable logic controller (PLC) 903 are provided as the external device 900.

Specifically, the work detection sensor 901 detects presence or absence of the work W in the conveyance line L and outputs a signal (a detection signal) indicating a result of the detection to the controller 100. The detection signal output from the work detection sensor 901 functions as a trigger (a printing trigger) for starting printing.

As illustrated in FIG. 2A, the PLC 903 is electrically connected to the controller 100. The PLC 903 is used in order to control the automatic printing system S according to a predetermined sequence.

Respective hardware configurations of the controller 100 and the printing head 1 and a configuration relating to the control of the printing head 1 by the controller 100 are explained below in order.

Controller 100

The controller 100 is configured to be able to electrically control the printing head 1 and supply ink for printing, a solvent for diluting the ink, and air for dying the inside of the printing head 1 to the printing head 1.

Specifically, the controller 100 according to this embodiment includes, as components relating to electric control, the storing unit 102 that stores the machining conditions, a control unit 101 that controls the units of the controller 100 and the printing head 1, and an operation display unit 103 that receives operation by the user and displays information to the user.

The controller 100 also includes, as components relating to the supply of the ink and the like, an ink supply unit 104 that supplies the ink to the nozzle 12 of the printing head 1, a solvent supply unit 105 that supplies the solvent to the nozzle 12 and the ink supply unit 104, and an air pump 106 that supplies the air to the printing head 1.

The storing unit 102 includes, as functional blocks relating to the maintenance operation for the printing head 1, a flag storing unit 102*a* that stores an error flag in the ink jet recording apparatus I and a maintenance-pattern storing unit 102*b* that stores content of the maintenance operation (in the illustration, simply described as "pattern storing unit"). The configurations of the flag storing unit 102*a* and the maintenance-pattern storing unit 102*b* are explained below.

Control Unit 101

The control unit 101 controls, based on the machining conditions stored in the storing unit 102, at least the ink supply unit 104 and the solvent supply unit 105 in the controller 100 and the nozzle 12, a charging electrode 13, and a deflection electrode 15 in the printing head 1. The control unit 101 controls the units, whereby printing on the work W is carried out. Note that, when the printing head 1 is cleaned, the air pump 106 is controlled in addition to the solvent supply unit 105 and the like.

Specifically, the control unit 101 includes a CPU, a memory, and an input and output bus and generates a control signal based on a signal indicating information input via the operation display unit 103 or the terminal for operation 800 and a signal indicating the machining conditions read from the storing unit 102. The control unit 101 outputs the control signal generated in that way to the units of the controller 100 and the ink jet recording apparatus I to thereby control printing on the work W.

For example, when printing on the work W, the control unit 101 reads printing content stored in the storing unit 102 and generates a control signal based on the printing content. The control unit 101 outputs the control signal to the charging electrode 13 to cause ink droplets to fly to realize an impacting position corresponding to the printing content.

Operation Display Unit 103

The operation display unit 103 is provided in, for example, a housing configuring the controller 100 (see FIG. 1). However, the operation display unit 103 includes a display that displays various kinds of information relating to the ink jet recording apparatus I and a switch including, for example, a plurality of push buttons. Power ON/OFF and the like of the ink jet recording apparatus I can be switched by operating the operation display unit 103. Note that, when the terminal for operation 800 is incorporated in the controller 100, the terminal for operation 800 may also be used as the operation display unit 103.

Like the terminal for operation 800 explained above, the operation display unit 103 can also set machining conditions in printing. The machining conditions set by the operation display unit 103 are output to the controller 100 and stored in the storing unit 102 of the controller 100. The following explanation is based on the premise that the user operates the operation display unit 103. However, the terminal for operation 800 can also be used instead of the operation display unit 103.

Ink Supply Unit 104

The ink supply unit 104 includes, as main components, an ink cartridge 104*a* storing ink for filling and a main tank 104*b* to which the ink is supplied from the ink cartridge 104*a*. The ink cartridge 104*a*, the main tank 104*b*, and the printing head 1 are connected in terms of fluid via an ink flowing path 104*c*.

The main tank 104*b* is configured to store the ink, the concentration (the viscosity) of which is adjusted by the solvent. In order to realize such a configuration, a path for the solvent is connected to a path leading from the ink cartridge 104*a* to the main tank 104*b*. The main tank 104*b* according to this embodiment is a container that stores ink liquid supplied to the nozzle 12 and is an illustration of an "ink tank".

The ink flowing path 104*c* is a path for supplying the ink to the printing head 1 and includes, for example, a path for feeding the ink into the nozzle 12 and a path for feeding back the ink from the gutter 16. The former path connects the ink cartridge 104*a*, the main tank 104*b*, and the nozzle 12. The latter path connects the gutter 16 and the main tank 104*b*. The ink can be circulated between the printing head 1 and the controller 100 by these paths.

Solvent Supply Unit 105

The solvent supply unit 105 includes, as main components, a solvent cartridge 105*a* that stores a solvent for filling and a conditioning tank 105*b* that stores the solvent used for cleaning. The solvent cartridge 105*a*, the conditioning tank 105*b*, and the printing head 1 are connected in terms of fluid via a solvent flowing path 105*c*. The solvent flowing path 105*c*, in which the solvent flows, includes a plurality of paths. A part of the paths is also used as the path for feeding back the ink from the gutter 16.

The solvent cartridge 105*a* is configured to be detachably attachable to the controller 100. The solvent can be filled in the controller 100 by replacing the solvent cartridge 105*a*. A solvent tank may be provided instead of the solvent cartridge 105*a*. Note that the solvent supply unit 105 has a function of detecting whether the solvent in the solvent cartridge 105*a* is exhausted or the solvent is scarce.

The solvent flowing path 105*c* includes a path for supplying the solvent to the printing head 1, the main tank 104*b*, and the like and includes, for example, a path for feeding the solvent into the nozzle 12 and a path for feeding back the solvent from the gutter 16. The former path connects the solvent cartridge 105*a* and the nozzle 12. The latter path also functions as the path for feeding back the ink as explained above.

Air Pump 106

The air pump 106 is configured to pressure-feed the air according to a control signal from the control unit 101. The air pressure-fed by the air pump 106 is supplied to the printing head 1 through an air tube 106*c* and used for drying the inside of the printing head 1.

Specifically, the air tube 106*c* according to this embodiment communicates with a flying space S1 in the housing (see FIG. 2B). As explained below, the housing 10 is a member that houses the nozzle 12 and the like on the inside.

In FIG. 2A, the air pump 106 is illustrated as an element of the controller 100. However, the present disclosure is not limited to this configuration. The air pump 106 may be incorporated in the controller 100 or may be provided as an external device independent from the controller 100. In the first place, the air pump 106 is not essential. For example, so-called factory air can also be used by connecting air equipment set in a factory or the like and the air tube 106*c*.

Other Components

A connection cable 107 obtained by binding and coating an electric wire for transmitting and receiving a control signal, a tube for feeding and receiving the ink (specifically, a tube defining the ink flowing path 104*c*), a tube for feeding and receiving the solvent (specifically, a tube defining the solvent flowing path 105*c*), and the air tube 106*c* for supplying the air is provided in the controller 100. The connection cable 107 has flexibility and is connected to the upper end portion of the printing head 1 (see FIGS. 1 and 4). The controller 100 and the printing head 1 are connected electrically and in terms of fluid via the connection cable 107.

The controller 100 includes a timer 108 capable of measuring a time period. The timer 108 can measure, for example, a stop period from execution of stop processing for the ink jet recording apparatus I to a start of start processing for the ink jet recording apparatus I. Besides, for example, the timer 108 can measure, as a substantial stop period, a period from an operation stop of the ink jet recording apparatus I to the next power-on of the ink jet recording apparatus I. The timer 108 is an illustration of a "time measuring unit". Note that details of the stop processing and the start processing are explained below.

Printing Head 1

The printing head 1 ejects, as particulate ink droplets, the ink, the concentration of which is adjusted based on a control signal supplied from the controller 100, the ink, and the solvent. By deflecting a flying direction of the ink droplets ejected in that way and impacting the deflected ink droplets on the surface of the work W, the printing head 1 can execute printing on the work W.

Specifically, the printing head 1 according to this embodiment includes a vibrator 11 that vibrates ink, the nozzle 12 that ejects the ink vibrated by the vibrator 11, the charging electrode 13 that charges particulate ink ejected from the nozzle 12, a charging detection sensor 14 that monitors a charging state of the ink, the deflection electrode 15 that deflects a flying direction of the ink charged by the charging electrode 13, and the gutter 16 that collects the ink undeflected by the deflection electrode 15 or a solvent ejected from the nozzle 12.

As illustrated in FIG. 2B, the printing head 1 includes a housing 10 that houses the vibrator 11, the nozzle 12, the charging electrode 13, the charging detection sensor 14, the deflection electrode 15, and the gutter 16 on the inside and defines the flying space S1 for ink droplets. The printing head 1 can eject the ink droplets deflected by the deflection electrode 15 to the outside of the housing 10 via the flying space S1.

Figure 4:
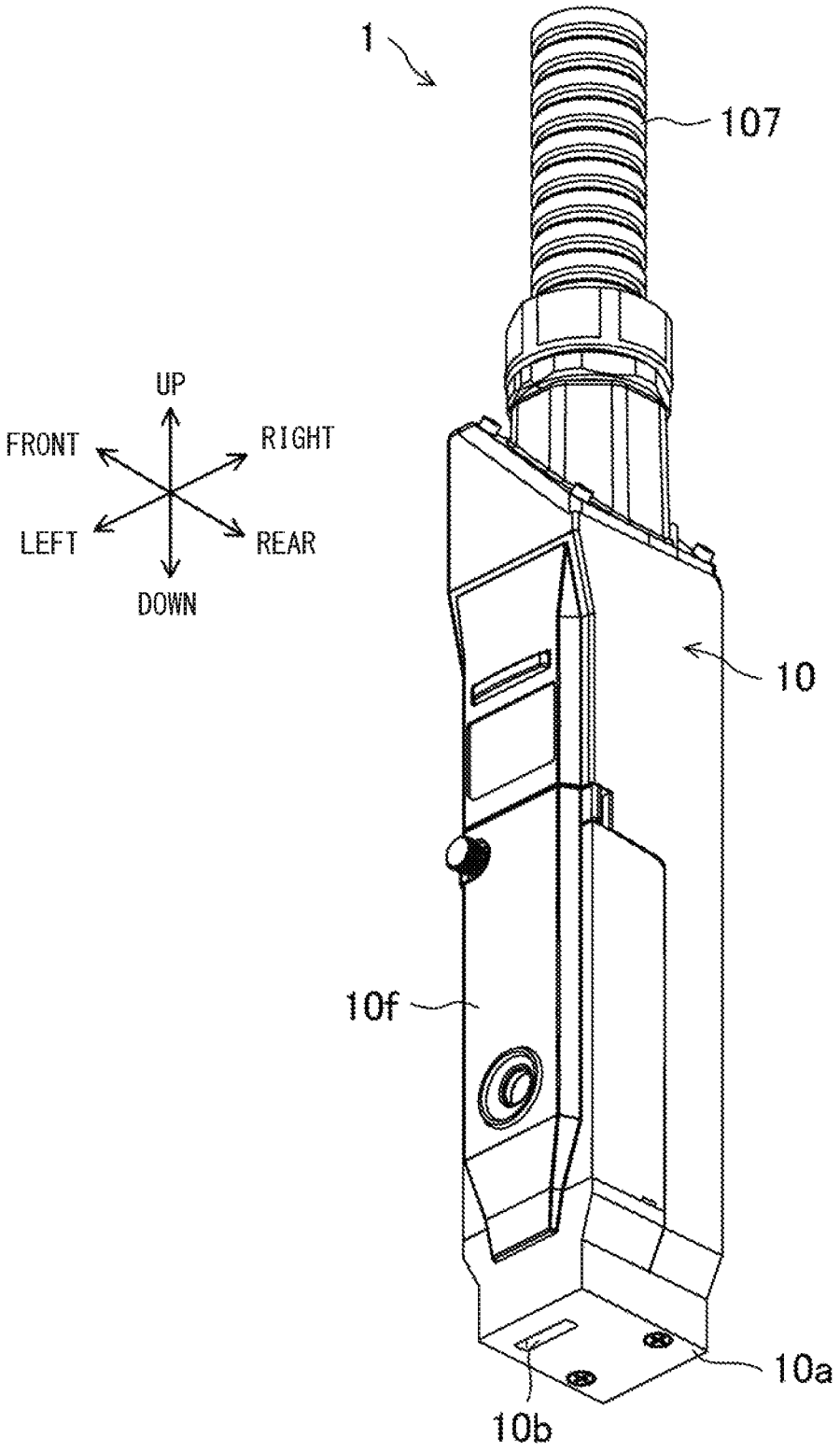
FIG. 4 is a perspective view illustrating an overall configuration of the printing head.

Specifically, as illustrated in FIG. 2B, an ejection port 10*b* for ejecting the ink deflected by the deflection electrode 15 or the solvent ejected from the nozzle 12 to the outside is opened on a lower surface 10*a* of the housing 10 forming the printing head 1 (see FIG. 4 as well). The ink or the solvent is ejected from the ejection port 10*b*.

The units forming the printing head 1 are explained below in order. Note that, in the following explanation, an "up-down" direction indicates a direction along the vertical direction. For example, a paper surface upward direction of FIG. 2B is equivalent to an "upward direction" and a paper surface downward direction of FIG. 2B is equivalent to a "downward direction". In the other figures, a direction corresponding to this direction is referred to as "up-down direction".

Vibrator 11

As illustrated in FIG. 2B, the vibrator 11 is disposed near the upper end in the flying space S1 of the housing 10. A device (for example, a piezo element) for giving up-down vibration to the ink (vibrating the ink) is incorporated in the vibrator 11 according to this embodiment. The vibrator is configured such that the ink is supplied via the connection cable 107. The vibrator 11 can vibrate the ink supplied in that way. The ink vibrated by the vibrator 11 is supplied to the nozzle 12.

Although not illustrated, the vibrator 11 according to this embodiment is grounded.

Nozzle 12

As illustrated in FIG. 2B, the nozzle 12 is connected to the lower end portion of the vibrator 11 and disposed in a posture with an opening end (an ink jetting opening) of the nozzle 12 directed downward. The ink vibrated by the vibrator 11 can be ejected from the opening end of the nozzle 12. For example, a suction path 27 functioning as a return path for depressurizing the inside of the printing head 1 during a stop is connected to the nozzle 12 (see FIG. 3). The solvent can also be ejected from the nozzle 12 through the suction path 27 explained below.

The ink ejected from the nozzle 12 without being vibrated by the vibrator 11 flows as an axial so-called "ink axis". On the other hand, the vibrated ink is granulated immediately after being ejected from the nozzle 12 to be so-called "ink droplets". The ink (the ink droplets) ejected from the nozzle 12 passes through the charging electrode 13.

Note that the solvent supplied to clean the printing head 1 passes through the vibrator 11 and the nozzle 12 in order and is ejected from the nozzle 12. The solvent ejected in that way axially flows and passes through the charging electrode 13.

Charging Electrode 13

As illustrated in FIG. 2B, the charging electrode 13 is configured by a pair of metal plates and is disposed below the nozzle 12. The pair of metal plates is fixed in a posture in which the longitudinal direction of the metal plates is set along the up-down direction and a posture in which the metal plates face each other. The ink ejected from the nozzle 12 passes between the pair of metal plates.

Specifically, pulse potential controllable by the controller 100 is applied to the charging electrode 13. When a relatively high voltage is applied to the charging electrode 13, a charging amount (the magnitude of negative charge) of the ink droplets is larger compared with when a voltage lower than the relatively high voltage is applied. When the charging amount is large, the ink droplets are greatly deflected by the deflection electrode 15 compared with when the charge amount is small. The controller 100 can control a deflection amount of the ink droplets by adjusting the magnitude of the pulse potential. The ink droplets charged by the charging electrode 13 pass the side of the charging detection sensor 14 and reach the deflection electrode 15.

Charging Detection Sensor 14

As illustrated in FIG. 2B, the charging detection sensor 14 is disposed below the charging electrode 13. Specifically, the charging detection sensor 14 is laid out right below the metal plate configuring the charging electrode 13 (in the example illustrated in FIG. 2B, the metal plate on the paper surface right side) and is disposed not to cross a trajectory of flying of the ink droplets. By disposing the charging detection sensor 14 in this way, it is possible to avoid collision of the ink droplets and the charging detection sensor 14.

Deflection Electrode 15

As illustrated in FIG. 2B, the deflection electrode 15 is configured by a pair of left and right metal plates (so-called "counter electrodes") and is disposed below the charging electrode 13 and the charging detection sensor 14. The pair of metal plates are fixed in a posture in which the longitudinal direction of the metal plates is set along substantially the up-down direction and a posture in which the metal plates face each other. The ink droplets passing through the charging electrode 13 pass between the pair of metal plates configuring the deflection electrode 15.

A voltage controllable by the controller 100 is applied to the deflection electrode 15. Consequently, a potential difference occurs between the metal plates configuring the deflection electrode 15. A flying direction of the ink droplets can be deflected by the potential difference according to a charging amount of the ink droplets. The flying direction of the ink droplets can be deflected along an arranging direction of the pair of metal plates.

That is, a trajectory of the ink droplets can be controlled via the voltages respectively applied to the charging electrode 13 and the deflection electrode 15. The ink droplets controlled in that way include the ink droplets deflected by the deflection electrode 15 and the ink droplets undeflected by the deflection electrode 15. The former ink droplets are involved in the printing on the work W. The ink droplets are ejected from the ejection port 10*b* provided on the lower surface of the housing 10 and are impacted on the work W.

On the other hand, the ink droplets undeflected by the deflection electrode 15 are not involved in the printing on the work W. Such ink droplets or axial ink not granulated in the first place reaches the inside of the gutter 16 as indicated by a chain line in FIG. 2B. Similarly, the solvent used for the cleaning of the nozzle 12 and the like in the printing head 1 and passed through the deflection electrode 15 also reaches the inside of the gutter 16.

Gutter 16

As illustrated in FIG. 2B, the gutter 16 is configured by a bent pipe, an opening end of which is directed upward, and is disposed below the deflection electrode 15. The gutter according to this embodiment can collect the ink not involved in the printing on the work W and the solvent passed through the nozzle 12 (specifically, the solvent ejected from the nozzle 12).

Specifically, in this embodiment, the opening end of the gutter 16 and the opening end of the nozzle 12 are disposed to face each other. By disposing the opening ends in this way, fluid flowing along the vertical direction from the opening end of the nozzle 12 can be received from the opening end of the gutter 16.

Main Operation of the Printing Head 1

As explained above, when the printing is executed on the work W, the ink vibrated by the vibrator 11 is ejected from the nozzle 12. The ink is supplied from the ink supply unit 104 of the controller 100 as appropriate. The ink ejected from the nozzle 12 is granulated immediately after the ejection and charged by the charging electrode 13. The ink droplets charged by the charting electrode 13 pass through the deflection electrode 15 after a charging state of the ink droplets is detected by the charging detection sensor 14.

The ink droplets, a flying direction of which is deflected by the deflection electrode 15, pass through the flying space S1 in the printing head 1 and are ejected to the outside of the printing head 1. The ink droplets ejected from the printing head 1 are impacted on the surface of the work W. An impacting position of the ink droplets is controlled via a charging amount of the ink droplets and an applied voltage to the deflection electrode 15.

As explained above, the ink jet recording apparatus I according to this embodiment is configured as the ink jet printer of the continuous type. Therefore, even when printing is not executed, the ink is continuously ejected from the nozzle 12. The ink ejected at this time is not deflected (in other words, is "undeflected") by the deflection electrode 15. The undeflected ink is not involved in printing, collected by the gutter 16, circulates inside the apparatus, and is reused.

When the printing head 1 is cleaned, the solvent is ejected from the nozzle 12. The solvent is supplied from the solvent supply unit 105 of the controller 100 as appropriate. The solvent ejected from the nozzle 12 is collected by the gutter 16 and reused without being, for example, granulated, charged, or deflected. Note that, when the printing head 1 is cleaned, the inside of the nozzle 12 is set to a negative pressure through the suction path 27 (FIG. 3). The solvent can be sucked to the suction path 27 without being ejected from the nozzle 12.

In the following explanation, in order to explain the collection of the ink or the solvent by the gutter 16 in detail, configurations relating to the ink flowing path 104*c* and the solvent flowing path 105*c* are explained with reference to FIG. 3. Note that components denoted by a sign F in FIG. 3 illustrate filters. In the following explanation, explanation about the disposition, the configuration, and the like of the filters F is omitted.

In the first solvent path 31, an optical empty detecting mechanism 44, the solvent pump P2, the sixteenth valve V16, and a twelfth valve V12 are provided in order. An ASC nozzle 19 is connected to the first solvent path 31. The ASC nozzle 19 is a nozzle for cleaning the vibrator 11 in the printing head 1, the deflection electrode 15, and the like. The ASC nozzle 19 can jet the cleaning liquid. A fifteenth valve V15 is provided halfway between the ASC nozzle 19 to the first solvent path 31.

The second dividing unit 52 includes the first valve V1 that opens and closes between the sixth ink path 26 and the eighth ink path 28, a third valve V3 that opens and closes between the sixth ink path 26 and the conditioning tank 105*b*, and a fourth valve V4 that opens and closes between the sixth ink path 26 and a waste liquid tank (in FIG. 3, illustrated as "waste liquid").

When printing is carried out, by opening the fourteenth valve V14, the ink is supplied from the main tank 104*b* via the fourth ink path 24. The ink supplied in that way changes to particulate ink droplets and is ejected from the nozzle 12.

In the ink (the ink droplets) ejected from the nozzle 12, the ink involved in the printing is ejected from the printing head 1 as explained with reference to FIG. 2B. On the other hand, the ink not involved in the printing and the solvent used for the cleaning of the nozzle 12 and the like are collected by the gutter 16 and fed back to the controller 100 through the fifth ink path 25.

In that case, the ink that should be fed back to the main tank 104*b* is supplied from the first dividing unit 51 to the main tank 104*b* via the sixth ink path 26, the first valve V1 in the second dividing unit 52, and the eighth ink path 28. On the other hand, the solvent that should be fed back to the conditioning tank 105*b* is supplied from the fifth path 25 to the conditioning tank 105*b* via the third valve V3 in the second dividing unit 52.

The collection of the ink or the solvent by the gutter is performed, for example, in relation to the start processing and the stop processing for the ink jet recording apparatus I. The "start processing" means processing executed before the printing is started when a power supply of the ink jet recording apparatus I is turned on. On the other hand, the "stop processing" means processing executed before the operation of the ink jet recording apparatus I is stopped when the power supply of the ink jet recording apparatus I is turned off.

As processing using the solvent, a cleaning operation (for example, automatic cleaning explained below) for the printing head 1 can also be performed. As explained in detail below, for example, when the inside of the printing head 1 (for example, the inner wall of the housing 10) is cleaned, by opening the sixteenth valve V16 and the fifteenth valve V15, the solvent is jetted from the ASC nozzle 19 through the first solvent path 31 in the solvent flowing path 105*c*. Before the solvent is jetted from the ASC nozzle 19, by closing the fifteenth valve V15 in advance, the internal pressure in the solvent path 31 can be increased. When the nozzle 12 in the printing head 1 is cleaned, the solvent is intermittently jetted from the nozzle 12 by repeatedly opening and closing the twelfth valve V12 while opening the sixteenth valve V16. When the solvent remaining in the nozzle 12 is collected, the solvent reaches the second dividing unit 52 via a seventh ink path (the suction path) 27 functioning as a path for solvent collection as well, the first dividing unit 51, and the sixth ink path 26 when the sixth valve V6 is opened. When the first valve V1 is opened, the collected solvent is stored in the main tank 104*b* through the eighth ink path 28. On the other hand, when the third valve V3 is opened rather than the first valve V1, the collected solvent is stored in the conditioning tank 105*b*.

Specifically, the ink jet recording apparatus I according to this embodiment does not immediately start the printing even if a power switch is turned on. The ink jet recording apparatus I executes predetermined start processing before starting the printing. In the start processing, the ejection of the ink is started after the printing head 1 is cleaned using the solvent. The ink ejected immediately after the start of the start processing forms the ink axis explained above and is collected by the gutter 16. When the start processing is completed, the ink circulates in the ink jet recording apparatus I. The apparatus comes into a state in which the printing is executable (a printing state).

Similarly, when the power switch is about to be turned off, the ink jet recording apparatus I according to this embodiment does not immediately stop the operation of the ink jet recording apparatus I. The ink jet recording apparatus I executes predetermined stop processing including nozzle cleaning before stopping the operation. In the stop processing, by ejecting the solvent from the nozzle 12, the ink remaining in the nozzle 12 can be cleaned and collected. The ink discharged from the nozzle 12 according to the ejection of the solvent is collected by the gutter 16 like the ink axis in the start processing. By completing the stop processing, the ink jet recording apparatus I completes preparation for stopping the operation of the ink jet recording apparatus I.

Note that the "power switch" in this embodiment includes, in addition to a physical push button, a touch panel displayed on the operation display 103 or the like. OFF operation of the power switch indicates, in addition to operation for physically pressing the push button, shutdown operation instructed through the terminal for operation 800, the operation display unit 103, and the like. The same applies to ON operation of the power switch.

For such an ink jet recording apparatus I, a maintenance operation such as cleaning of the inside of the printing head 1 needs to be implemented as appropriate. However, in actual operation, a place (content) and a time period for carrying out the maintenance operation depend on determination by the user. Accordingly, a user having less knowledge and experience about the maintenance operation is likely to be unable to appropriately carry out the maintenance operation.

It is also conceivable to display, on the operation display unit 103, guidance indicating a procedure of the maintenance operation. However, as a result of intensive studies by the inventors, the inventors noticed that such guidance alone was insufficient.

On the other hand, in the ink jet recording apparatus I according to this embodiment, automation of the maintenance operation is realized. By automating the maintenance operation, a mechanism not requiring technical knowledge and experience is realized.

At least in this embodiment, the maintenance operation is carried out by devising the configuration of the printing head 1 and, then, using the head station 200 configuring the ink jet recording apparatus I together with the printing head 1. In order to carry out the maintenance operation, it is also requested to devise a control process by the controller 100.

Therefore, in the following explanation, a configuration relating to the maintenance operation in the printing head 1, the configuration of the head station 200, a basic concept of a control process relating to the maintenance operation, and specific examples of the maintenance operation are explained in order.

Further Configuration of the Printing Head 1.

Figure 5:
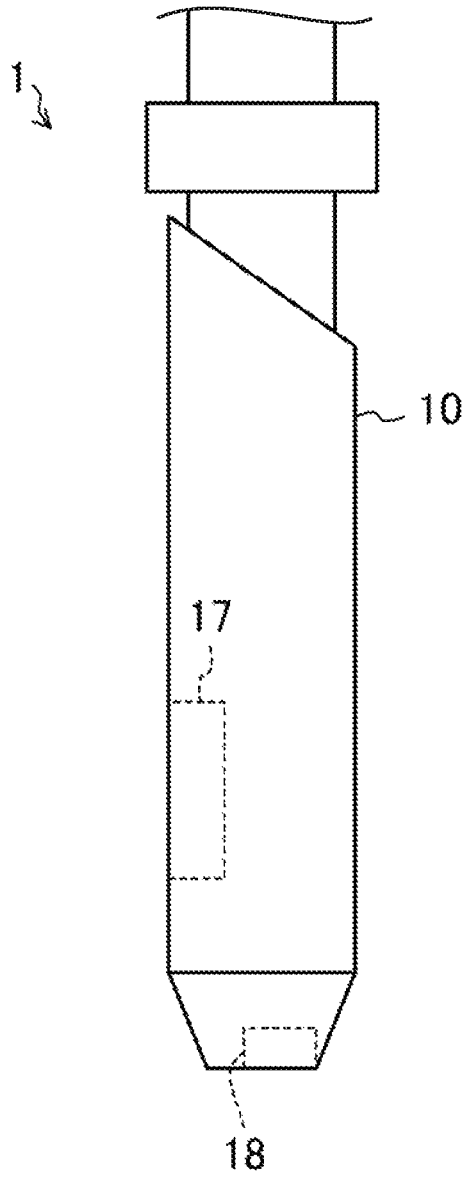
FIG. 5 is a front view schematically illustrating the internal structure of the printing head.

First, in the printing head 1 according to this embodiment, a configuration highly relevant to the maintenance operation is further explained. FIG. 4 is a perspective view illustrating an overall configuration of the printing head 1. FIG. 5 is a front view schematically illustrating the internal structure of the printing head 1.

As illustrated in FIG. 4, the housing 10 of the printing head 1 has a substantially parallelepiped external shape extending in the paper surface up-down direction. In the following explanation, the longitudinal direction of the housing 10 is simply referred to as "up-down direction". On the other hand, two directions orthogonal to the up-down direction are respectively referred to as "front-rear direction" and "left-right direction". In the other figures, directions corresponding to these directions are respectively referred to as "up-down direction", "front-rear direction", and "left-right direction".

"Up" indicates the paper surface upper side of FIG. 4 and "down" indicates the paper surface lower side. Similarly, "front" indicates the paper surface near side (specifically, the left near side) of FIG. 4 and "rear" indicates a paper surface depth side (specifically, the right depth side). "Left" indicates a paper surface left side (specifically, the left lower side) and "right" indicates the paper surface right side (specifically, the right upper side) of FIG. 4. In the other figures, sides corresponding to these sides are respectively referred to as "up", "down", "front", "rear", "left", and "right".

As illustrated in FIG. 4, one end of the connection cable 107 is connected to the upper end of the printing head 1. On the other hand, the lower surface 10*a* of the printing head 1 functions as an ejection surface for ejecting the ink.

As illustrated in FIG. 4, the ejection port 10*b* for ejecting ink droplets deflected by the deflection electrode to the outside is opened on the lower surface 10*a* functioning as the ejection surface. The ejection port 10*b* is formed as a rectangular opening section extending along the left-right direction. The longitudinal direction (that is, the left-right direction) of the ejection port 10*b* substantially coincides with an arrangement direction of the metal plates configuring the deflection electrode 15. That is, the ejection port 10*b* extends along a direction in which the ink droplets are deflected.

As illustrated in FIG. 4, a detachable cover member 10*f* is provided on the front surface of the housing 10. The cover member 10*f* defines the flying space S1 of ink droplets together with the other members. The cover member 10*f* is detached when maintenance (in particular, manual maintenance) of the nozzle 12 or the like is performed. By detaching the cover member 10*f*, the flying space S1 is accessible from the outside.

On the other hand, as illustrated in FIG. 5, a light source 17 is provided on the left side portion of the printing head 1. The light source 17 includes, for example, at least one light emitting diode (LED) and is configured to emit light according to a control signal from the control unit 101. When the light source 17 emits light, the left side surface of the printing head 1 can be shined.

The light source 17 according to this embodiment can convert a light emission form of the light source 17 based on a control signal from the control unit 101. For example, the control unit 101 can change a light emission color of the light source 17 and light and extinguish the light source 17.

As illustrated in FIG. 5, an operation detecting unit 18 is incorporated at the lower end portion of the printing head 1. The operation detecting unit 18 according to this embodiment is configured by a Hall element. That is, the operation detecting unit 18 functioning as the Hall element can output a detection signal when a magnet is brought close to the operation detecting unit 18, for example, when the distance between the Hall element and the magnet decreases to a specified value or less.

In particular, the operation detecting unit 18 according to this embodiment is fixed to at least the housing 10. When the magnet is disposed below the operation detecting unit 18, specifically, when the magnet is brought into contact with the lower surface 10*a* of the housing 10, the operation detecting unit 18 can output a detection signal to the control unit 101.

Head Station 200

Figure 6A:
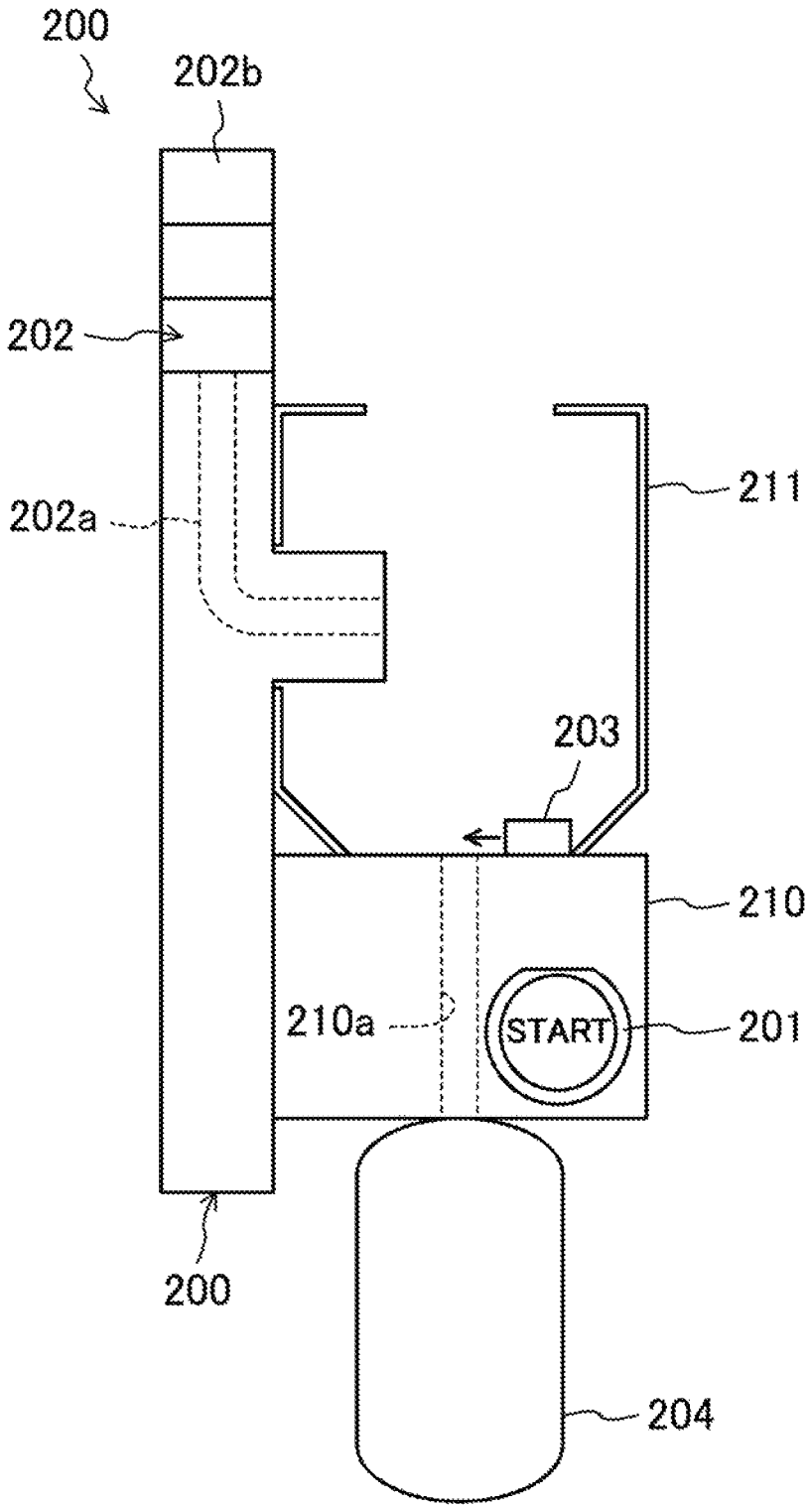
FIG. 6A is a front view illustrating a schematic configuration of a head station.
Figure 6B:
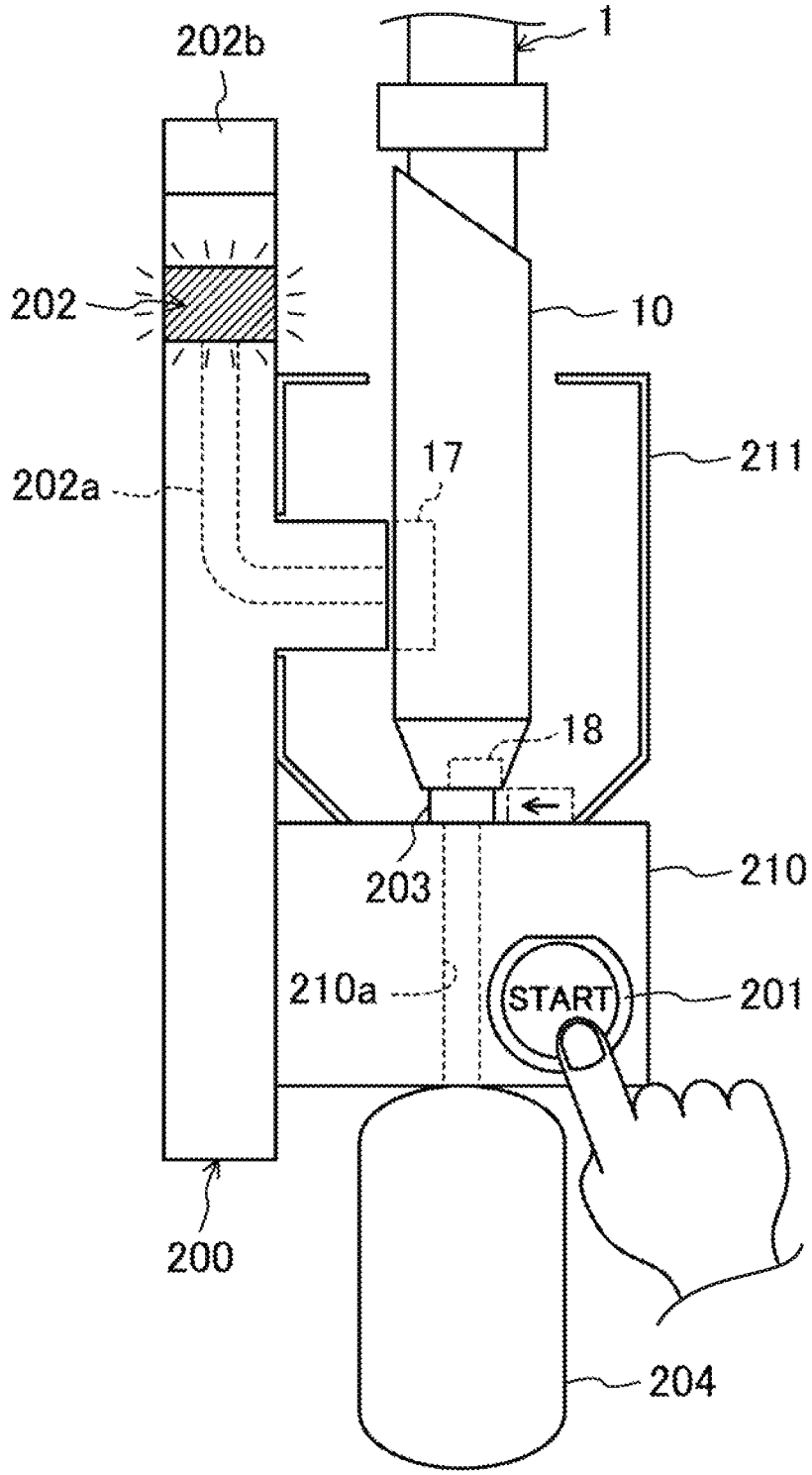
FIG. 6B is a front view illustrating a state in which the printing head is attached to the head station.

Subsequently, the configuration of the head station 200 according to this embodiment is explained. FIG. 6A is a front view illustrating a schematic configuration of the head station 200. FIG. 6B is a front view illustrating a state in which the printing head 1 is attached to the head station 200.

As illustrated in FIGS. 6A and 6B, the head station 200 has a pedestal-like external shape and is configured such that the printing head 1 is attached to the head station 200 via an opening provided at the upper end portion of the head station 200.

Main Configuration of the Head Station 200

Specifically, the head station 200 according to this embodiment includes a pedestal-like main body 210, a head attachment unit 211 erected on the upper surface of the main body 210, an operation unit 201 disposed on the front surface of the main body 210, a state display unit 202 connected to a side surface of the main body 210, an attachment detecting unit 203 provided on the inside of the head attachment unit 211, and a waste liquid unit 204 connected to the lower surface of the main body 210.

The main body 210 is formed in a substantially rectangular parallelepiped shape and is configured to, when the printing head 1 is attached to the head attachment unit 211, support the printing head 1 from below (see FIG. 6B). A passage 210*a* for waste liquid is opened on the upper surface of the main body 210. The passage 210*a* pierces through the main body 210 from the upper surface to the lower surface of the main body 210 and is connected to the waste liquid unit 204 connected to the lower surface.

The operation unit 201 is configured by a push button or the like. The operation unit 201 is dynamically coupled to the attachment detecting unit 203 via, for example, a link mechanism, a pivot mechanism, and a bell crank mechanism. For example, as illustrated in FIG. 6A, the attachment detecting unit 203 can be moved to a predetermined position by pressing the operation unit 201.

The head attachment unit 211 is provided on the upper surface of the main body 210 and defines a space for temporarily holding the printing head 1 in the maintenance operation. The head attachment unit 211 according to this embodiment is opened at least at the upper end of the head attachment unit 211 and is configured such that the printing head 1 is inserted from the opening.

The state display unit 202 is formed in a vertically long box shape and is laid out in a side portion of the main body 210. The state display unit 202 is configured by a so-called light guide material 202*a*. That is, the light guide material 202*a* having a bar shape is housed on the inside of the state display unit 202.

The light guide member 202*a* according to this embodiment is shielded from light except both end portions of the light guide member 202*a*. One end portion of the light guide material 202*a* extends to the inside of the head attachment unit 211. The other end portion of the light guide material 202*a* is connected to a display plate 202*b* having light transmissivity.

As illustrated in FIG. 6B, in this embodiment, when the printing head 1 is attached to the head attachment unit 211, the light source 17 provided in the printing head 1 and one end portion of the light guide material 202*a* face each other. When the head station 200 is configured in this way, the printing head 1 attached to the head attachment unit 211 and the display plate 202*b* in the state display unit 202 are optically combined.

Accordingly, in view of the light transmissivity of the display plate 202*b*, by causing the light source 17 of the printing head 1 to emit light, it is possible to propagate the light with the light guide material 202*a* and cause the display plate 202*b* to emit light.

Therefore, for example, by associating an execution situation of maintenance operation processing, information such as an execution result, and a light emission form (an emission color, lighting, and the like) of the light source 17 in advance, it is possible to notify information to the user via the display plate 202*b*. The state display unit 202 according to this embodiment illustrates a "display unit" in that the state display unit 202 can display information relating to processing for executing the maintenance operation.

Like the attachment detecting unit 203 explained below, the state display unit 202 according to this embodiment is configured as a "power supply-less" member that does not need electric power.

The attachment detecting unit 203 is configured by, for example, a magnet. An electric wire is not connected to the magnet. The attachment detecting unit 203 is configured to move to the predetermined position based on operation by the user. Specifically, the attachment detecting unit 203 according to this embodiment is configured to move from an initial position illustrated in FIG. 6A to a predetermined position illustrated in FIG. 6B when the operation unit 201 is pressed.

The attachment detecting unit 203 according to this embodiment is configured to be opposed to, in this predetermined position, the lower surface 10*a* of the printing head 1 inserted into the head attachment unit 211 and configured such that the distance between the magnet forming the attachment detecting unit 203 and the Hall element forming the operation detecting unit 18 in the printing head 1 is the specified value or less. In this case, the operation detecting unit 18 detects approach of the magnet and outputs a detection signal.

It is possible to cause the detection signal output from the operation detecting unit 18 to function as a trigger for starting the maintenance operation and function as a trigger for suspending the maintenance operation. In this embodiment, the detection signal is used as the trigger for starting the maintenance operation. The attachment detecting unit 203 illustrates a "detecting unit" in this embodiment in that the attachment detecting unit 203 can detect attachment of the printing head 1.

In the head station 200 according to this embodiment, the state display unit 202 and the attachment detecting unit 203 do not need electric power and are configured as so-called "power supply-less" devices.

In this way, the ink jet recording apparatus I according to the present disclosure includes a sensor system Se3 including a first sensor illustrated as the operation detecting unit 18 and a second sensor illustrated as the attachment detecting unit 203. The first sensor (the operation detecting unit 18) is provided in the printing head 1. On the other hand, the second sensor (the attachment detecting unit 203) is provided in the head station 200.

The first sensor (the operation detecting unit 18) is configured to, when the relative distance between the first sensor (the operation detecting unit 18) and the second sensor (the attachment detecting unit 203) decreases to a specified value or less, output a detection signal to the control unit 101.

By being configured in this way, the sensor system Se3 can detect that the printing head 1 is attached to the head station 200.

As illustrated in FIGS. 6A and 6B, the second sensor (the attachment detecting unit 203) moves to the predetermined position when the operation unit 201 is operated. The second sensor (the attachment detecting unit 203) is configured such that, when the printing head 1 is attached to the head station 200, the relative distance between the first sensor (the operation detecting unit 18) and the second sensor (the attachment detecting unit 203) moved to the predetermined position is the specified value or less.

By being configured in this way, the sensor system Se3 can more accurately detect that the printing head 1 is attached to the head station 200. For example, the head station 200 can be used exclusively for each printing head 1 by changing the place of the predetermined position according to the specifications and the like of the printing head 1.

The second sensor may be configured by a "power supply-less" member that does not need power supply like the magnet. Configuring the second sensor in this way is advantageous in configuring the head station 200 itself to be power supply-less. This is effective in suppressing manufacturing cost of the head station 200, realizing a reduction in size, weight, and the like of the head station 200, and suppressing electric leakage due to waste liquid discharged from the printing head 1.

Referring back to FIGS. 6A and 6B, the waste liquid unit 204 is configured by, for example, a bottle made of resin. As the resin for making the bottle, HEPE and the like can be used. The waste liquid unit 204 is opened at the upper end portion and is connected to the lower surface of the main body 210. By connecting the waste liquid unit 204 in this way, the passage 210*a* for waste liquid and the waste liquid unit 204 can be connected in terms of fluid.

Therefore, the waste liquid leaking from the lower surface 10*a* of the printing head 1 flows down in the passage 210*a* and reaches the waste liquid unit 204. The waste liquid unit 204 can store the waste liquid that flows down in that way.

Note that the configuration in which the waste liquid unit 204 is connected to the lower surface of the main body 210 is not essential. For example, the main body 210 and the waste liquid unit 204 may be connected in terms of fluid via a pipe or the like.

Operation Relating to the Head Station 200

When performing the maintenance operation, the user inserts and attaches the printing head 1 to the head station 200. Consequently, the light source 17 of the printing head 1 and the state display unit 202 are optically coupled. On the other hand, the flying space S1 in the printing head 1 and the waste liquid unit 204 are connected in terms of fluid.

Subsequently, the user presses the operation unit 201. Consequently, the attachment detecting unit 203 moves to the predetermined position and approaches the operation detecting unit 18 of the printing head 1. When the relative distance between the attachment detecting unit 203 and the operation detecting unit 18 decreases to the specified value or less as a result of the approaching, the operation detecting unit 18 outputs a detection signal to the control unit 101. The control unit 101 is triggered by the detection signal and starts the control process relating to the maintenance operation.

The control unit 101 executes the control process relating to the maintenance operation to execute a predetermined maintenance operation on the ink jet recording apparatus I.

Since the detection signal is output from the operation detecting unit 18 while being triggered the pressing of the operation unit 201 in this way, the operation unit 201 according to this embodiment is considered to be a member for causing the control unit 101 to start the maintenance operation. In this case, when the operation unit 201 is operated in a state in which the printing head 1 is attached to the head station 200, the control unit 101 executes the maintenance operation on the printing head 1.

Note that, in this embodiment, the operation unit 201 manually operated by the user is provided as the member for starting the maintenance operation. However, the present invention is not limited to this. The operation unit 201 may be omitted. That is, when the printing head 1 is attached to the head station 200, the maintenance operation may be automatically started. For example, when the printing head 1 is attached to the head station 200, if the operation detecting unit 18 on the printing head 1 side and the attachment detecting unit 203 on the head station 200 side are in a positional relation in which the operation detecting unit 18 and the attachment detecting unit 203 are opposed to each other, it is possible to automatically detect the attachment of the printing head 1 and automatically start the maintenance operation.

In the following explanation, other components relating to the maintenance operation are explained and, at the same time, a basic concept of the processing of the maintenance operation is explained in detail. In the following explanation, as specific examples of a plurality of kinds of maintenance operations, maintenance processing A to maintenance processing G illustrated in FIGS. 7 and 9 are explained.

About the Maintenance Operation

Basic Concept of the Maintenance Operation

Figure 7:
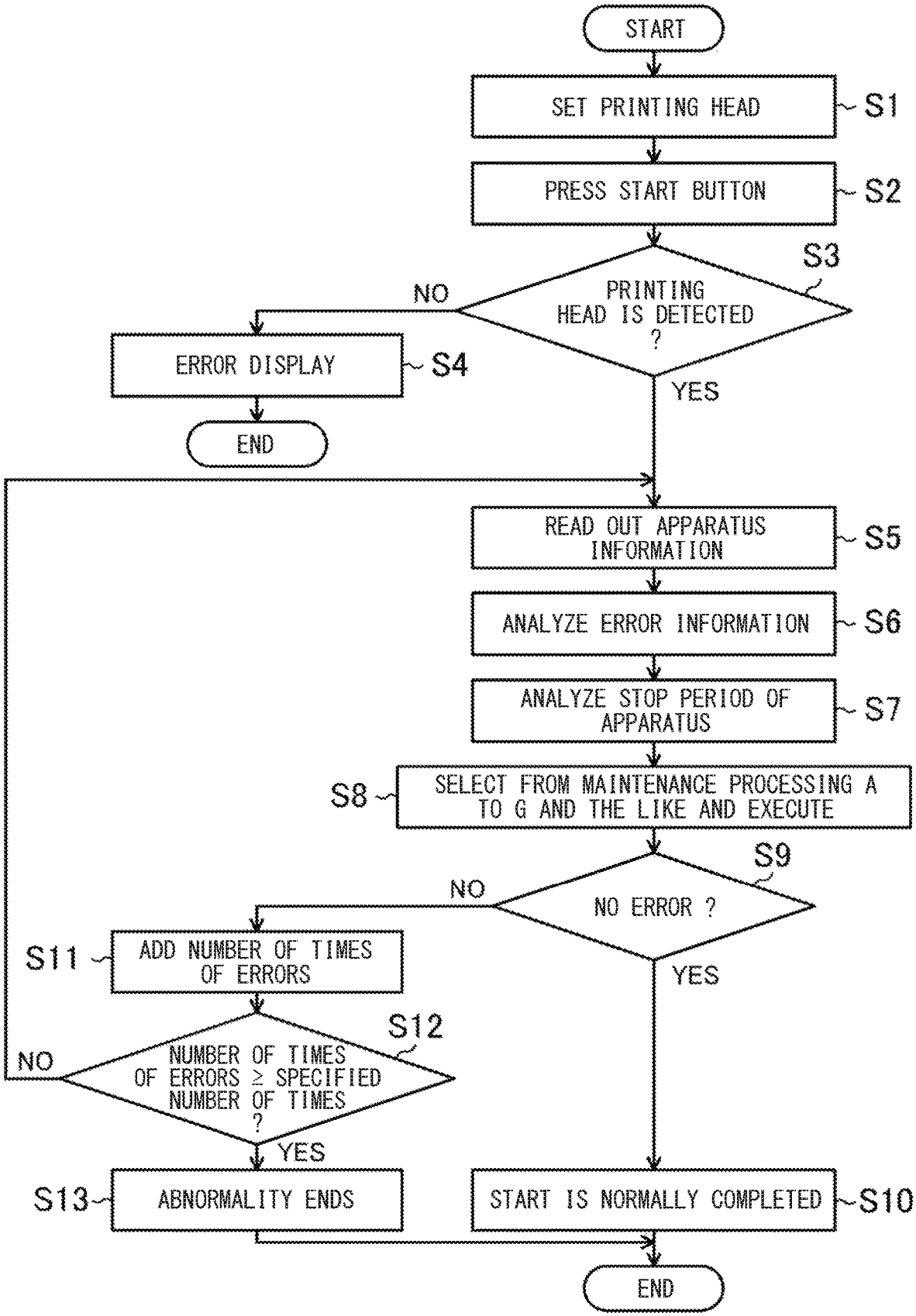
FIG. 7 is a flowchart illustrating a specific example of a maintenance operation.
Figure 10:
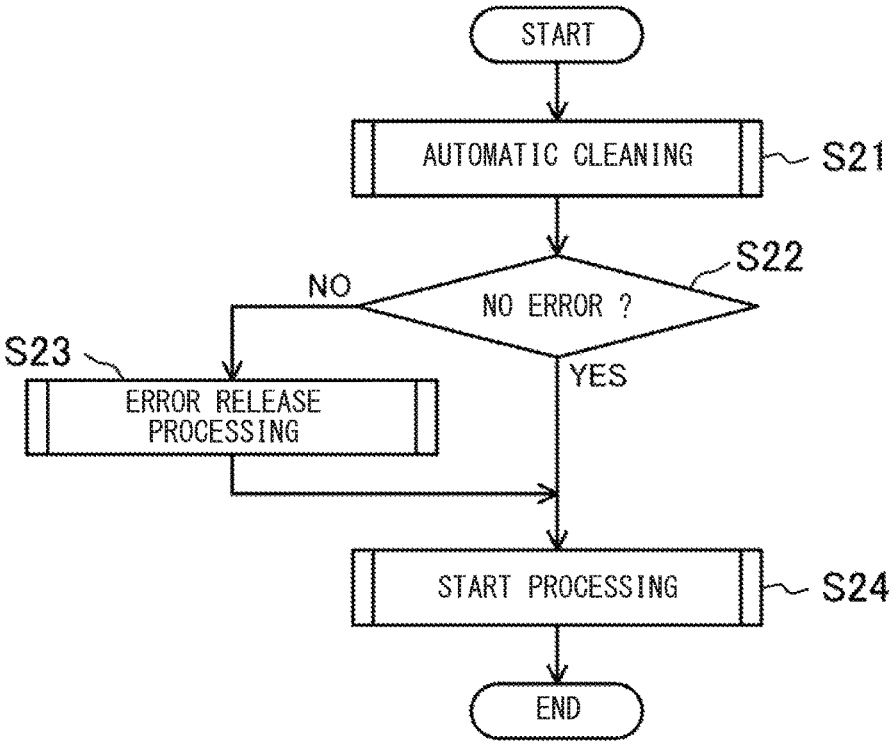
FIG. 10 is a flowchart illustrating details of maintenance processing.

FIG. 7 is a flowchart illustrating a specific example of the maintenance operation. FIG. 8 is a diagram schematically illustrating contents of error flags. FIG. 9 is a table illustrating details of the maintenance processing A to the maintenance processing G. FIG. 10 is a flowchart illustrating details of the maintenance operation.

As a result of intensive studies by the inventors, the inventors conceived of preparing maintenance operations of a plurality of patterns and associating, with each other, the maintenance operations and abnormalities (errors) that occur in the printing head 1 and the like.

In order to realize this, the ink jet recording apparatus I according to this embodiment includes the maintenance-pattern storing unit 102*b* that stores, in association with each other, a plurality of different types of abnormalities that occur in the ink jet recording apparatus I and a plurality of kinds of maintenance operations executable in the ink jet recording apparatus I and the flag storing unit 102*a* that stores occurrence of an abnormality in the ink jet recording apparatus I as an error flag corresponding to a type of the abnormality.

The flag storing unit 102*a* can store, as the error flag, the occurrence of the abnormality in the ink jet recording apparatus I and the type of the abnormality.

Note that the abnormality stored in the flag storing unit 102*a* includes, for example, at least one of an abnormality that occurs in the controller 100, an abnormality that occurs in the printing head 1, and an abnormality that occurs in the units of the automatic printing system S.

The abnormality stored in the flag storing unit 102*a* may be, for example, an abnormality detected when the stop processing was executed before. "When the stop processing was executed before" may be timing when the stop processing was performed "last time", may be timing when the stop processing was executed "the time before last", or may be timing when the stop processing was executed further in the past.

As illustrated in FIG. 8, the flag storing unit 102*a* according to this embodiment is configured to store, as an error history, a history of abnormalities that occurred in the past.

Squares with checks in FIG. 8 indicate that an error occurred at predetermined timing, that is, an error flag was set. The error flag can be regarded as "set", for example, when a variable indicating the error flag increases or decreases from an initial value.

On the other hand, squares with hyphens indicate that an error did not occur at the predetermined timing, that is, the error flag was left cleared. The error flag can be regarded as "cleared", for example, when the variable indicating the error flag does not increase or decrease from the initial value.

In the example illustrated in FIG. 8, the error flag is stored (the error flag is set) in the last stop time (timing when the stop processing was executed the last time) and in the last stop time but one (timing when the stop processing was executed the time before last). On the other hand, the error flag is not stored (the error flag is cleared) at the stop time three times before (timing when the stop processing was executed three times before).

The type of the abnormality stored in the flag storing unit 102*a* includes, for example, "nozzle clogging" indicating that the nozzle 12 is clogged and "deflection leak" indicating that the deflection electrode 15 is excessively soiled.

For example, the control unit 101 monitors a flow rate of a path communicating with the gutter 16 and, when the flow rate is excessively small, can determine that nozzle clogging occurs. In this case, it is conceived that, as a result of the clogging occurring in the nozzle 12, deviation occurs in the ink axis and a trouble occurs in the collection of the ink by the gutter 16.

As a sensor for detecting the deviation of the ink axis, the ink jet recording apparatus I includes an ink-axis detecting unit Se2 functioning as a flow-rate detecting unit (see FIG. 2A). The ink-axis detecting unit Se2 can be configured by, for example, a thermal flow sensor. If a flow rate detected by the ink-axis detecting unit Se2 is a specified value or more, the control unit 101 can determine that deviation does not occur in the ink axis and the ink axis is normal.

On the other hand, the control unit 101 monitors a potential difference between the metal plates of the deflection electrode 15 illustrated in FIG. 2B and the like and, when the potential difference is a specified value or less, can determine that a deflection leak occurs. In this case, it is conceived that the units in the printing head 1 are soiled. This soil is hereinafter referred to as "head soil" as well.

As a sensor for detecting the head soil, the ink jet recording apparatus I includes a soil detecting unit Se1 functioning as a voltage detecting unit (see FIG. 2A). The soil detecting unit Se1 can detect a potential difference between the metal plates of the deflection electrode 15. As explained above, when the potential difference is the specified value or less, the control unit 101 can determine that the head soil does not occur.

Every time the stop processing is completed, the control unit 101 according to this embodiment determines whether an abnormality occurs and, when an abnormality occurs, determines a type of the abnormality and causes the flag storing unit 102*a* to store a result of the determination.

The flag storing unit 102*a* sets, in association with timing when the abnormality occurs, an error flag corresponding to a type of the abnormality. Every time the stop processing is executed, the flag storing unit 102*a* sets and stores an error flag. Consequently, as illustrated in FIG. 8, an error history including error flags arranged in time series is configured.

In the example illustrated in FIG. 8, it is seen that the nozzle clogging occurred in the last stop time and the nozzle clogging and the deflection leak occurred in the last stop time but one. In FIG. 8, although the nozzle clogging and the deflection leak occurred in the last stop time but one, as a result of carrying out a cleaning operation in the last start time, the deflection leak is solved (the error flag is cleared) but the nozzle clogging is not solved yet (the error flag is not cleared). That is, since the error flag of the nozzle clogging is continuously set twice in the error history, the nozzle is likely to be considerably soiled.

The maintenance-pattern storing unit 102*b* stores, respectively in association with types of abnormalities, a plurality of kinds of maintenance operations executable on the ink jet recording apparatus I.

The plurality of kinds of maintenance operations include a plurality of kinds of cleaning operations that use the solvent supplied from the solvent supply unit 105. The cleaning operation also includes a partial process of the start processing (for example, a process for cleaning the path connected to the gutter 16). In that sense, the start processing is also considered to be a kind of the cleaning operation.

The plurality of kinds of cleaning operations are set such that at least one of execution times of the cleaning operations and supply paths of the solvent are different from one another. When the cleaning operations are formed by a plurality of processes, the execution times may be differentiated for each of the processes or a part of the processes may be skipped.

The plurality of kinds of maintenance operations further include a discharging operation for discharging at least one of the ink and the solvent from the ink flowing path 104*c* and/or the solvent flowing path 105*c* and a drying operation for drying the inside of the printing head 1 by operating the air pump 106.

The plurality of kinds of maintenance operations are not limited to the cleaning operation, the discharging operation, and the drying operation. The maintenance operations include any operation that can be executed in order to keep the performance of the ink jet recording apparatus I.

Specifically, in the example illustrated in FIG. 9, the maintenance-pattern storing unit 102*b* stores, as the plurality of kinds of maintenance operations, the maintenance processing A to the maintenance processing G formed by combining "automatic cleaning" for automatically cleaning the printing head 1 prior to the start processing, "error release processing" for solving an abnormality stored as an error flag, and "start processing" for bringing the printing head 1 into a printable state.

As it is seen from the illustration, it is unnecessary to execute all of the automatic cleaning, the error release processing, and the start processing. For example, when none of the error flags is stored (all the error flags are cleared), the error release processing is unnecessary.

Accordingly, the maintenance-pattern storing unit 102*b* according to this embodiment is configured to store at least one of the plurality of kinds of maintenance operations in association with a case in which all the error flags are cleared in the flag storing unit 102*a*.

For example, in FIG. 9, among the maintenance processing A to the maintenance processing G, the maintenance processing A to the maintenance processing D are equivalent to a maintenance operation in the case in which all the error flags are cleared and the maintenance processing E to the maintenance processing G are equivalent to a maintenance operation in the case in which any one of the error flags is set.

The maintenance-pattern storing unit 102*b* is configured to able to store the plurality of kinds of maintenance operations further in association with a stop period of the ink jet recording apparatus I in addition to the types of the abnormalities. The stop period can be measured by the timer 108.

For example, in FIG. 9, selection conditions obtained by combining the latest error information (the last error) and the stop period are illustrated. As illustrated in FIG. 9, the maintenance-pattern storing unit 102*b* can store the selection conditions and processing content (the maintenance operation) in association with each other.

The control unit 101 is configured to select, based on a type of an abnormality corresponding to an error flag stored in the flag storing unit 102*a* (specifically an error flag not cleared in the flag storing unit 102*a*) among the error flags, one maintenance operation out of the plurality of kinds of maintenance operations stored in the maintenance-pattern storing unit 102*b* and execute the maintenance operation.

"An error flag not cleared in the flag storing unit 102*a*" may be, for example, "an error flag not cleared at a point in time when power supply to the ink jet recording apparatus I is interrupted".

For example, the control unit 101 can refer to the latest error information at a point in time when the maintenance operation is about to be started and carry out a maintenance operation linked with the error information as the maintenance operation.

As explained above, the maintenance-pattern storing unit 102*b* can store the selection conditions obtained by combining the latest error information and the stop period.

Therefore, the control unit 101 according to this embodiment can select, based on the type of the abnormality corresponding to the error flag not cleared in the flag storing unit 102*a* and the stop period measured by the timer 108 functioning as the time measuring unit, one maintenance operation out of the plurality of kinds of maintenance operations and execute the maintenance operation.

In the example illustrated in FIG. 9, the control unit 101 is configured to select, based on the selection conditions obtained by combining the last error and the stop period, one maintenance processing out of the maintenance processing A to the maintenance processing G and execute the maintenance processing.

As explained above, the maintenance-pattern storing unit 102*b* can store at least one maintenance operation of the plurality of kinds of maintenance operations in association with the case in which all the error flags are cleared in the flag storing unit 102*a*.

Therefore, the control unit 101 according to this embodiment can select and execute a maintenance operation in each of the case in which all the error flags are cleared in the flag storing unit 102*a* and the case in which any one of the error flags is not cleared.

An execution time of the maintenance operation selected when all the error flags are cleared in the flag storing unit 102*a* can be set short compared with an execution time of the maintenance operation selected when any one of the error flags is not cleared.

In the example illustrated in FIG. 9, when all the error flags are cleared, the error release processing is not executed because the error release processing is unnecessary. In this case, an execution time of a maintenance operation formed by combining, the automatic cleaning, the error release processing, and the start processing is short because the error release processing is not performed.

Timing when one maintenance operation is selected out of the plurality of kinds of maintenance operation and executed can be changed as appropriate. As explained above, the timing may be timing when the user attaches the printing head 1 to the head station 200 and presses the operation unit 201. If the attachment of the printing head 1 is detected irrespective of the pressing of the operation unit 201, the timing can be timing when the power supply of the ink jet recording apparatus I is turned on. In that case, the timing may be timing obtained by combining these conditions. The user himself or herself may select any one of the timings.

In the example illustrated in FIG. 2A, the flag storing unit 102*a* and the maintenance-pattern storing unit 102*b* are respectively illustrated as elements of the storing unit 102. However, the flag storing unit 102*a* and the maintenance-pattern storing unit 102*b* are not limited to this example. For example, separate storage devices may be used as the flag storing unit 102*a* and the maintenance-pattern storing unit 102*b*. The flag storing unit 102*a* and the like may be provided in a member other than the controller 100.

Basic Flow of a Maintenance Operation

First, in step S1 in FIG. 7, the printing head 1 is set in (attached to) the head station 200. In the subsequent step S2, the user presses the operation unit 201 functioning as the start button. Consequently, the attachment detecting unit 203 in the head station 200 moves to the predetermined position illustrated in FIG. 6B.

In step S3, the control unit 101 determines whether the printing head 1 is detected, that is, whether the printing head 1 is attached to the head station 200. This determination can be performed based on, for example, whether a detection signal is output from the operation detecting unit 18 and the detection signal is input to the control unit 101. When the determination is NO, the control unit 101 proceeds to step S4. In this case, the control unit 101 performs error display on the operation display unit 103 or the like and ends the control process.

On the other hand, when the determination in step S3 is YES, the control unit 101 proceeds from step S3 to step S5. In this case, the control unit 101 reads out apparatus information from the storing unit 102. The apparatus information read out in step S5 can include, in addition to the error information (latest error information) and the stop period, for example, information relating to a maintenance operation executed before and information indicating result of the execution.

Specifically, the storing unit 102 refers to, as the latest error information, the error flag in the last stop time stored in the flag storing unit 102*a*. The error flag includes the information such as the deflection leak and the nozzle clogging. Timing when these kinds of information are stored may be timing when the stop processing ends, in particular, timing when the circulation of the ink in the ink jet recording apparatus I is stopped.

The stop period is measured by the timer 108. A method of the measurement can be changed as appropriate. The stop period may be, for example, a difference between the timing when the stop processing ends, in particular, time when the circulation of the ink in the ink jet recording apparatus I is stopped and the present time.

In step S6 following step S5, the control unit 101 analyzes the error information read out from the storing unit 102 (in particular, the flag storing unit 102*a*). Similarly, in step S7 following step S6, the control unit 101 analyzes the stop period (the stop period of the apparatus) measured by the timer 108. The order of step S6 and S7 may be changed or steps S6 and S7 may be simultaneously performed.

In step S8 following step S7, the control unit 101 determines selection conditions obtained by combining the error information and the stop period and collates the selection conditions with electronic data (a variable table or the like) equivalent to the table illustrate in FIG. 9. The control unit 101 collates the selection conditions to select, from the maintenance processing A to the maintenance processing G, content of a maintenance operation that should be performed on the ink jet recording apparatus I, in particular, the printing head 1 and executes the maintenance operation.

The maintenance processing A to the maintenance processing G include at least one of the automatic cleaning, the error release processing, and the start processing. The control unit 101 executes the respective kinds of processing in order.

Note that the maintenance processing A to the maintenance processing G illustrated in FIGS. 7 and 9 are only illustrations. As in modifications explained below, other maintenance processing can also be executed. Details of the respective kinds of maintenance processing are explained below.

In step S9 following step S8, the control unit 101 determines whether any maintenance processing selected out of the maintenance processing A to the maintenance processing G is normally completed as the maintenance operation. This determination is performed based on whether the automatic cleaning, the error release processing, and the start processing are respectively successfully ended. For example, while the automatic cleaning or the error release processing (intermittent jetting of the solvent illustrated in FIG. 10) is carried out, when the solvent is exhausted and the automatic cleaning or the error release processing cannot be carried out halfway, the control unit 101 determines that an error occurs in the automatic cleaning itself or the error release processing itself. For example, while the start processing is carried out, when the deviation of the ink axis is detected by the ink-axis detecting unit Se2 or it is detected by the soil detecting unit Se1 that the potential difference between the metal plates of the deflection electrode 15 decreases to the specified value (for example, 7000 V) or less, the control unit 101 determines that an error occurs in the start processing itself. When the determination is YES, the control unit 101 proceeds to step S10. In step S10, the control unit 101 may notify the user via the state display unit 202 that the maintenance operation is normally completed.

In step S10, for example, the user detaches the printing head 1 from the head station 200. As illustrated in FIG. 1, the detached printing head 1 is set in the conveyance line L. Consequently, printing can be applied to the works W.

When the determination in step S9 is NO, the control unit 101 proceeds to step S11. In this case, the control unit 101 determines that an error occurs in a maintenance operation itself for releasing an error, adds one to the number of times of occurrence of errors (hereinafter referred to as "number of times of errors" as well", and proceeds to step S12.

In step S12, the control unit 101 determines whether the number of times of errors is a specified number of times or more. When the determination is NO, the control unit 101 returns to step S5. In this case, the control unit 101 performs selection of a maintenance operation and subsequent steps again (that is, retries a maintenance operation). On the other hand, when the determination is YES, the control unit 101 proceeds to step S13, determines that an abnormality ends, and completes the control process.

Note that the user himself or herself may set the specified number of times used in steps S11 and S12. The control unit 101 may carry out determination using a time period instead of using the specified number of times. For example, the control unit 101 may count an execution time of the maintenance operation with the timer 108 and, when the execution time exceeds a specified time, retry the maintenance operation.

When proceeding from step S9 to step S11, the control unit 101 may notify the user via the state display unit 202 that the maintenance operation is not normally completed.

While the maintenance is carried out in step S8, when an abnormality (for example, positional deviation of the printing head 1 with respect to the head station 200 and an abnormality relating to the hardware configurations of the printing head 1 and the controller 100) occurs, the control unit 101 may stop the maintenance operation.

Details of the Maintenance Operation

Details of the automatic cleaning, the error release processing, and the start processing are explained below.

FIG. 10 is a flowchart illustrating details of the maintenance operation. The flowchart illustrates details of step S8 in FIG. 7. That is, steps S21 to S24 in FIG. 10 configure step S8 in FIG. 7.

In step S21 in FIG. 10, based on the selection conditions, the control unit 101 determines whether the automatic cleaning should be performed, selects a type of the automatic cleaning that should be performed, and executes the automatic cleaning.

In subsequent step S22, the control unit 101 determines whether all the error flags are cleared. When the determination is NO, the control unit 101 proceeds to step S23. In step S23, based on the selection conditions, the control unit 101 determines whether the error release processing should be performed, selects a type of the error release processing that should be performed, and executes the error release processing. When the error release processing is completed, the control unit 101 proceeds from step S23 to step S24.

On the other hand, when the determination in step S22 is YES, the control unit 101 skips step S23 and proceeds to step S24. In step S24, the control unit 101 selects a type of the start processing, executes the start processing, and ends the maintenance operation.

Figure 11:
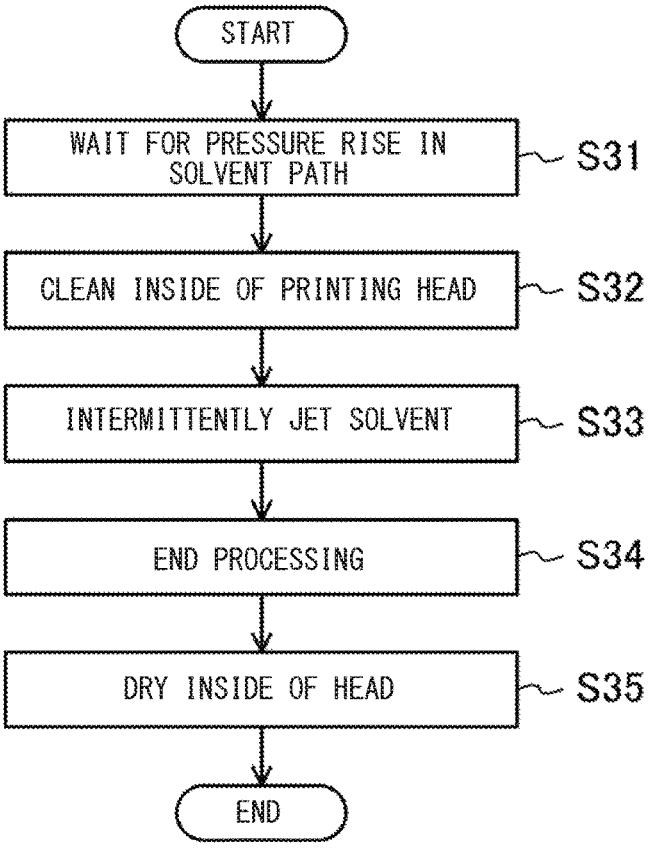
FIG. 11 is a flowchart illustrating processing relating to automatic cleaning.
Figure 13:
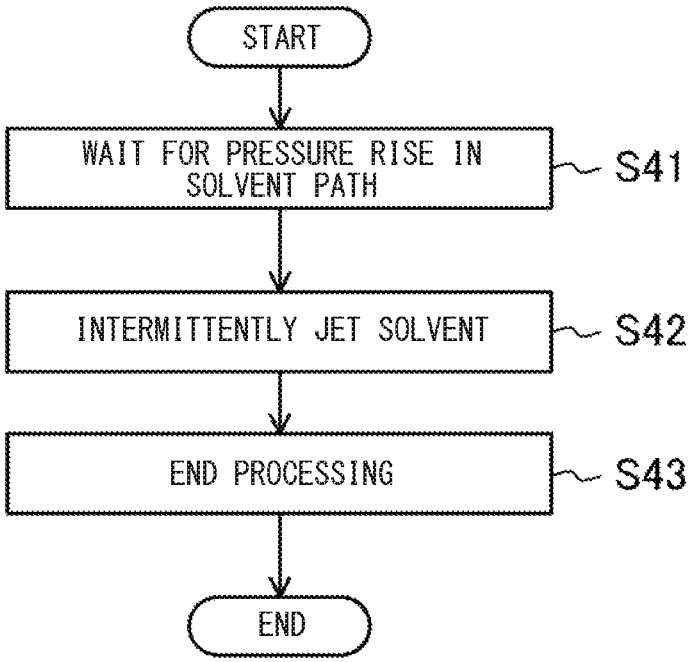
FIG. 13 is a flowchart illustrating error release processing.
Figure 14:
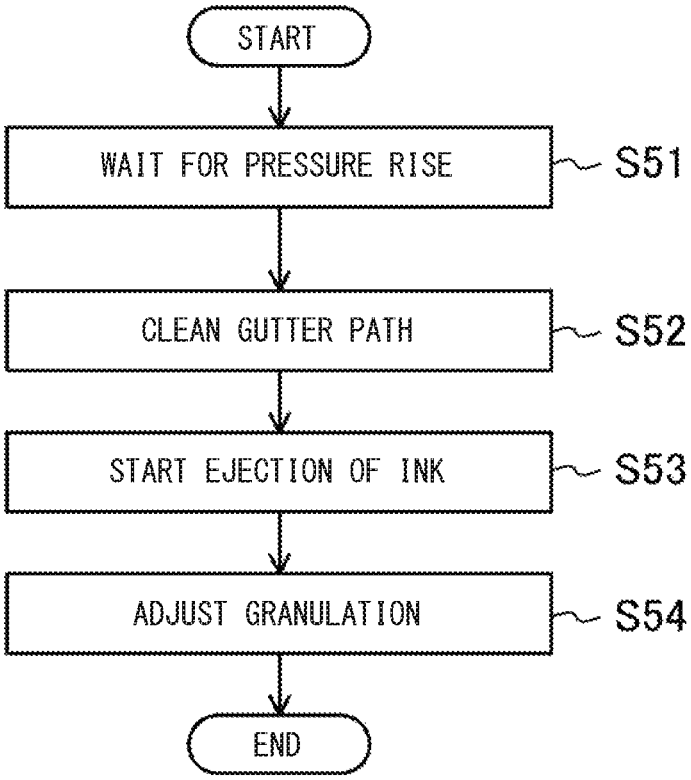
FIG. 14 is a flowchart illustrating start processing.
Figure 15A:
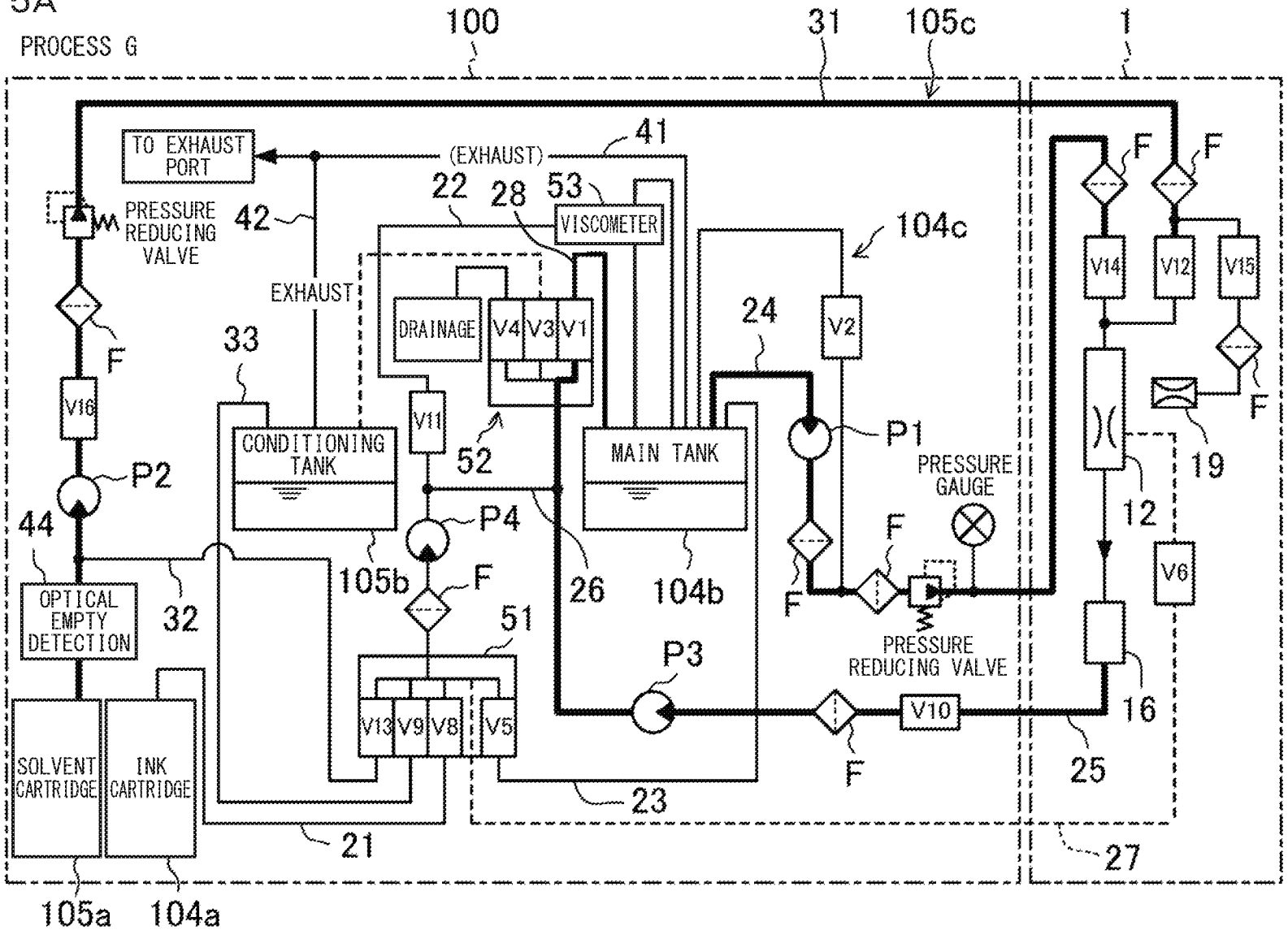
FIG. 15A is a diagram for explaining a process G in the start processing.
Figure 15B:
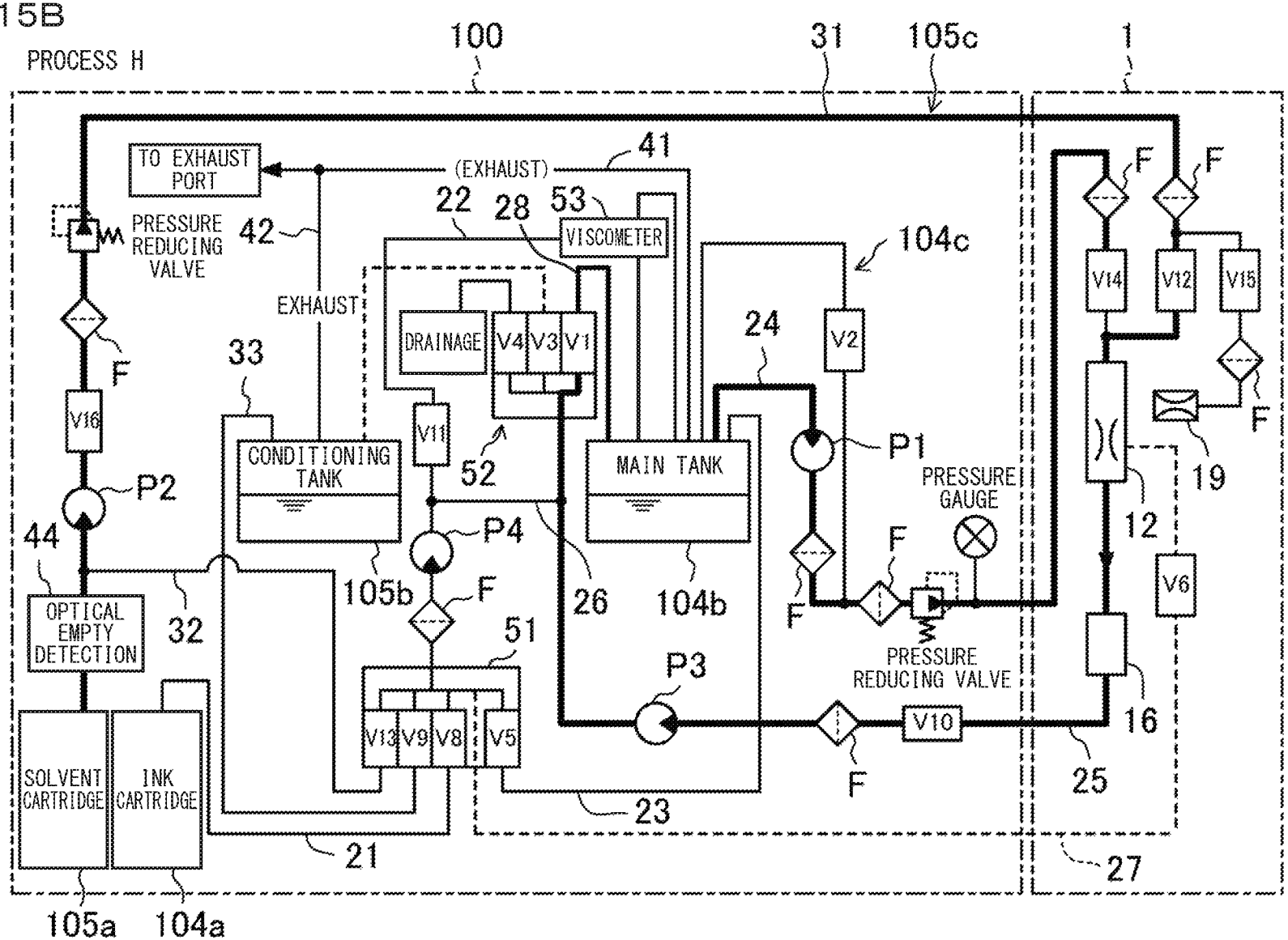
FIG. 15B is a diagram for explaining a process H in the start processing.
Figure 15C:
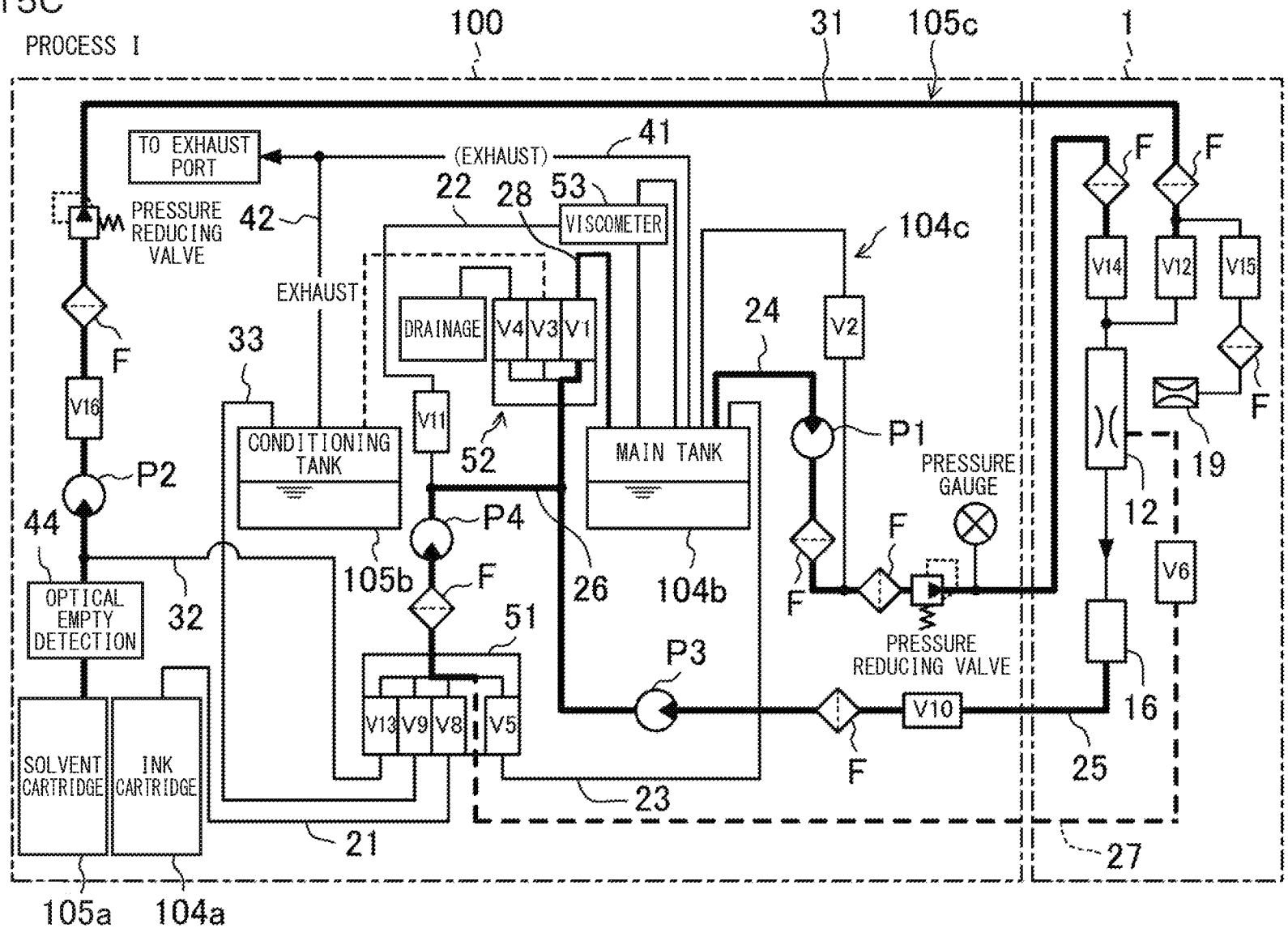
FIG. 15C is a diagram for explaining a process I in the start processing.
Figure 15D:
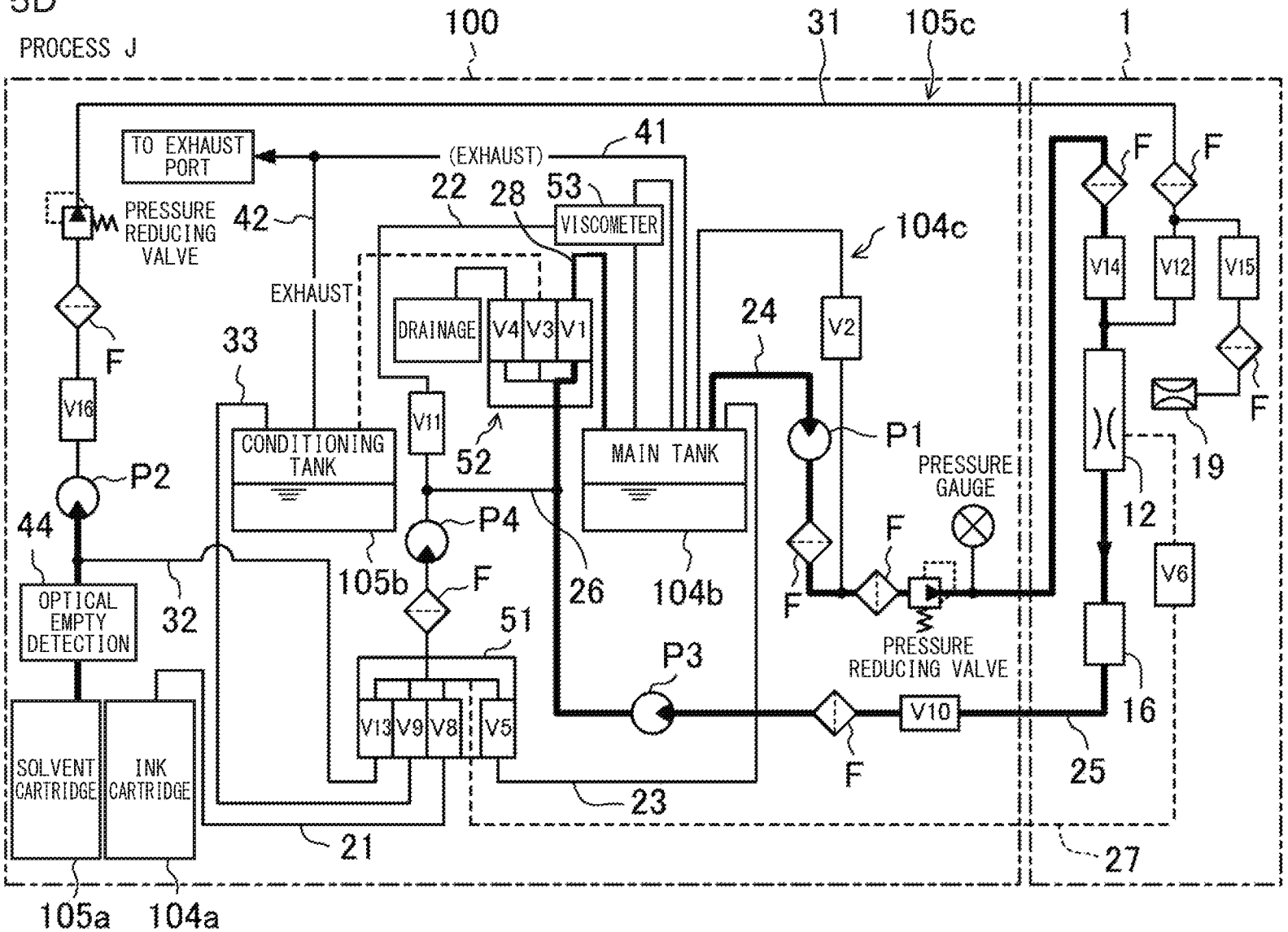
FIG. 15D is a diagram for explaining a process J in the start processing.

FIG. 11 is a flowchart illustrating processing relating to the automatic cleaning. FIGS. 12A to 12F are respectively diagrams for explaining processes A to F in the automatic cleaning. FIG. 13 is a flowchart illustrating the error release processing. FIG. 14 is a flowchart illustrating the start processing. FIGS. 15A to 15D are diagrams for explaining processes G to J in the start processing.

Automatic Cleaning

The automatic cleaning is explained in detail below.

First, in step S31 in FIG. 11, the control unit 101 pressurizes the path for the solvent in the ink jet recording apparatus I. Specifically, the control unit 101 executes the process A illustrated in FIG. 12A in order to pressurize the path for the solvent (in particular, the first solvent path 31).

In the process A, in order to prepare the solvent, in a state in which the sixteenth valve V16 is opened, the control unit 101 puts the twelfth valve V12 on standby in a closed state. When the solvent pump P2 operates in that state, the solvent stored in the solvent cartridge 105*a* is supplied to the vicinity of the twelfth valve V12 via the first solvent path 31 (see a thick line in FIG. 12A).

In step S32 following step S31, the control unit 101 cleans the inside of the printing head 1. Specifically, in order to clean the inside of the printing head 1, the control unit 101 alternately executes the process B illustrated in FIG. 12B and the process C illustrated in FIG. 12C.

In the process B, the control unit 101 jets the solvent (the cleaning liquid) from the ASC nozzle 19 in a state in which the fifteenth valve V15 is opened. The jetting is executed for a predetermined period. The inside of the printing head 1 can be cleaned by the jetted solvent (see a thick line in FIG. 12B).

Figure 12A:
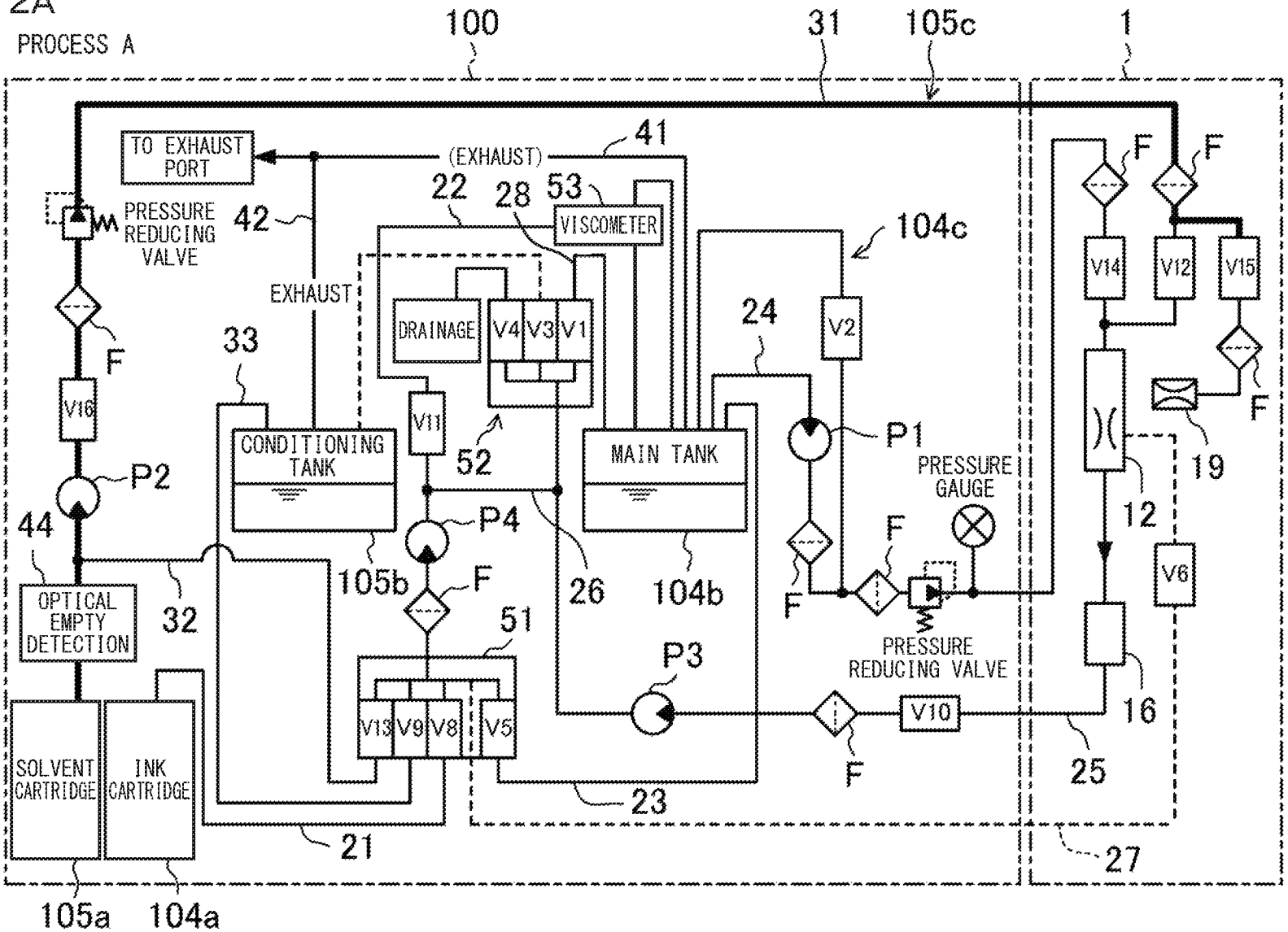
FIG. 12A is a diagram for explaining a process A in the automatic cleaning.
Figure 12B:
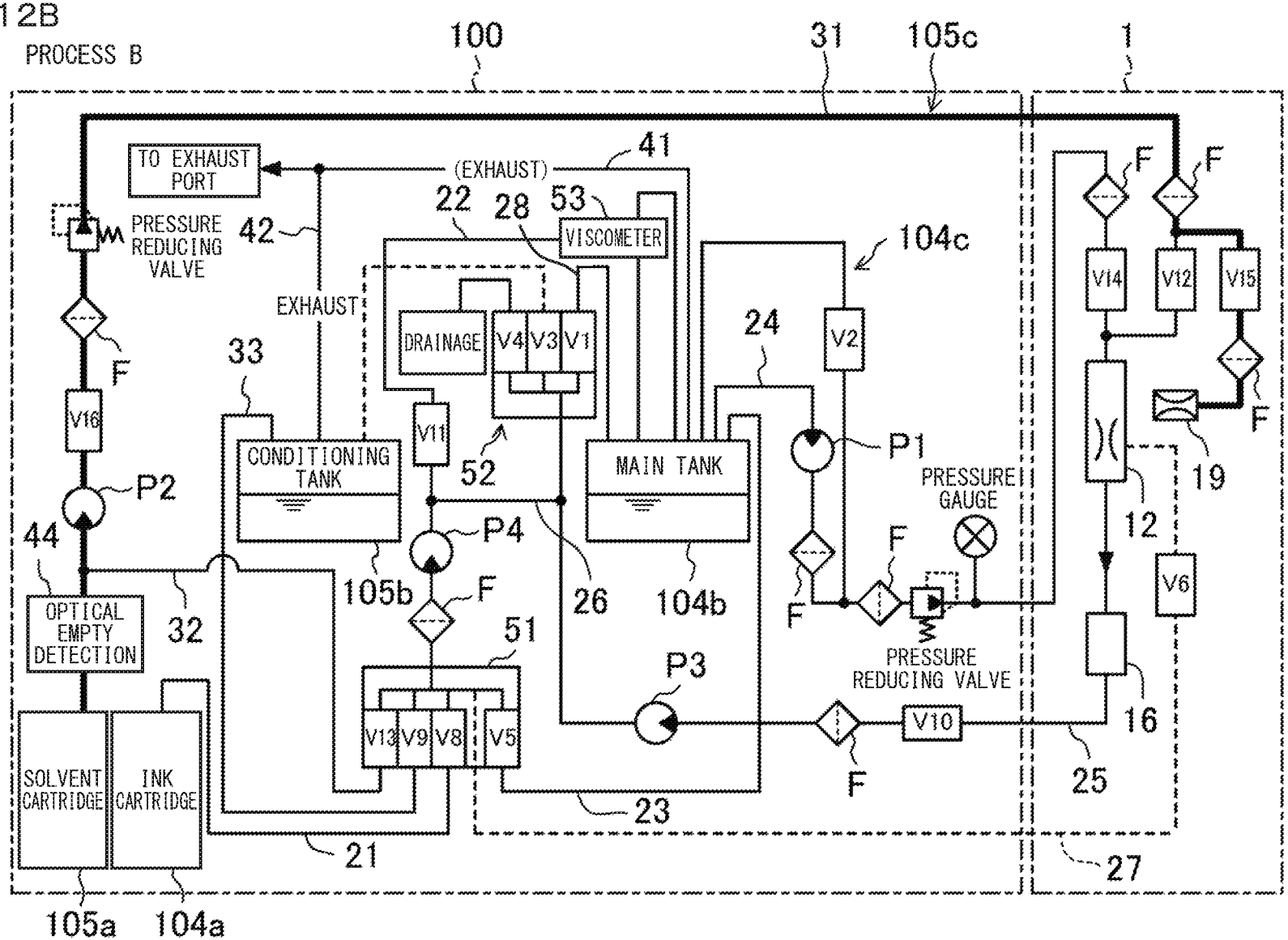
FIG. 12B is a diagram for explaining a process B in the automatic cleaning.
Figure 12C:
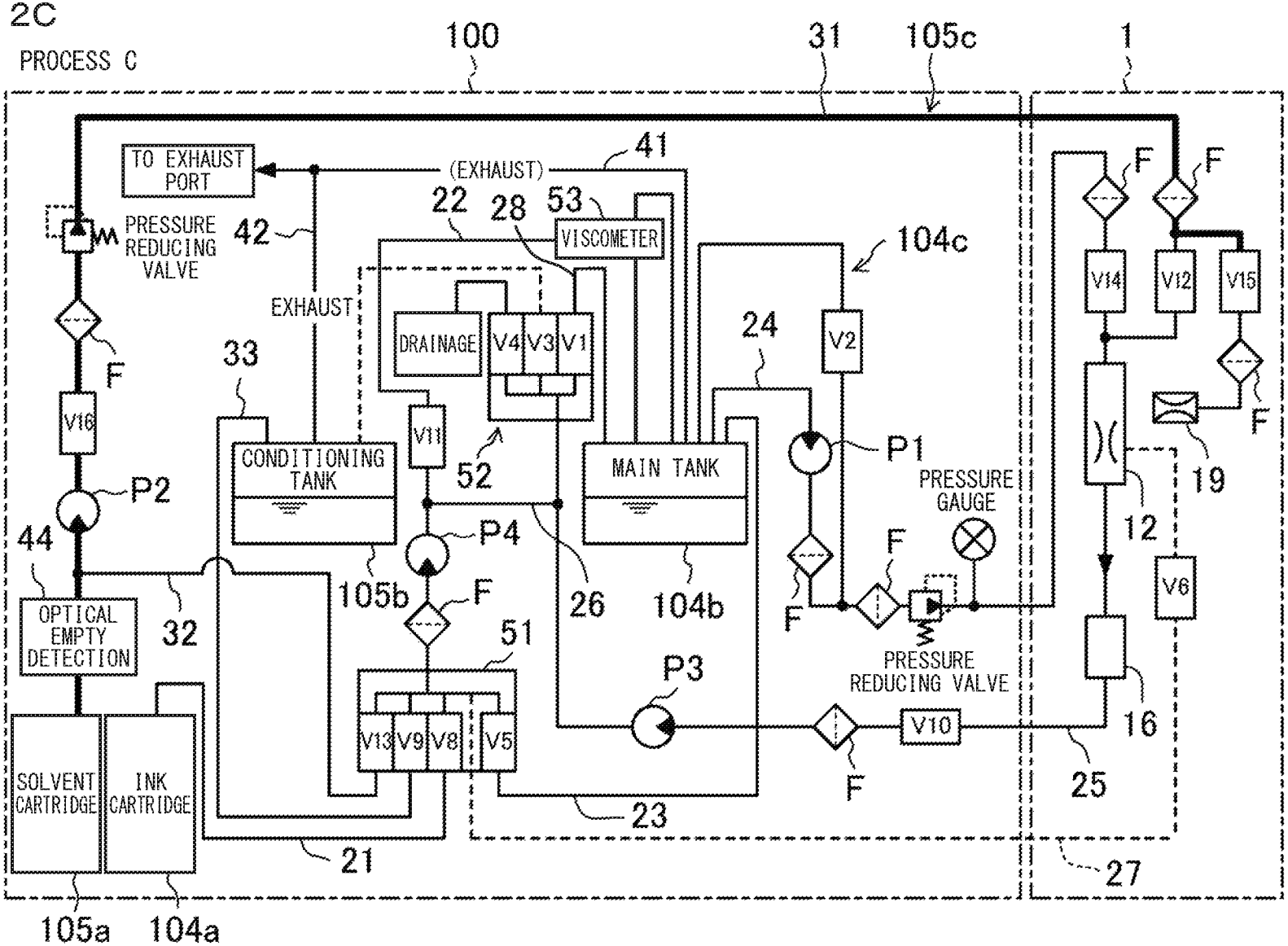
FIG. 12C is a diagram for explaining a process C in the automatic cleaning.
Figure 12D:
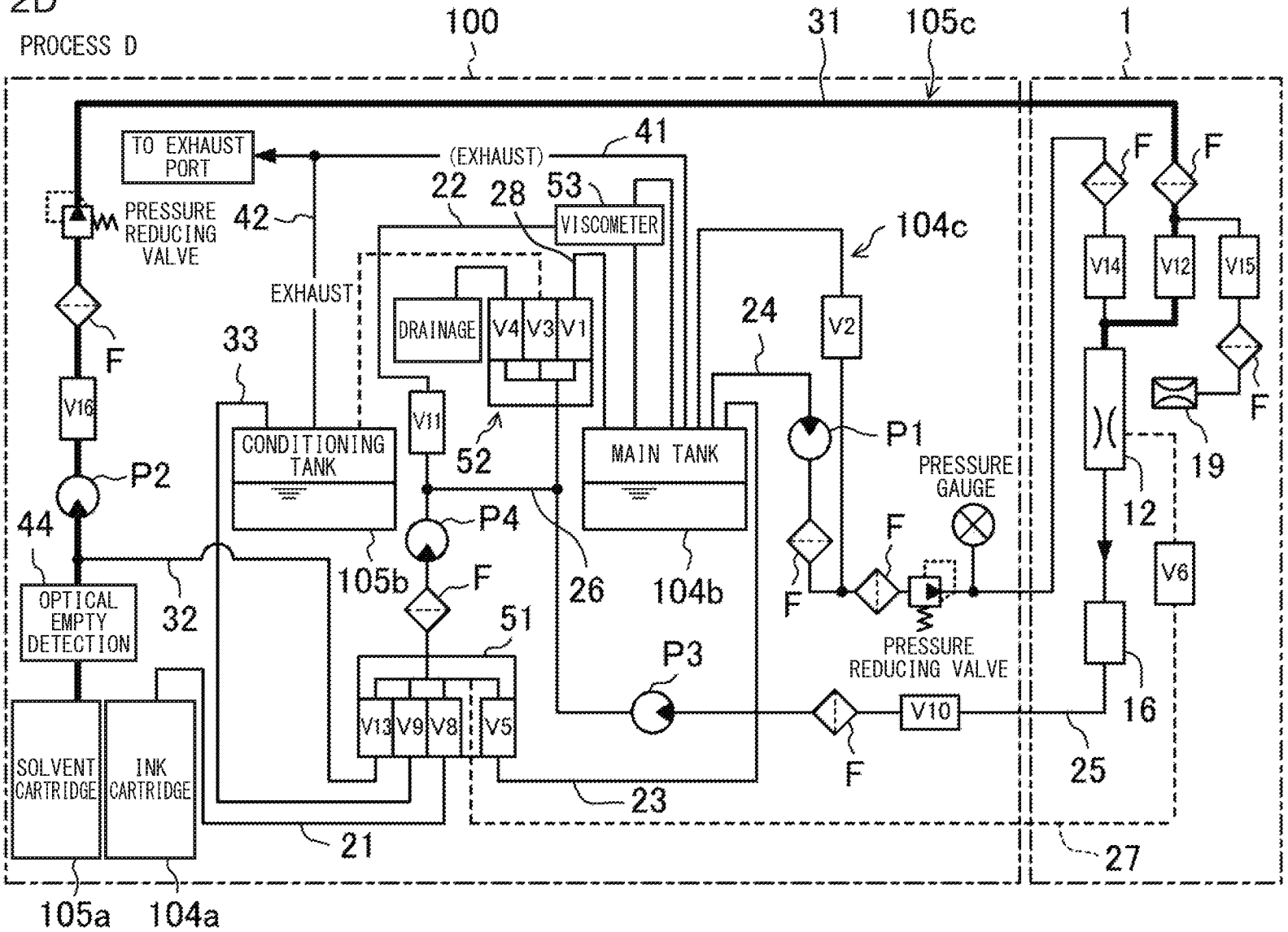
FIG. 12D is a diagram for explaining a process D in the automatic cleaning.
Figure 12E:
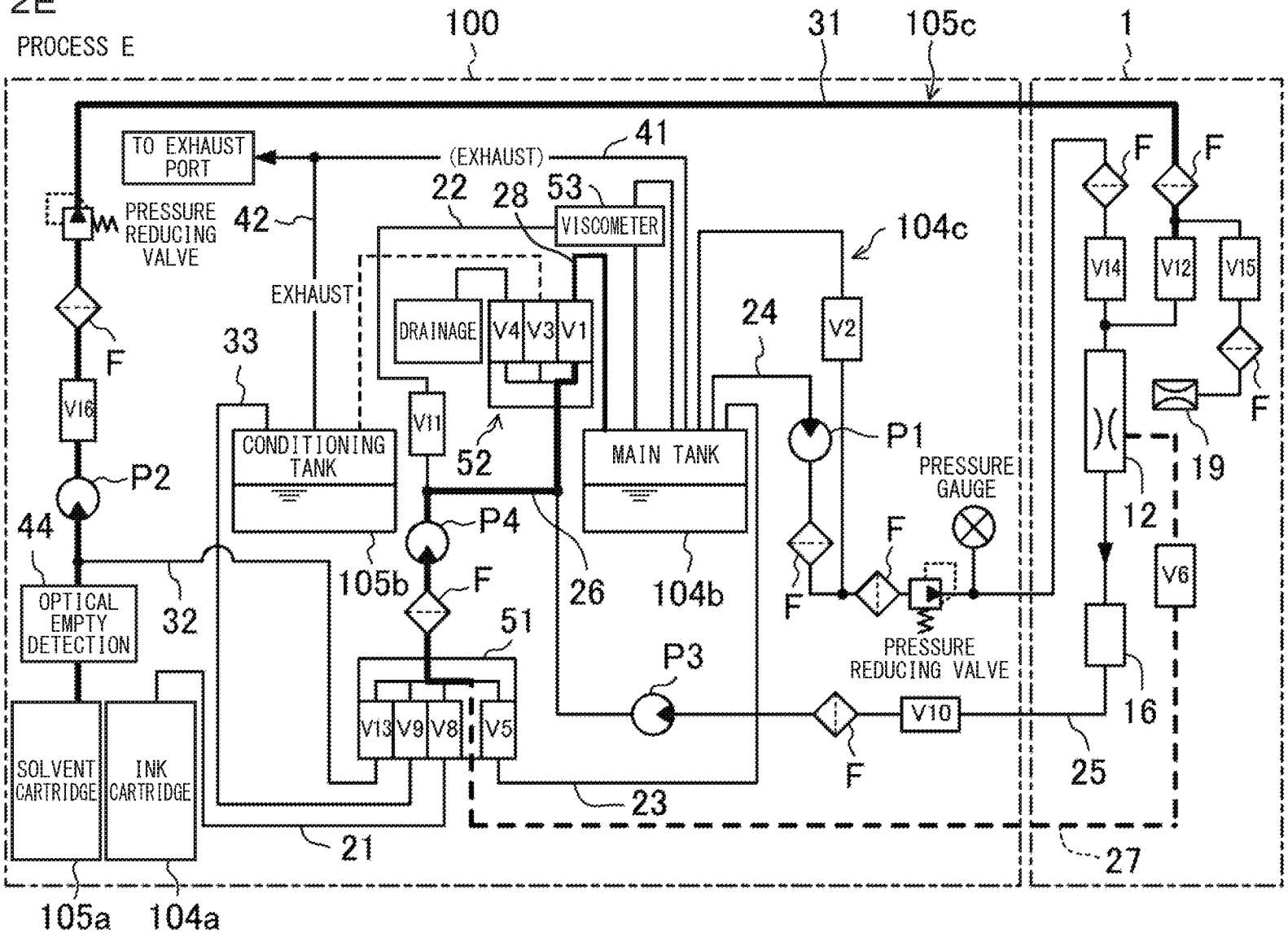
FIG. 12E is a diagram for explaining a process E in the automatic cleaning.
Figure 12F:
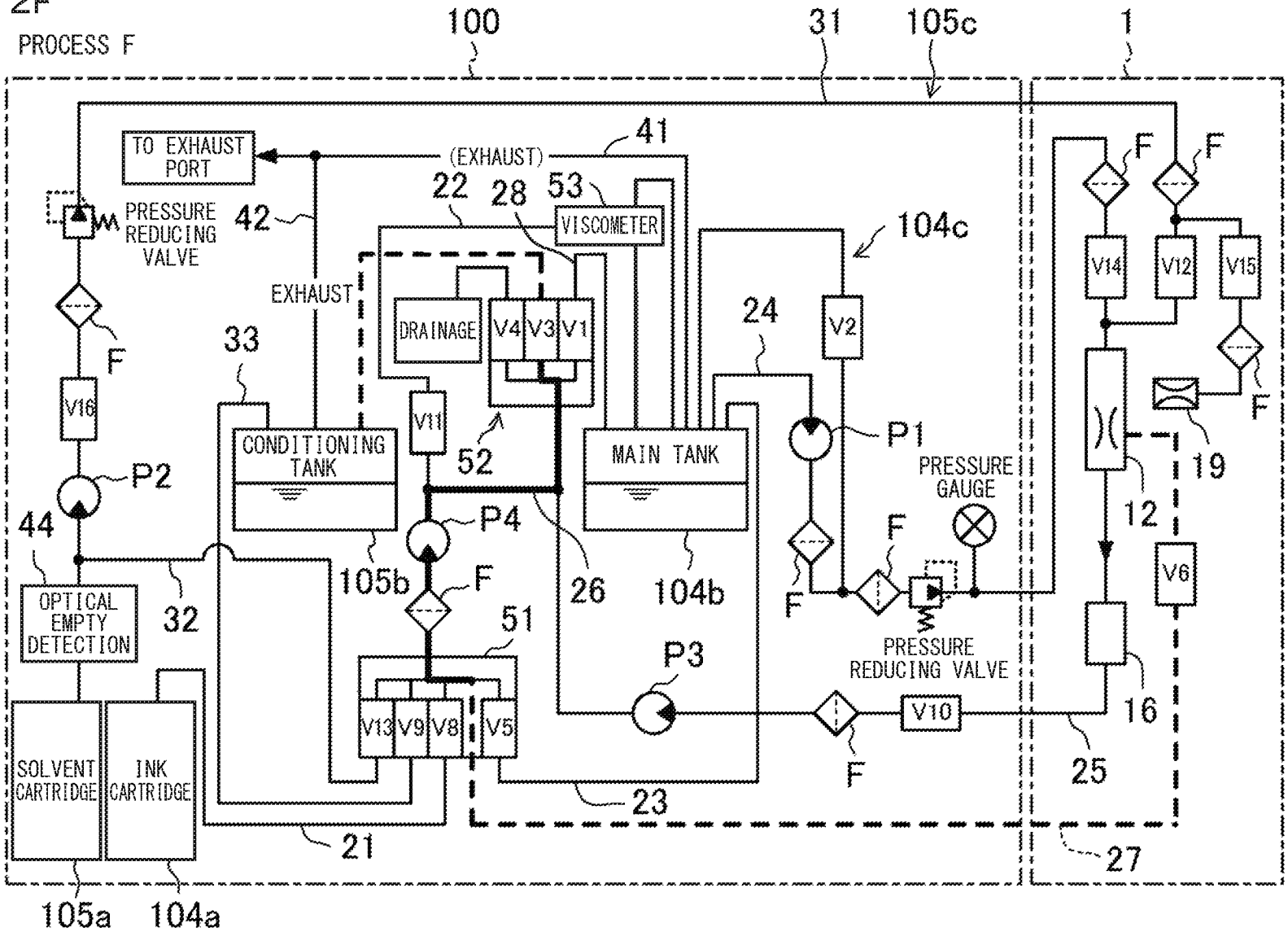
FIG. 12F is a diagram for explaining a process F in the automatic cleaning.

In the process C, the control unit 101 closes the fifteenth valve V15 and puts the fifteenth valve V15 on standby in the closed state (see a thick line in FIG. 12C). Consequently, the first solvent path 31 is pressurized again.

The processes B and C are repeated at least once (for example, in two to eight sets). A time period (for example, approximately several seconds) in which the process B is carried out in step S32 is set to substantially the same time period as a time period in which the process C is carried out.

In step S33 following step S32, the control unit 101 executes intermittent ejection of the solvent (intermittently jets the solvent). Specifically, in order to intermittently eject the solvent, the control unit 101 alternately executes the process D illustrated in FIG. 12D and the process E illustrated in FIG. 12E. By intermittently ejecting the solvent, the ink jet recording apparatus I, in particular, the nozzle 12 forming the printing head 1 can be cleaned. This operation is hereinafter referred to as "intermittent jetting operation".

In the process D, the control unit 101 opens the sixteenth valve V16 and the twelfth valve V12. When the solvent pump P2 operates in that state, the solvent stored in the solvent cartridge 105*a* is ejected from the nozzle 12 via the first solvent path 31 (see a thick line in FIG. 12D). Although not illustrated in FIG. 12D, the solvent ejected from the nozzle 12 is collected by the gutter 16.

In the process E, the control unit 101 closes the twelfth valve V12 and opens the sixth valve V6 and the first valve V1. Then, the pressure in the nozzle 12 suddenly drops with a negative pressure applied by the circulation pump P4. Consequently, the solvent remaining in the nozzle 12 is sucked into the main tank 104*b* via the suction path 27, the first dividing unit 51, the sixth ink path 26, the first valve V1, and the eighth ink path 28 (see a thick line in FIG. 12E).

The processes D and E are repeated a plurality of times (for example, in two to eight sets). A time period (for example, shorter than 1 second) in which the process D is carried out in step S33 is shorter than a time period (for example, approximately several seconds) in which the process E is carried out.

After closing the twelfth valve V12 in the process E, the control unit 101 opens the twelfth valve V12 in the process D, whereby the solvent is intermittently jetted. When shifting from the process D to the process E, the control unit 101 may close the twelfth valve V12 for approximately several seconds. In this way, the pressure of the solvent near the twelfth valve V12 can be increased. When the twelfth valve V12 is opened, the solvent can be powerfully ejected.

In step S34 following step S33, the control unit 101 executes end processing relating to the automatic cleaning. Specifically, the control unit 101 executes the process F illustrated in FIG. 12F in order to remove the solvent remaining in the nozzle 12 and a substance that causes the nozzle clogging.

In the process F, the control unit 101 opens the sixth valve V6 and the third valve V3. Then, the solvent remaining in the nozzle 12 is sucked into the conditioning tank 105*b* via the suction path 27, the first dividing unit 51, the sixth ink path 26, and the third valve V3 by the negative pressure applied by the circulation pump P4 (see a thick line in FIG. 12F).

In step S35 following step S34, the control unit 101 blows the air into the printing head 1 and dries the inside of the printing head 1 (intra-head drying). Specifically, the control unit 101 operates the air pump 106 and supplies the air into the printing head 1. The supply of the air is executed for a specified time. The specified time at this time is set according to, for example, the ambient temperature of the ink jet recording apparatus I and the type of the solvent used for the cleaning.

The control unit 101 according to this embodiment can perform automatic cleaning more powerful (hereinafter referred to as "powerful cleaning") than normal automatic cleaning (hereinafter referred to "normal cleaning") by reducing the number of times the processes B and C are repeated in step S32, the number of times the processes D and E are repeated in step S33, and a time period in which the process F is executed in step S34.

Similarly, the control unit 101 according to this embodiment can perform automatic cleaning (hereinafter referred to as "short time cleaning") with a shorter execution time than the normal cleaning by reducing the number of times the processes B and C are repeated in step S32, the number of times the processes D and E are repeated in step S33, and the time period in which the process F is executed in step S34.

Error Release Processing

Subsequently, the error release processing is explained.

First, in step S41 in FIG. 13, the control unit 101 pressurizes the path for the solvent in the ink jet recording apparatus I. Specifically, the control unit 101 executes the process A in order to pressurize the path for the solvent (in particular, the first solvent path 31). When the process A is executed, the solvent stored in the solvent cartridge 105*a* is supplied to the vicinity of the twelfth valve V12 (see a thick line in FIG. 12A).

In step S42 following step S41, the control unit 101 executes intermittent ejection of the solvent (intermittently jets the solvent). Specifically, the control unit 101 alternately executes the process D illustrated in FIG. 12D and the process E illustrated in FIG. 12E in order to intermittently eject the solvent. By executing the processes, the intermittent jetting operation explained above is performed. The solvent can be intermittently jetted from the nozzle 12.

A time period in which the process D is executed in the error release processing may be longer (for example, approximately several times) than a time period in which the process D is executed in the automatic cleaning.

Similarly, the number of times the processes D and E are repeated in the error release processing may be longer (for example, approximately ten times) than the number of times the processes D and E are repeated in the automatic cleaning.

By extending the execution time of the process D and increasing the number of times itself the process D is performed, it is possible to eject a relatively large amount of the solvent from the nozzle 12 and more surely wash away soil adhering to the nozzle 12 and the like.

In step S43 following step S42, the control unit 101 executes end processing relating to the error release processing. Specifically, the control unit 101 executes the process F illustrated in FIG. 12F in order to remove the solvent remaining in the nozzle 12 and the substance that causes the nozzle clogging. By executing the process F, the solvent remaining in the nozzle 12 is sucked into the conditioning tank 105*b* by the negative pressure applied by the circulation pump P4 (see a thick line in FIG. 12F).

Start Processing

Subsequently, the start processing is explained.

First, in step S51 in FIG. 14, the control unit 101 pressurizes the paths for the ink and the solvent in the ink jet recording apparatus I (pressure rise waiting). Therefore, the control unit 101 executes the process G illustrated in FIG. 15A. In the process G, in order to prepare the solvent, in a state in which the sixteenth valve V16 is opened, the control unit 101 puts the twelfth valve V12 on standby in a closed state. The solvent pump P2 operates in that state, whereby the solvent stored in the solvent cartridge 105*a* is supplied to the vicinity of the twelfth valve V12 via the first solvent path 31 (see a thick line in FIG. 15A).

In order to prepare the ink, the control unit 101 puts the fourteenth valve V14 on standby in a closed state. The ink pump P1 operates in that state, whereby the ink stored in the main tank 104*b* is supplied to the vicinity of the fourteenth valve V14 via the fourth ink path 24 (see a thick line in FIG. 15A).

In order to prepare the gutter 16, the control unit 101 puts the tenth valve V10 and the first valve V1 on standby in an open state. The gutter pump P3 operates in that state, whereby the ink or the solvent collected by the gutter 16 can be fed back to the main tank 104*b* via the fifth ink path 25 and the second dividing unit 52 (see a thick line in FIG. 15A).

In the process G, a detection signal of a pressure gauge (see FIG. 3 and the like) is input to the control unit 101. The control unit 101 stays on standby based on such a detection signal until the pressure of the fourth ink path 24 increases to a specified value or more.

In step S52 following step S51, the control unit 101 cleans a path communicating with the gutter 16 (cleans a gutter path). Specifically, the control unit 101 alternately executes the process H illustrated in FIG. 15B and the process I illustrated in FIG. 15C (for example, in one to three sets) in order to clean the path communicating with the gutter 16.

Specifically, in the process H, the control unit 101 opens the twelfth valve V12, whereby the solvent is ejected from the nozzle 12. The solvent ejected in that way is collected by the gutter 16 (see a thick line in FIG. 15B).

In the process I, the control unit 101 closes the twelfth valve V12 and stops the ejection of the solvent from the nozzle 12. At the same time, the control unit 101 opens the first valve V1 and the sixth valve V6. Consequently, the solvent ejected in the preceding process H is sucked into the suction path 27. The solvent sucked into the suction path 27 is fed back to the main tank 104*b* via the sixth valve V6 and the first valve V1 (see a thick line in FIG. 15C).

In step S53 following step S52, the control unit 101 executes the process J and ejects the ink from the nozzle 12. In the process J, the control unit 101 closes the sixth valve V6 and the sixteenth valve V16 and opens the fourteenth valve V14. Consequently, the supply of the solvent is stopped and, on the other hand, the axial ink (the ink axis) is ejected from the nozzle 12. The ink ejected in that way is collected by the gutter 16. The ink collected in that way is fed back from the fifth ink path 25 to the main tank 104*b* via the first valve V1 (see a thick line in FIG. 15D). As indicated by the thick line in FIG. 15D, the ink circulates between the printing head 1 and the controller 100.

In step S54 following step S53, the control unit 101 starts vibration of the ink ejected from the nozzle 12 and voltage application to the charging electrode 13 and the deflection electrode 15. Consequently, it is possible to granulate, charge, and deflect the ink.

When step S54 is completed, the ink circulates on the inside of the ink jet recording apparatus I. The apparatus comes into a printable state.

The control unit 101 according to this embodiment can perform start processing (hereinafter referred to as "simple start") simpler than normal start processing (hereinafter referred to as "normal start") by reducing the number of times the processes H and I are repeated in step S52.

Specific Example of the Maintenance Operation

As illustrated in FIG. 7, in this embodiment, contents of the automatic cleaning, the error removal processing, and the start processing are set about each of the maintenance processing A to the maintenance processing G functioning as maintenance operations.

For example, the maintenance processing A is a maintenance operation executed when an abnormality did not occur in the last stop time and the stop period is one hour or less. In this case, the error release processing is unnecessary. Since the stop period is short, the automatic cleaning is also unnecessary and the simple start is executed. Consequently, it is possible to save the solvent and reduce a time period required for the maintenance operation and a time period required until the printing head 1 is brought into the printable state. The maintenance processing A is used when the printing is temporarily stopped, for example, in a lunch break.

The maintenance processing B is a maintenance operation executed when an abnormality did not occur in the last start time and the stop period is one day or less. In this case, the error release processing is unnecessary, the short-time cleaning is executed as the automatic cleaning, and the normal start is executed as the start processing. The maintenance processing B is used when the printing is stopped overnight, for example, when a working hour of one day ends.

The maintenance processing C is a maintenance operation executed when an abnormality did not occur in the last stop time and the stop period is one week or less. In this case, the error release processing is unnecessary. As the automatic cleaning, the normal cleaning more excellent in cleaning performance than the short-time cleaning is executed. The normal start is executed as the start processing. The maintenance processing C is used when holidays continue for a few days such as a weekend.

The maintenance processing D is a maintenance operation executed when an abnormality did not occur in the last stop time and the stop period is two weeks or less. In this case, the error release processing is unnecessary. As the automatic cleaning, the powerful cleaning more excellent in cleaning performance than the normal cleaning is executed. The normal stop is executed as the start processing. The maintenance processing D is used in a long-term leave such as year end and new year holidays.

The maintenance processing E is a maintenance operation executed when the nozzle clogging occurred in the last stop time and the stop period is ten minutes or less. In this case, as the error release processing, the intermittent jetting operation explained with reference to FIG. 13 is executed. The normal cleaning is executed as the automatic cleaning. The normal start is executed as the start processing. The maintenance processing E is used as a restoration operation carried out before the ink around the nozzle 12 solidifies.

The maintenance processing F is a maintenance operation executed when the deflection leak occurred in the last stop time and the stop period is one hour or less. In this case, since the deflection electrode 15 is considered to be soiled, the error release processing such as the intermittent jetting operation is unnecessary. Instead, the powerful cleaning is executed as the automatic cleaning. The normal start is executed as the start processing. The maintenance processing F is used to wash off soil adhering to the deflection electrode 15 and the like by intensively cleaning the inside of the printing head 1, for example, the flying space S1.

The maintenance processing G is a maintenance operation executed when the deflection leak occurred in the last stop time and the stop period is one day or less. In this case, as in the maintenance processing F, the error release processing such as the intermittent jetting operation is unnecessary. Instead, the powerful cleaning is executed as the automatic cleaning. The error release processing such as the intermittent jetting operation is unnecessary. Instead, the powerful cleaning is executed as the automatic cleaning.

The maintenance processing A to the maintenance processing G are only illustrations as explained above. Contents of the respective kinds of maintenance processing can be changed as appropriate according to the specifications of the ink jet recording apparatus I.

About Automation of the Maintenance Operation

According to this embodiment, as illustrated in FIG. 9, the maintenance-pattern storing unit 102*b* stores, in association with each other, the types of the abnormalities that could occur in the ink jet recording apparatus I and the maintenance processing A to the maintenance processing G functioning as the plurality of kinds of maintenance operations. As illustrated in FIG. 7, the control unit 101 automatically selects, based on the stored content in the maintenance-pattern storing unit 102*b*, a maintenance operation corresponding to a type of an abnormality. A mechanism not requiring technical knowledge and experience is realized by automatically selecting the maintenance operation.

Consequently, it is possible to carry out an appropriate maintenance operation irrespective of knowledge and experience of a user.

For example, when the cleaning operation such as the automatic cleaning is carried out as the maintenance operation, hardening of the ink progresses when the stop period of the ink jet recording apparatus I is long compared with when the stop period is short. The cleaning operation needs to be carried out for a longer time because of the progress of the hardening of the ink.

As illustrated in FIG. 9, the maintenance-pattern storing unit 102*b* stores, in association with each other, the stop period of the ink jet recording apparatus I and the maintenance operation executable on the apparatus in addition to the type of the abnormality. The maintenance operation corresponding to the type of the abnormality can be automatically selected based on content of the storage. Consequently, a more appropriate maintenance operation can be carried out.

In general, maintenance operations carried out on the ink jet recording apparatus I include not only operation carried out when an abnormality occurs in the apparatus but also operation carried out when an abnormality does not occur, for example, the normal start processing. The latter operation is considered to be able to be performed in a shorter time because it is unnecessary to solve the abnormality.

The execution time of the maintenance operation (for example, the maintenance processing B in FIG. 9) selected when an abnormality does not occur, that is, when all the error flags are cleared is set short compared with the execution time of the maintenance operation (for example, the maintenance processing G in FIG. 9) selected when an abnormality occurs, that is, any one of the error flags is not cleared. Consequently, a more appropriate maintenance operation can be carried out.

The control unit 101 selects the maintenance operation based on a type of an abnormality at a point in time when the power supply to the ink jet recording apparatus I is interrupted, for example, at a point in time when the operation of the ink jet recording apparatus I is temporarily stopped such as the error flag in the last stop time in FIG. 8. Consequently, a more appropriate maintenance operation can be carried out.

The control unit 101 can execute the maintenance operation when the ink jet recording apparatus I is turned on, for example, when the operation of the ink jet recording apparatus I is resumed. Consequently, a more appropriate maintenance operation can be carried out.

As illustrated in FIG. 6B and steps S1 to S3 in FIG. 7, the control unit 101 is configured to execute the maintenance operation on the printing head 1 when the operation unit 201 of the head station 200 is operated in a state in which the printing head 1 is attached to the head station 200.

With this configuration, in order to execute the maintenance operation, the printing head 1 needs to be attached to the head station 200. Accordingly, it is possible to improve safety of the maintenance operation and align the posture of the printing head 1 at the time when the maintenance operation is executed. It is possible to improve convenience of use of the ink jet recording apparatus I.

The ink jet recording apparatus I according to this embodiment is configured to dry the inside of the printing head 1 by operating the air pump 106 equipped in the controller 100 as illustrated in FIG. 2A. Consequently, it is possible to execute the maintenance operation without supplying the air such as the factory air from the outside.

The ink jet recording apparatus I according to this embodiment is configured to directly supply the air to the flying space S1 in the printing head 1 as illustrated in FIG. 2B. Specifically, one end of the air tube 106*c* is opened in the flying space S1. Consequently, it is possible to more surely and quickly dry the inside of the printing head 1.

In the ink jet recording apparatus I according to this embodiment, as illustrated in FIG. 6B, it is unnecessary to detach the cover member 10*f* when the maintenance operation is executed. Therefore, it is possible to save labor and time in executing the maintenance operation. It is possible to improve convenience of use of the ink jet recording apparatus I.

In the ink jet recording apparatus I according to this embodiment, as illustrated in FIG. 1, the head station 200 and the controller 100 are separated. Accordingly, it is possible to freely change the place of the head station 200. It is possible to improve convenience of use of the ink jet recording apparatus I.

In general, it is also conceivable that the connection cable 107 is longer than the connection cable 107 in the example illustrated in FIG. 1 and the controller 100 and the printing head 1 are disposed in positions apart from each other. According to this embodiment, in such a case, it is possible to execute the maintenance operation without carrying the printing head 1 to the controller 100.

The ink jet recording apparatus I according to this embodiment can perform the intermittent jetting operation in the maintenance operation. Consequently, it is possible to powerfully jet the solvent and efficiently clean the printing head 1.

Incidentally, in the embodiment, the last error and the stop period are used as the selection conditions. However, this configuration is not essential. As the selection conditions, at least the last error only has to be used. As the selection conditions, information other than the last error and the stop period can also be used.

A modification of the selection conditions and a modification of the maintenance operation executed with reference to the modification are explained in detail.

Modification of the Maintenance Operation

Figure 16:
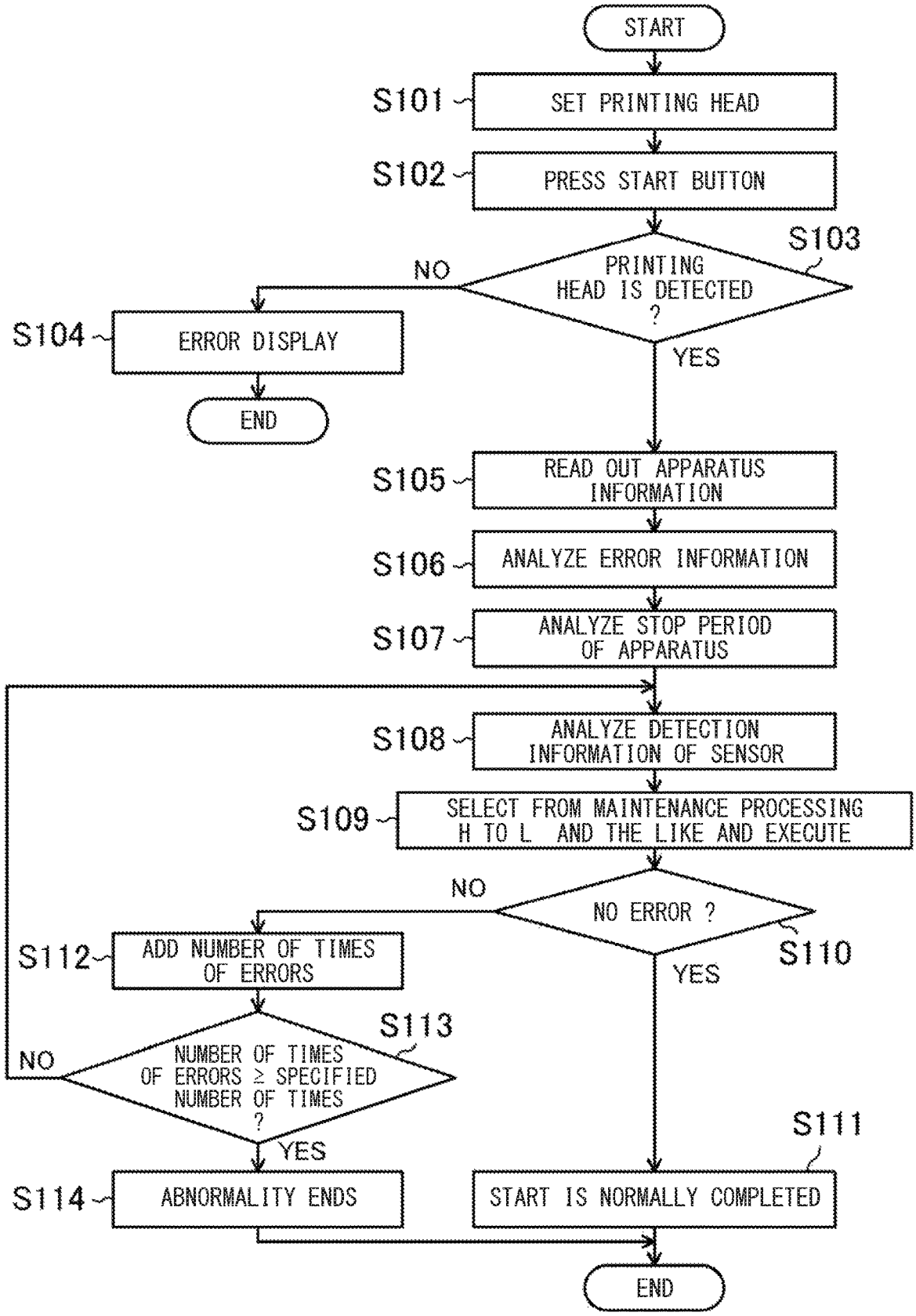
FIG. 16 is a diagram corresponding to FIG. 7 illustrating another example of the maintenance operation.

FIG. 16 is a diagram corresponding to FIG. 7 illustrating another example of the maintenance operation processing. FIG. 17 is a table illustrating details of maintenance processing H to maintenance operation L. As illustrated in FIG. 17, the maintenance-pattern storing unit 102*b* and the control unit 101 can execute processing based on detection results (sensor information) by the soil detecting unit Se1 functioning as the voltage detecting unit and the ink-axis directing unit Se2 functioning as the flow-rate detecting unit.

Specifically, the maintenance-pattern storing unit 102*b* according to the modification stores, in association with each other, the detection result by at least one of the soil detecting unit Se1 and the ink-axis detecting unit Se2 and the plurality of kinds of maintenance operations.

The control unit 101 according to the modification can select, based on the detection result by at least one of the soil detecting unit Se1 and the ink-axis detecting unit Se2, one maintenance operation out of the plurality of kinds of maintenance operations (specifically, the maintenance processing H to the maintenance processing L illustrated in FIG. 17) and execute the maintenance operation.

In the modification, as the selection conditions, in addition to the error flag (the last error) set in the last stop time and the elapsed period (the last stop period) from the last stop processing until the start processing of this time is performed, a combination of the sensor information, an error flag (the last error flag but one) set in the last stop time but one, and an elapsed period (the last stop period but one) from the last stop processing but one until the last start processing is performed is used.

By using such selection conditions, it is possible to prepare a variety of maintenance operations. It is possible to more finely maintain the ink jet recording apparatus I.

A control process executed in the modification is as illustrated in FIG. 16. When the printing head 1 is attached to the head station 200 in step S101 in FIG. 16 and the operation unit 201 functioning as the start button is pressed in step S102, in step S103, the control unit 101 determines whether the printing head 1 is detected. When the determination is NO, the control unit 101 proceeds to step S104 and performs error display.

On the other hand, when the determination in step S103 is YES, the control unit 101 proceeds to step S105. In this case, the control unit 101 reads out apparatus information from the storing unit 102. The apparatus information read out in step S5 includes information indicating the selection conditions according to the modification.

In step S106, the control unit 101 analyzes error information read out from the storing unit 102. The error information includes information indicating the last error and the last error but one. Note that the error information may include an error history before the last error but one.

In step S107, the control unit 101 analyzes the stop period measured by the timer 108. The stop period includes the last stop period and the last stop period but one.

In the subsequent step S108, the control unit 101 analyzes detection information of a sensor (sensor information). The sensor information includes a detection result by the soil detecting unit Se1 and a detection result (sensor information) by the ink-axis detecting unit Se2. The detection result by the soil detecting unit Se1 can be used to determine whether head soil occurs. A detection result by the ink-axis detecting unit Se2 can be used to determine whether the ink axis (a nozzle axis) is normal.

In the subsequent step S109, the control unit 101 determines selection conditions obtained by combining the error information, the stop period, and the sensor information and collates the selection conditions with electronic data (a variable table and the like) equivalent to a table illustrated in FIG. 17. The control unit 101 collates the selection conditions to select, from the maintenance processing H to the maintenance processing L, content of a maintenance operation that should be performed on the ink jet recording apparatus I, in particular, the printing head 1 and executes the maintenance operation.

In step S110 following step S108, the control unit 101 determines whether any one maintenance processing of the maintenance processing H to the maintenance processing L selected as the maintenance operation is normally completed. This determination is performed based on whether each of the automatic cleaning, the error release processing, and the start processing is normally successfully ended. A specific determination method is as explained with reference to FIG. 7. In the example illustrated in FIG. 16, the detection result of the soil detecting unit Se1 or the ink-axis detecting unit Se2 is also reflected on the determination in step S110. That is, when head soil is detected by the soil detecting unit Se1 or a nozzle-axis abnormality is detected by the ink-axis detecting unit Se2 as a result of analyzing the detection information of the sensor in step S108, the control unit 101 determines that an error is present.

When the determination in step S110 is YES, the control unit 101 proceeds to step S111. In step S111, the control unit 101 may notify the user via the state display unit 202 that the maintenance operation is normally completed.

On the other hand, when the determination in step S110 is NO, the control unit 101 proceeds to step S112. In this case, the control unit 101 determines that an error occurs in the maintenance operation itself or an error occurs in the detection result of the soil detecting unit Se1 or the ink-axis detecting unit Se2 as explained above, adds one to the number of times of occurrence of errors, and proceeds to step S113.

In step S113, the control unit 101 determines whether the number of times of errors is a specified number of times or more. When the determination is NO, the control unit 101 returns to step S108. Note that the number of times of errors include, as explained above, the number of times of errors that occurred in the maintenance operation itself and the number of times of errors that occurred as an analysis result of the sensor detection information. The numbers of times of errors may be separately added up and compared with different specified number of times or may be totaled and compared with one specified number of times.

After returning to step S108, the control unit 101 performs the analysis of the detection information of the sensor (step S108) and the selection and execution of the maintenance operation (step S109) and the subsequent steps again. On the other hand, when the determination in step S113 is YES, the control unit 101 proceeds to step S114, determines that an abnormality ends, and completes the control process.

The maintenance processing H to the maintenance processing L include at least one of the automatic cleaning, the error release processing, and the start processing. The control unit 101 executes the respective kinds of processing in order.

Note that the maintenance processing H to the maintenance processing L illustrated in FIGS. 16 and 17 are only illustrations. For example, in addition to the maintenance processing H to the maintenance processing L, the maintenance processing A to the maintenance processing G explained above may be included in choices.

For example, the maintenance processing H is a maintenance operation executed when an abnormality did not occur in both the last stop time and the last stop time but one, the last stop period is one hour or less, the last stop period but one is ignored, and the detection result by the sensor information is determined as normal (when soil of the printing head 1 is not detected and deviation of the ink axis is not detected). In this case, the error release processing is unnecessary. The automatic cleaning is also unnecessary. The simple start is executed.

The maintenance processing I is a maintenance operation executed when the deflection leak occurred in the last stop time, the last stop period is one hour or less, an abnormality did not occur in the last stop time but one, the last stop period but one is ignored, and deviation of the ink axis is detected. In this case, the intermittent jetting operation explained with reference to FIG. 13 is executed as the error release processing. The powerful cleaning is executed as the automatic cleaning. The simple start is executed as the start processing. The maintenance processing I is used when the ink jet recording apparatus I normally operated the time before last and normally started last time but the deflection leak occurred in the last stop time. In this case, as a result of collision of the ink and the gutter 16 due to the deviation of the ink axis, the ink is considered to adhere to and soil the inside of the printing head 1. Therefore, it is seen that a cause of the deflection leak is adhesion of foreign matters to the nozzle 12 rather than rebounding of the ink from the work W. Therefore, the foreign matters only have to be removed by the intermittent jetting operation. Further, since the last stop period is relatively short, it is sufficient to execute the simple start. By using the simple start, a time period required for the maintenance operation and a time period required until the printing head 1 is brought into the printable state can be reduced.

The maintenance processing J is a maintenance operation executed when an abnormality did not occur in both the last stop time and the last stop time but one, both of the last stop period and the last stop period but one are ten minutes or less, and head soil is detected. In this case, since the deflection leak is caused if the start processing is executed before the head soil is solved, the powerful cleaning is executed as the automatic cleaning to solve the head soil.

Since the last stop period is relatively short, it is sufficient to execute the simple start. By using the simple start, a time period required for the maintenance operation and a time period required until the printing head 1 is brought into the printable state can be reduced.

The maintenance processing K is a maintenance operation executed when the deflection leak occurred in both the last stop time and the last stop time but one, both of the last stop period and the last stop period but one are ten minutes or less, and head soil is detected. The deflection leak occurring in both the last stop time and the last stop time but one indicates that the deflection leak is not solved, although the powerful cleaning or the like is carried out halfway in the maintenance operation. In view of this and the detection of the head soil, soil due to an environment around the conveyance line L not dissolved by the solvent is considered to adhere to the inside of the printing head 1. In this case, the control unit 101 displays, on the operation display unit 103, a message for urging the user not to carry out all of the automatic cleaning, the error cleaning processing, and the start processing and to manually clean the inside of the printing head 1.

The maintenance processing L is a maintenance operation executed when an abnormality did not occur in both the last stop time and the last stop time but one, an abnormality did not occur in the nozzle in both the last stop time and the last stop time but one, the last stop period and the last stop period but one are ignored, and deviation of the ink axis is not detected. In this case, the error release processing is unnecessary. The automatic cleaning is also unnecessary. The simple start or the normal start is executed.

The modification explained with reference to FIGS. 16 and 17 illustrates a variation of the control content by the control unit 101. However, modifications of the ink jet recording apparatus I are not limited to this.

For example, in the embodiment, the head station 200 is configured as the power supply-less device. However, the present disclosure is not limited to this configuration. The head station 200 may be a device including a power supply.

Modifications relating to a hardware configuration of the head station 200 are explained below.

First Modification of the Head Station 200

Figure 18:
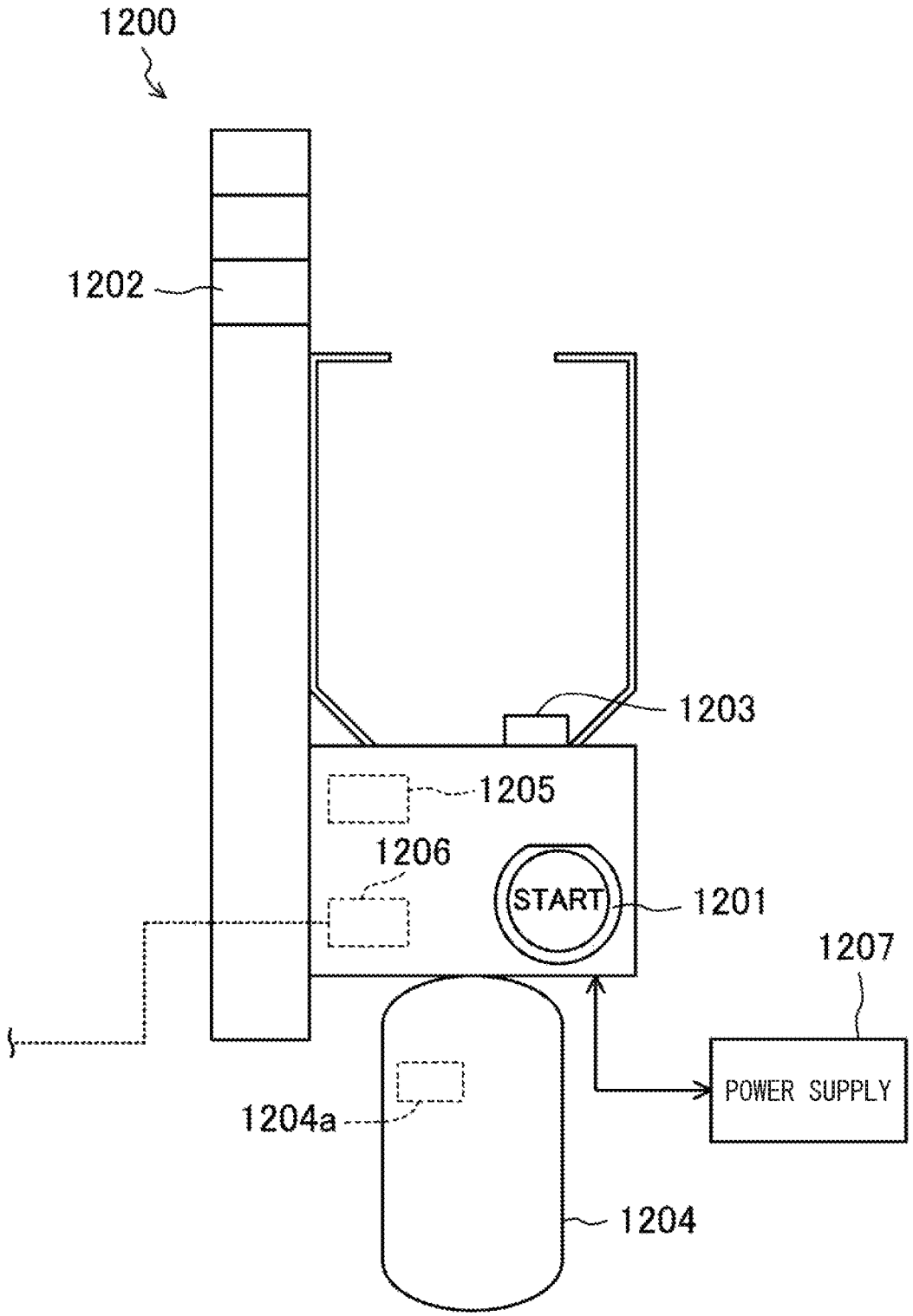
FIG. 18 is a diagram corresponding to FIG. 6A illustrating a first modification of the head station.

FIG. 18 is a diagram corresponding to FIG. 6A illustrating a first modification of the head station 200. In the following explanation, the first modification is denoted by a sign 1200 and is sometime simply referred to as "head station".

As illustrated in FIG. 18, as in the embodiment, the head station 1200 includes an operation unit 1201, a state display unit 1202, an attachment detecting unit 1203, and a waste liquid unit 1204. The head station 1200 according to the first modification further includes a second control unit 1205 that controls the units of the head station 1200 based on electric power supplied from the outside, a communication unit 1206 capable of transmitting and receiving signals between the communication unit 1206 and the controller 100, a leak detecting unit 1204*a* housed in the waste liquid unit 1204, and a power supply 1207 that supplies electric power to the state display unit 1202 functioning as a display unit.

The operation unit 1201 is configured as, for example, a push button and electrically connected to the second control unit 1205. When the operation unit 1201 is pressed, a signal indicating that the operation unit 1201 receives operation is input to the second control unit 1205.

In this case, the second control unit 1205 inputs a signal indicating that the operation unit 1201 is pressed to the controller 100 via the communication unit 1206. The control unit 101 in the controller 100 determines, based on the signal input in that way, whether the operation unit 1201 is pressed in a state in which the printing head 1 is attached to the head station 1200. The control unit 101 is configured to be able to start the maintenance operation when the determination is YES.

The state display unit 1202 includes, for example, an LED element. The control unit 101 in the controller 100 generates a control signal based on an execution state and an execution result of the maintenance operation and inputs the control signal to the second control unit 1205 via the communication unit 1206. The second control unit 1205 can cause, based on the control signal input via the communication unit 1206, the state display unit 1202 to emit light.

The attachment detecting unit 1203 includes, for example, a Hall element. The Hall element detects approach of a magnet provided in the printing head 1 and outputs a signal of the detection to the second control unit 1205. The second control unit 1205 inputs the detection signal to the control unit 101 via the communication unit 1206. The control unit 101 is configured to, when the detection signal from the attachment detecting unit 1203 is input, determine that the printing head 1 is attached to the head station 1200. The detection signal from the attachment detecting unit 1203 functions as a trigger for starting the maintenance operation together with a signal indicating that the operation unit 1201 is pressed.

The leak detecting unit 1204*a* is disposed on the inside of the waste liquid unit 1204. The leak detecting unit 1204*a* is configured by, for example, an ultrasonic sensor and can detect the level of waste liquid. A signal indicating a detection result by the leak detecting unit 1204*a* is output to the control unit 101 via the communication unit 1206 or the like.

The communication unit 1206 is configured to transmit and receive signals between the communication unit 1206 and the second control unit 1205 and the control unit 101 by using wired communication or wireless communication.

Note that, in the first modification, the configuration in which the operation unit 1201 is provided in the head station 1200 is not essential. For example, an operation input to the operation display unit 103, a signal output from the terminal for operation 800, or the like may be used.

In the first modification, the configuration in which the state display unit 1202 is provided in the head station 1200 is not essential either. For example, an execution state, an execution result, and the like of the maintenance operation may be displayed on the operation display unit 103.

In the first place, in the first modification, the configuration in which the second control unit 1205 is provided in the head station 1200 is not essential either. The control unit 101 provided in the controller 100 may be used as the second control unit 1205 as well. The terminal for operation 800, the external device 900, or the like may be used as the second control unit 1205 as well.

Note that, in the embodiment, as illustrated in FIG. 2B, the air tube 106*c* is opened on the inside of the printing head 1. However, the present disclosure is not limited to this configuration. For example, the air may be supplied to the printing head 1 via the head stations 200 and 1200. Similarly, the solvent functioning as the cleaning liquid may be supplied to the printing head 1 via the head stations 200 and 1200.

Further modifications of the head station 200 and 1200 are explained below.

Second Modification of the Head Station 200

Figure 19:
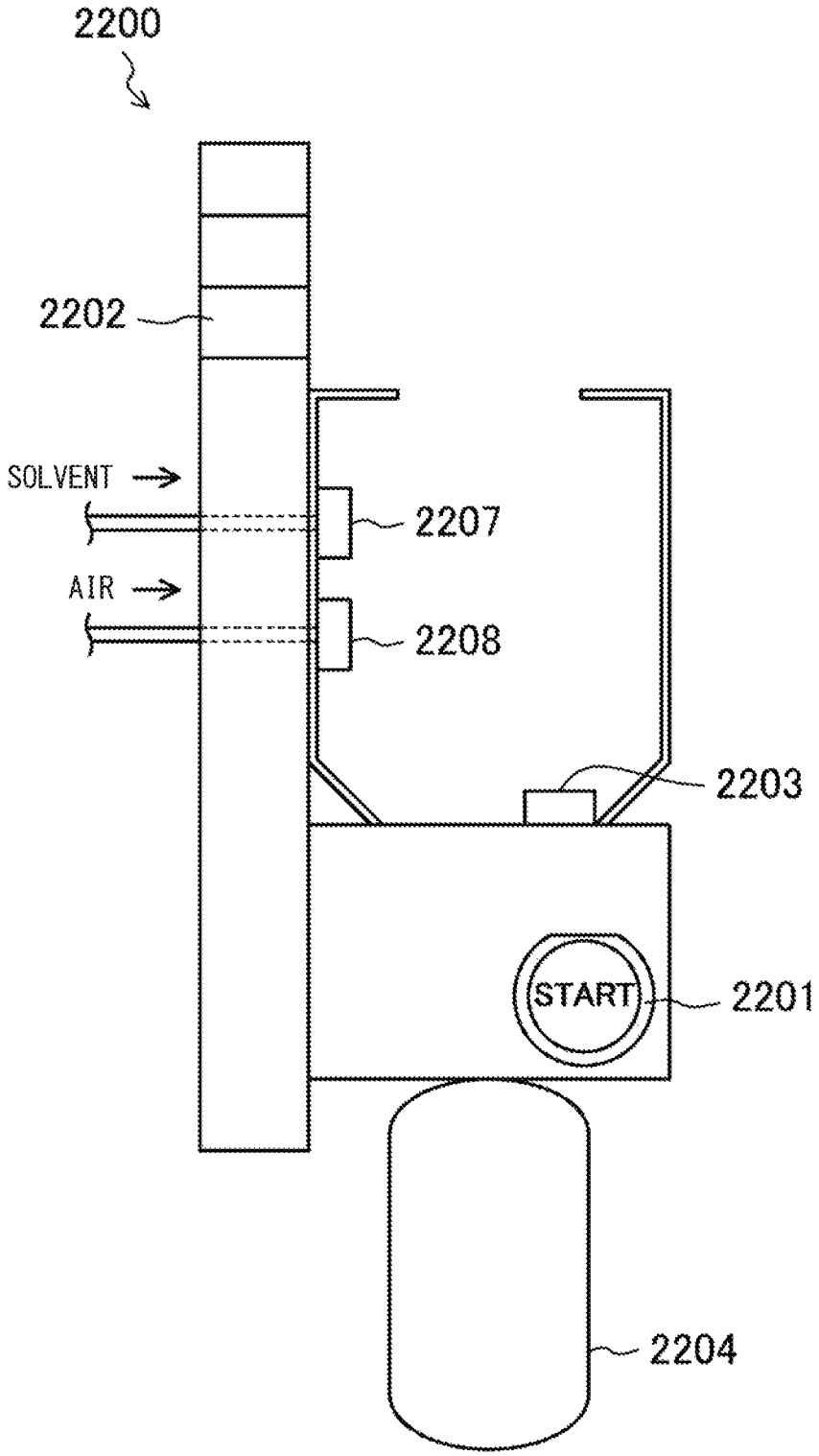
FIG. 19 is a diagram corresponding to FIG. 6A illustrating a second modification of the head station.
Figure 20:
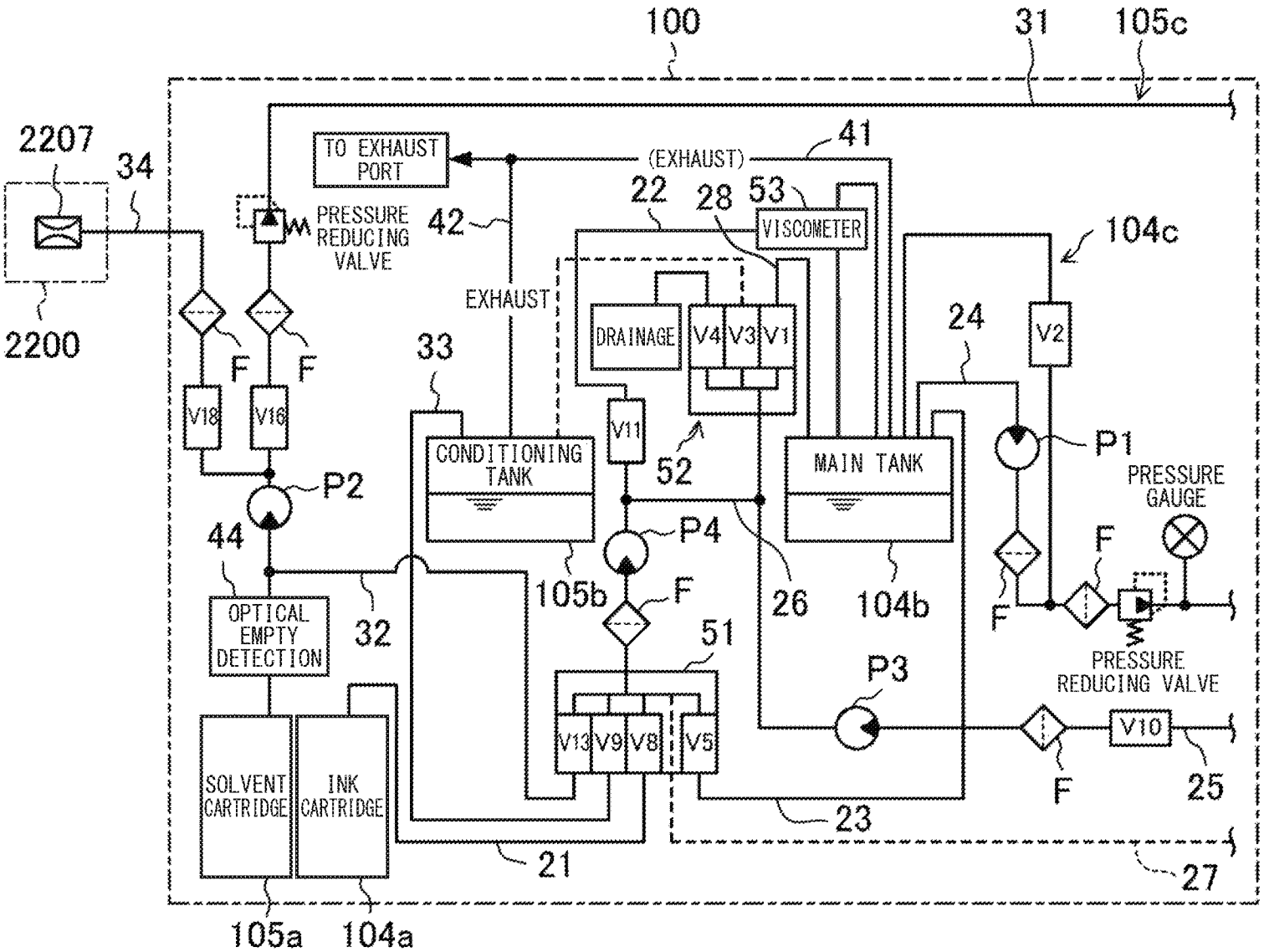
FIG. 20 is a diagram illustrating a relation between the second modification of the head station and a controller.
Figure 21:
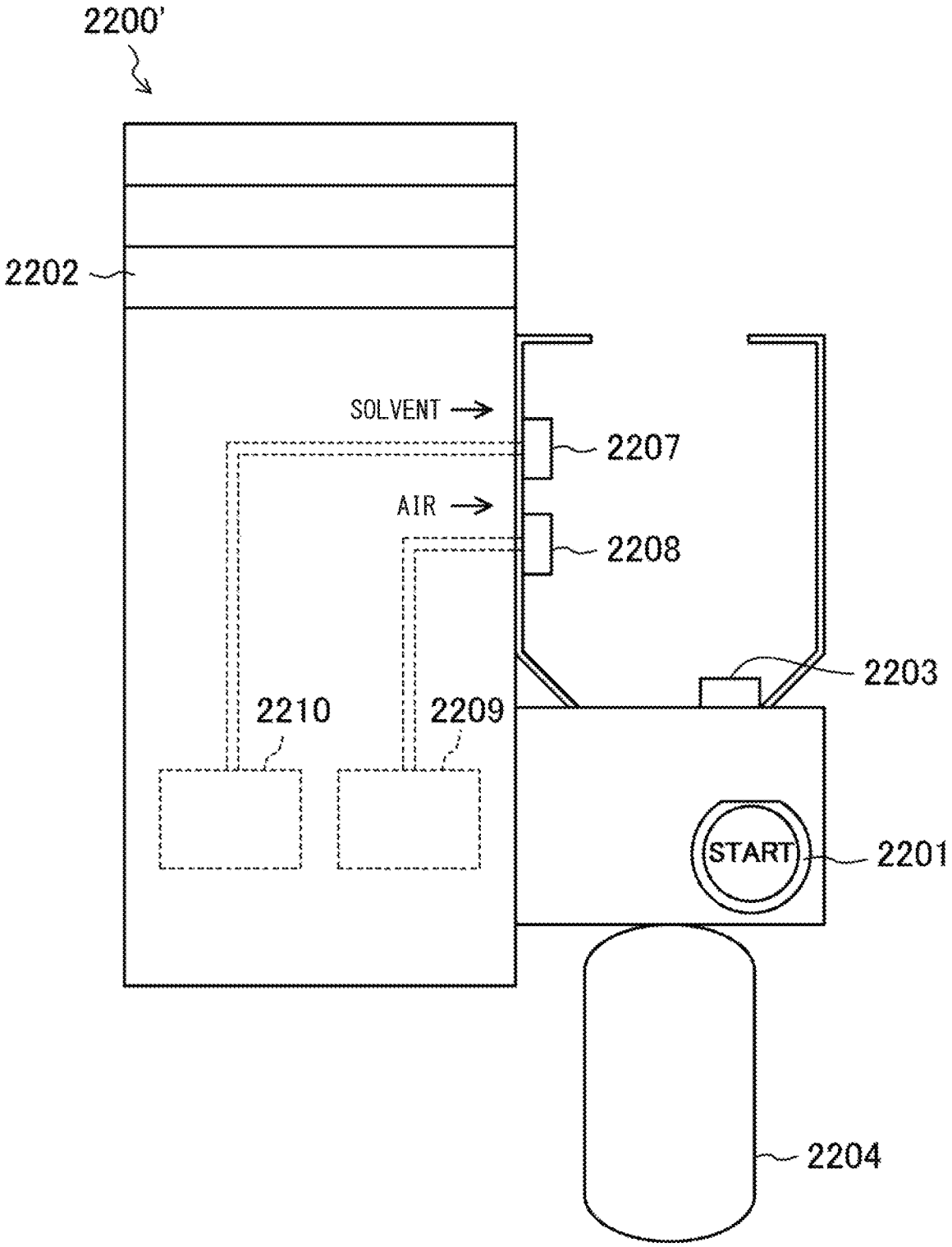
FIG. 21 is a diagram corresponding to FIG. 19 illustrating a further variation of the second modification.

FIG. 19 is a diagram corresponding to FIG. 6A illustrating a second modification of the head station. FIG. 20 is a diagram illustrating a relation between the second modification of the head station and the controller 100. FIG. 21 is a diagram corresponding to FIG. 19 illustrating a further variation of the second modification. In the following explanation, the second modification is denoted by a sign 2200 or 2200' and sometimes simply referred to as "head station".

As illustrated in FIG. 19, as in the embodiment and the first modification, the head station 2200 includes an operation unit 2201, a state display unit 2202, an attachment detecting unit 2203, and a waste liquid unit 2204. These components are configured the same as those in the first modification. Therefore, explanation of the components is omitted.

However, the head station 2200 includes control means dedicated to the head station 2200 like the second control unit 1205 in the first modification. The control unit 101 in the controller 100 is configured to control the units of the head station 2200.

The head station 2200 according to the second modification further includes a solvent ejecting unit 2207 for supplying the solvent supplied from the outside to the printing head 1 and an air ejecting unit 2208 for supplying the air supplied from the outside to the printing head 1.

As illustrated in FIG. 20, the solvent ejecting unit 2207 is connected to the first solvent path 31 via the eighteenth valve V18 and the fourth solvent path 34. The solvent ejecting unit 2207 can eject the solvent stored in the solvent cartridge 105*a* to the inside of the head station 2200.

In a state in which the printing head 1 is attached to the head station 2200, the solvent ejecting unit 2207 can communicate with a solvent introducing port (not illustrated) opened on a side surface of the printing head 1. The solvent can be fed into the inside of the printing head 1 through the solvent introducing port.

The air ejecting unit 2208 can eject, to the inside of the head station 2200, the air supplied from an air supply source (not illustrated) provided on the outside.

In a state in which the printing head 1 is attached to the head station 2200, the air ejecting unit 2208 can communicate with an air introducing port (not illustrated) opened on the side surface of the printing head 1. The air can be fed into the inside of the printing head 1 through the air introducing port.

Note that the solvent supply source and the air supply source may be set on the outside of the controller 100 or may be set on the inside of the head station 2200. In the latter case, as in the head station 2200' illustrated in FIG. 21, an air supply source 2209 storing the air and a solvent supply source 2210 storing the solvent functioning as the cleaning liquid are housed in a housing forming the head station 2200'.

In the second modification, the solvent introducing port and the air introducing port are not essential. For example, the printing head 1 from which the head cover 10*f* is detached can be attached to the head station 2200. The solvent can be directly supplied from the solvent ejecting unit 2207. The air can be directly supplied from the air ejecting unit 2208. Alternatively, instead of using the printing head 1 in which the solvent introducing port and the air introducing port are provided or using the printing head 1 from which the head cover 10*f* is detached, the solvent and the air can also be supplied from the ejection port 10*b* provided on the lower surface 10*a* of the housing 10.

Other Embodiments

In the embodiment, the first modification, and the second modification, the ink jet recording apparatus I includes the head stations 200, 1200, and 2200 dedicated to the printing head 1. However, the present disclosure is not limited to this configuration. For example, when members equivalent to the waste liquid units 204, 1204, and 2204 are attached to the printing head 1, the head stations 200, 1200, and 2200 can be omitted.

Figure 22:
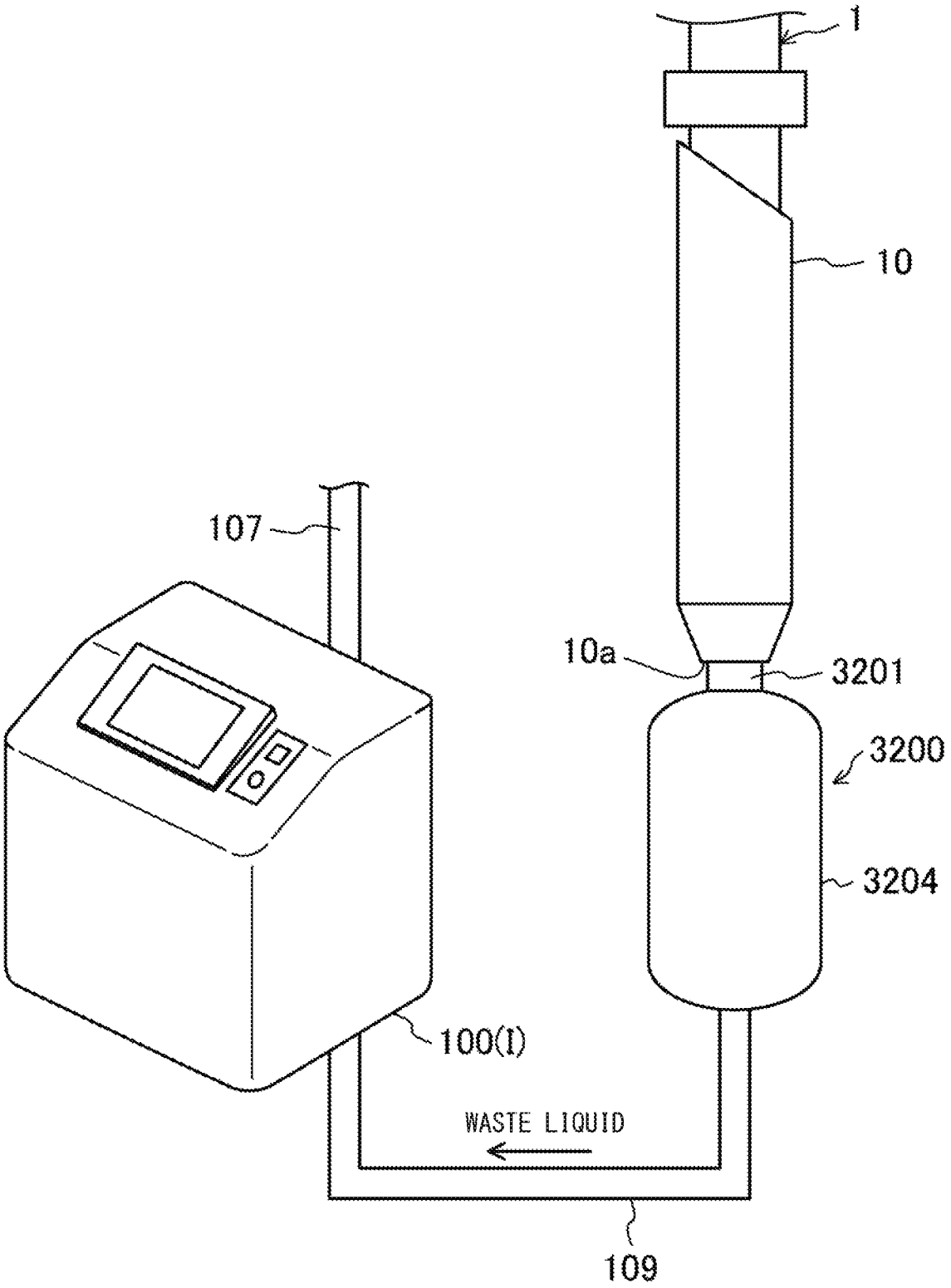
FIG. 22 is a diagram illustrating a configuration in which the head station is omitted.

FIG. 22 is a diagram illustrating a configuration that make a head station unnecessary. Like the waste liquid units 204, 1204, and 2204, a cleaning liquid collection instrument 3200 illustrated in FIG. 22 includes a collection tank 3204 capable of storing the solvent (the waste liquid) used for the cleaning operation. The cleaning liquid collection instrument 3200 includes a connecting unit 3201 that connects, in terms of fluid, the ejection port 10*b* provided on the lower surface 10*a* of the printing head 1 and a collection tank 3204 while sealing the ejection port 10*b* and the collection tank 3204 from the outside. The solvent used for the cleaning operation is stored in the collection tank 3204 via the connecting unit 3201. The cleaning liquid collection instrument 3200 further includes a waste liquid supply pipe 109 that connects the collection tank 3204 and the controller 100 in terms of fluid. The waste liquid supply pipe 109 may be configured as a part of the connection cable 107 or may be provided as a pipe independent from the connection cable 107. The solvent stored in the collection tank 3204 is supplied to the controller 100 through the waste liquid supply pipe 109.

Note that, in the configuration illustrated in FIG. 22, the cleaning liquid collection instrument 3200 is not essential. When the cleaning liquid collection instrument 3200 is omitted, a seal member (not illustrated) for liquid-tightly sealing the ejection port 10*b* can be provided around the ejection port 10*b*. Consequently, in a state in which the ejection port 10*b* is sealed by the seal member, the printing head 1 and the waste liquid supply pipe 109 can be directly connected via the ejection port 10*b*. In this case, the solvent (the waste liquid) used for the cleaning operation is collected by the controller 100 via the waste liquid supply pipe 109.

As explained above, the technique disclosed herein is not limited to the configurations including the head stations 200, 1200, and 2200 and can be implemented in various forms.

What is claimed is:

1. An ink jet recording apparatus that performs printing by ejecting particulate ink on work, the ink jet recording apparatus comprising:

a printing head configured to house, on an inside, a nozzle that ejects ink, a charging electrode that charges the particulate ink ejected from the nozzle, a deflection electrode that deflects a flying direction of the ink charged by the charging electrode, and a gutter that collects the ink undeflected by the deflection electrode, the printing head ejecting the ink deflected by the deflection electrode to an outside;

a controller including an ink supply unit that supplies the ink to the nozzle and a solvent supply unit that supplies a solvent to the nozzle;

a maintenance-pattern storing unit configured to store a table where a plurality of different types of abnormalities that occur in the ink jet recording apparatus and a plurality of kinds of maintenance operations executable in the ink jet recording apparatus are associated with each other;

a flag storing unit configured to store an error flag corresponding to a type of an abnormality as part of a history of abnormalities that occurred in the past when the abnormality occurs in the inkjet recording apparatus; and a control unit configured to select, based on the table stored in the maintenance-pattern storing unit and the type of the abnormality corresponding to the error flag stored in the flag storing unit, one maintenance operation out of the plurality of kinds of maintenance operations stored in the maintenance-pattern storing unit and execute the maintenance operation.

2. The ink jet recording apparatus according to claim 1, wherein the control unit selects, based on a type of an abnormality corresponding to an error flag not cleared in the flag storing unit among a plurality of the error flags, one maintenance operation out of the plurality of kinds of maintenance operations and executes the maintenance operation.

3. The ink jet recording apparatus according to claim 1, further comprising a time measuring unit configured to measure a stop period from execution of stop processing for the ink jet recording apparatus to a start of start processing for the ink jet recording apparatus, wherein the maintenance-pattern storing unit stores the plurality of kinds of maintenance operations respectively in association with the types of the abnormalities and the stop period, and the control unit selects, based on the type of the abnormality corresponding to the error flag stored in the flag storing unit and the stop period measured by the time measuring unit, one maintenance operation out of the plurality of kinds of maintenance operations and executes the maintenance operation.

4. The ink jet recording apparatus according to claim 1, wherein the maintenance-pattern storing unit stores at least one maintenance operation among the plurality of kinds of maintenance operations in association with a case in which all the error flags are cleared in the flag storing unit, the control unit selects and executes maintenance operations respectively when all the error flags are cleared in the flag storing unit and when any one of the error flags is not cleared, and an execution time of the maintenance operation selected when all the error flags are cleared in the flag storing unit is short compared with an execution time of the maintenance operation selected when any one of the error flags is not cleared.

5. The ink jet recording apparatus according to claim 1, wherein the control unit selects, based on a type of an abnormality corresponding to an error flag stored at a point in time when power supply to the ink jet recording apparatus is interrupted among the error flags, one maintenance operation out of the plurality of kinds of maintenance operations and executes the maintenance operation.

6. The ink jet recording apparatus according to claim 1, wherein the control unit selects one maintenance operation out of the plurality of kinds of maintenance operations and executes the maintenance operation when the ink jet recording apparatus is turned on.

7. The ink jet recording apparatus according to claim 1, wherein the plurality of kinds of maintenance operations include a plurality of kinds of cleaning operations for performing cleaning using a solvent supplied from the solvent supply unit.

8. The ink jet recording apparatus according to claim 7, wherein the plurality of cleaning operations are set such that at least one of execution times thereof and supply paths of the solvent are different from one another.

9. The ink jet recording apparatus according to claim 1, further comprising:

a voltage detecting unit configured to detect a voltage applied to the deflection electrode; and a flow-rate detecting unit configured to detect a flow rate of the ink collected by the gutter, wherein the maintenance-pattern storing unit stores the plurality of kinds of maintenance operations respectively in association with a detection result by at least one of the voltage detecting unit and the flow-rate detecting unit, and the control unit selects, based on the detection result by at least one of the voltage detecting unit and the flow-rate detecting unit, one maintenance operation out of the plurality of kinds of maintenance operations and executes the maintenance operation.

10. The ink jet recording apparatus according to claim 1, further comprising:

a head station to which the printing head is attached;

a detecting unit provided in the head station and configured to detect the attachment of the printing head; and an operation unit provided in the head station or the controller and for causing the control unit to start the maintenance operation, wherein the control unit executes the maintenance operation on the printing head when the operation unit is operated in a state in which the printing head is attached to the head station.

11. The ink jet recording apparatus according to claim 10, wherein the head station includes:

a display unit configured to display information related to the maintenance operation; and a power supply configured to supply electric power to the display unit.

12. The ink jet recording apparatus according to claim 1, wherein the type of the abnormality includes nozzle clogging indicating that the nozzle is clogged.

13. The ink jet recording apparatus according to claim 1, wherein the type of the abnormality includes deflection leak indicating that the deflection electrode is soiled.

* * * * *